US006998381B2

(12) United States Patent
Grimm et al.

(10) Patent No.: US 6,998,381 B2
(45) **Date of Patent: *Feb. 14, 2006**

(54) CONCENTRATED, STABLE, PREFERABLY CLEAR, FABRIC SOFTENING COMPOSITION CONTAINING AMINE FABRIC SOFTENER

(75) Inventors: Kimberly Ann Grimm, Cincinnati, OH (US); Dennis Ray Bacon, Milford, OH (US); Toan Trinh, Maineville, OH (US); Errol Hoffman Wahl, Cincinnati, OH (US); Helen Bernardo Tordil, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 8 days.

This patent is subject to a terminal disclaimer.

(21) Appl. No.: 10/389,480

(22) Filed: Mar. 14, 2003

(65) Prior Publication Data

US 2004/0002436 A1 Jan. 1, 2004

Related U.S. Application Data

(63) Continuation of application No. 09/463,103, filed as application No. PCT/IB98/01104 on Jul. 20, 1998, now Pat. No. 6,630,441.

(60) Provisional application No. 60/054,141, filed on Jul. 29, 1997.

(51) Int. Cl.
*C11D 1/58* (2006.01)

(52) U.S. Cl. ..... 510/527; 510/500; 510/522

(58) Field of Classification Search ..... 510/500, 510/522, 527
See application file for complete search history.

(56) References Cited

U.S. PATENT DOCUMENTS

| | | | | |
|---|---|---|---|---|
| 4,806,255 | A * | 2/1989 | Konig et al. | 510/522 |
| 4,863,620 | A * | 9/1989 | Coffindaffer | 510/100 |
| 5,399,272 | A * | 3/1995 | Swartley et al. | 510/525 |
| 5,500,138 | A | 3/1996 | Bacon et al. | |
| 6,083,899 | A | 7/2000 | Baker et al. | |
| 6,211,140 | B1 | 4/2001 | Sivik et al. | |
| 6,268,332 | B1 | 7/2001 | Baker et al. | |
| 6,630,441 | B2 * | 10/2003 | Grimm et al. | 510/527 |

FOREIGN PATENT DOCUMENTS

| | | | |
|---|---|---|---|
| EP | 0296995 | B1 | 12/1988 |
| EP | 0404471 | A1 | 12/1990 |
| EP | 534009 | * | 3/1993 |
| EP | 0637625 | A1 | 2/1995 |
| WO | WO 97/03172 | * | 1/1997 |
| ZA | 972461 | | 3/1997 |

* cited by examiner

*Primary Examiner*—John R. Hardee
(74) *Attorney, Agent, or Firm*—Jason J. Camp; David V. Upite

(57) ABSTRACT

Amine fabric softener actives are prepared in dispersion and/or clear form with materials to improve performance by increasing the cationic charge density. These materials include polycationic compounds, especially cationic polymers; single long-chain cationic compounds; and carboxylic acids that increase the acidity in the rinse, thus lowering pH and increasing the percentage of amine fabric softener active that is protonated. Antistatic properties are also improved.

16 Claims, No Drawings

CONCENTRATED, STABLE, PREFERABLY CLEAR, FABRIC SOFTENING COMPOSITION CONTAINING AMINE FABRIC SOFTENER

CROSS REFERENCE TO RELATED APPLICATIONS

This application is a continuation of U.S. application Ser. No. 09/463,103, filed Jan. 19, 2000, now U.S. Pat. No. 6,630,441, which is a national stage application under 35 U.S.C. § 371 of International Application PCT/IB98/01104 with an International filing date of Jul. 20, 1998, this application claims the benefit of Provisional Application No. 60/054,141, filed Jul. 29, 1997 and published in English under PCT Article 21(2), said applications being incorporated herein by reference.

TECHNICAL FIELD

The present invention relates to concentrated, preferably translucent, or, more preferably, clear, aqueous, liquid softening compositions useful for softening cloth. It especially relates to textile softening compositions for use in the rinse cycle of a textile laundering operation to provide excellent fabric-softening/static-control benefits.

BACKGROUND OF THE INVENTION

Concentrated clear compositions containing ester and/or amide linked fabric softening actives are disclosed in copending U.S. application Ser. No. 08/679,694, filed Jul. 11, 1996 in the names of E. H. Wahl, T. Trinh, E. P. Gosselink, J. C. Letton, and M. R. Sivik, for Fabric Softening Compound/Composition, said application being incorporated herein by reference. The fabric softener actives in said applications are all biodegradable ester-linked materials, containing, as long hydrophobic groups, both unsaturated and branched chains. They are also, for the most part, quaternary ammonium compounds.

SUMMARY OF THE INVENTION

The amine fabric softener compositions herein comprise:

A. from about 2% to about 80% of water insoluble amine fabric softener active containing at least two $C_6$–$C_{22}$ hydrocarbyl groups, but no more than one being less than $C_{12}$ and then the other is at least $C_{16}$, the groups having an IV (Iodine Value) of from about 0 to about 140, the groups comprising straight and/or branched chain hydrocarbon groups, said amine softener active being neutralized by an acid; and B. at least one material to increase the cationic charge density of said fabric softener active;

C. optionally, from about 2% to about 60% of quaternary ammonium softener active;

D. optionally, less than about 40% by weight of the composition of principal solvent having a ClogP of from about 0.15 to about 0.64, and at least some degree of asymmetry; and E. aqueous solvent.

Preferably, the compositions are aqueous, stable clear or dispersion fabric softener compositions containing:

A. from about 2% to about 80%, preferably from about 13% to about 75%, more preferably from about 17% to about 70%, and even more preferably from about 19% to about 65%, by weight of the composition, of amine fabric softener active which is selected from:

(1) softener having the formula:

$$(R_{3-m}—NH^{(+)}—[(CH_2)_n—Y—R^1]_mR^1_p)A^-$$

wherein each m and p is 0, 1, or 2, the total of m and p being 2, each $R^1$ is a $C_6$–$C_{22}$, preferably $C_{14}$–$C_{20}$, but no more than one being less than about $C_{12}$ and then the other is at least about 16, hydrocarbyl, or substituted hydrocarbyl substituent, preferably $C_{10}$–$C_{20}$ alkyl or alkenyl (unsaturated alkyl, including polyunsaturated alkyl, also referred to sometimes as "alkylene"), most preferably $C_{12}$–$C_{18}$ alkyl or alkenyl, and where the Iodine Value (hereinafter referred to as "IV") of a fatty acid containing this $R^1$ group is from about 5 to about 140, more preferably from about 80 to about 130; and most preferably from about 90 to about 115 (as used herein, the term "Iodine Value" means the Iodine Value of a "parent" fatty acid, or "corresponding" fatty acid, which is used to define a level of unsaturation for an $R^1$ group that is the same as the level of unsaturation that would be present in a fatty acid containing the same $R^1$ group) with, preferably, a cis/trans ratio of from about 1:1 to about 50:1, the minimum being 1:1, preferably from about 2:1 to about 40:1, more preferably from about 3:1 to about 30:1, and even more preferably from about 4:1 to about 20:1; each $R^1$ can also preferably be a branched chain $C_{14}$–$C_{22}$ alkyl group, preferably a branched chain $C_{16}$–$C_{18}$ group; each R is a short chain $C_1$–$C_6$, preferably $C_1$–$C_3$ alkyl or hydroxyalkyl group, e.g., methyl (most preferred), ethyl, propyl, hydroxyethyl, and the like, benzyl, or $(R^2\ O)_{2-4}H$ where each $R^2$ is a $C_{1-6}$ alkylene group; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$–$C_{22}$, preferably $C_{14}$–$C_{20}$, with each $R^1$ being a hydrocarbyl, or substituted hydrocarbyl group. (As used herein, the "percent of softener active" containing a given $R^1$ group is based upon taking a percentage of the total active based upon the percentage that the given $R^1$ group is, of the total $R^1$ groups present.); and $A^-$ is a softener compatible anion, preferably, chloride, bromide, sulfate, and nitrate, more preferably chloride, and includes the B (3) acid disclosed hereinafter;

(2) softener having the formula:

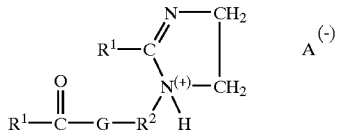

wherein each $R^2$ is a $C_{1-6}$ alkylene group, preferably an ethylene group; and G is an oxygen atom or an —NR— group; and each R, $R^1$, and $A^-$ have the definitions given above;

(3) reaction products of substantially unsaturated and/or branched chain higher fatty acids with dialkylenetriamines in, e.g., a molecular ratio of about 2:1, said reaction products containing compounds of the formula:

$$R^1—C(O)—NH—R^2—NH—C(O)—R^1$$

wherein each $R^1$ and $R^2$ are defined as above, and subsequently neutralized with an acid having the anion $A^-$;

(4) softener having the formula:

$$[R^1—C(O)—NR—R^2—NRH—R^2—NR—C(O)—R^1]^+A^-$$

wherein each R, $R^1$, $R^2$, and $A^-$ are defined as above;

(5) the reaction product of substantially unsaturated and/or branched chain higher fatty acid with triethanolamine, and subsequently neutralized with an acid having the anion $A^-$;

(6) softener having the formula:

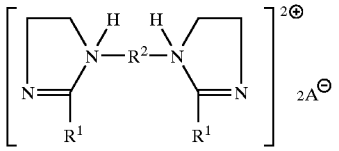

wherein R, $R^1$, $R^2$, and $A^-$ are defined as above; and (7) mixtures thereof;

B. at least one material to increase the cationic charge density of said fabric softener active, said material being selected from the group consisting of:

(1) polycationic compound;

(2) single long chain cationic compound;

(3) acid, preferably carboxylic acid, in an amount at least sufficient to lower the pH of unbuffered water, more preferably sufficient to lower the rinse water pH, by at least about 0.5, preferably at least about 1 pH unit; and (4) mixtures thereof;

C. optionally, from about 2% to about 60% of quaternary softener active;

D. optionally, less than about 40%, preferably from about 10% to about 35%, more preferably from about 12% to about 25%, and even more preferably from about 14% to about 20%, by weight of the composition of principal solvent having a ClogP of from about 0.15 to about 0.64, preferably from about 0.25 to about 0.62, and more preferably from about 0.40 to about 0.60, and the principal solvent preferably being selected from the group consisting of:

I. mono-ols including:

a. n-propanol; and/or b. 2-butanol and/or 2-methyl-2-propanol;

II. hexane diol isomers including: 2,3-butanediol, 2,3-dimethyl-; 1,2-butanediol, 2,3-dimethyl-; 1,2-butanediol, 3,3-dimethyl-; 2,3-pentanediol, 2-methyl-; 2,3-pentanediol, 3-methyl-; 2,3-pentanediol, 4-methyl-; 2,3-hexanediol; 3,4-hexanediol; 1,2-butanediol, 2-ethyl-; 1,2-pentanediol, 2-methyl-; 1,2-pentanediol, 3-methyl-; 1,2-pentanediol, 4-methyl-; and/or 1,2-hexanediol;

III. heptane diol isomers including: 1,3-propanediol, 2-butyl-; 1,3-propanediol, 2,2-diethyl-; 1,3-propanediol, 2-(1-methylpropyl)-; 1,3-propanediol, 2-(2-methylpropyl)-; 1,3-propanediol, 2-methyl-2-propyl-; 1,2-butanediol, 2,3,3-trimethyl-; 1,4-butanediol, 2-ethyl-2-methyl-; 1,4-butanediol, 2-ethyl-3-methyl-; 1,4-butanediol, 2-propyl-; 1,4-butanediol, 2-isopropyl-; 1,5-pentanediol, 2,2-dimethyl-; 1,5-pentanediol, 2,3-dimethyl-; 1,5-pentanediol, 2,4-dimethyl-; 1,5-pentanediol, 3,3-dimethyl-; 2,3-pentanediol, 2,3-dimethyl-; 2,3-pentanediol, 2,4-dimethyl-; 2,3-pentanediol, 3,4-dimethyl-; 2,3-pentanediol, 4,4-dimethyl-; 3,4-pentanediol, 2,3-dimethyl-; 1,5-pentanediol, 2-ethyl-; 1,6-hexanediol, 2-methyl-; 1,6-hexanediol, 3-methyl-; 2,3-hexanediol, 2-methyl-; 2,3-hexanediol, 3-methyl-; 2,3-hexanediol, 4-methyl-; 2,3-hexanediol, 5-methyl-; 3,4-hexanediol, 2-methyl-; 3,4-hexanediol, 3-methyl-; 1,3-heptanediol; 1,4-heptanediol; 1,5-heptanediol; and/or 1,6-heptanediol;

IV. octane diol isomers including: 1,3-propanediol, 2-(2-methylbutyl)-; 1,3-propanediol, 2-(1,1-dimethylpropyl)-1,3-propanediol, 2-(1,2-dimethylpropyl)-; 1,3-propanediol, 2-(1-ethylpropyl)-; 1,3-propanediol, 2-(1-methylbutyl)-; 1,3-propanediol, 2-(2,2-dimethylpropyl)-; 1,3-propanediol, 2-(3-methylbutyl)-; 1,3-propanediol, 2-butyl-2-methyl-; 1,3-propanediol, 2-ethyl-2-isopropyl-; 1,3-propanediol, 2-ethyl-2-propyl-; 1,3-propanediol, 2-methyl-2-(1-methylpropyl)-; 1,3-propanediol, 2-methyl-2-(2-methylpropyl)-; 1,3-propanediol, 2-tertiary-butyl-2-methyl-; 1,3-butanediol, 2,2-diethyl-; 1,3-butanediol, 2-(1-methylpropyl)-; 1,3-butanediol, 2-butyl-; 1,3-butanediol, 2-ethyl-2,3-dimethyl-; 1,3-butanediol, 2-(1,1-dimethylethyl)-; 1,3-butanediol, 2-(2-methylpropyl)-; 1,3-butanediol, 2-methyl-2-isopropyl-; 1,3-butanediol, 2-methyl-2-propyl-; 1,3-butanediol, 3-methyl-2-isopropyl-; 1,3-butanediol, 3-methyl-2-propyl-; 1,4-butanediol, 2,2-diethyl-; 1,4-butanediol, 2-methyl-2-propyl-; 1,4-butanediol, 2-(1-methylpropyl)-; 1,4-butanediol, 2-ethyl-2,3-dimethyl-; 1,4-butanediol, 2-ethyl-3,3-dimethyl-; 1,4-butanediol, 2-(1,1-dimethylethyl)-; 1,4-butanediol, 2-(2-methylpropyl)-; 1,4-butanediol, 2-methyl-3-propyl-; 1,4-butanediol, 3-methyl-2-isopropyl-; 1,3-pentanediol, 2,2,3-trimethyl-; 1,3-pentanediol, 2,2,4-trimethyl-; 1,3-pentanediol, 2,3,4-trimethyl-; 1,3-pentanediol, 2,4,4-trimethyl-; 1,3-pentanediol, 3,4,4-trimethyl-; 1,4-pentanediol, 2,2,3-trimethyl-; 1,4-pentanediol, 2,2,4-trimethyl-; 1,4-pentanediol, 2,3,3-trimethyl-; 1,4-pentanediol, 2,3,4-trimethyl-; 1,4-pentanediol, 3,3,4-trimethyl-; 1,5-pentanediol, 2,2,3-trimethyl-; 1,5-pentanediol, 2,2,4-trimethyl-; 1,5-pentanediol, 2,3,3-trimethyl-; 1,5-pentanediol, 2,3,4-trimethyl-; 2,4-pentanediol, 2,3,3-trimethyl-; 2,4-pentanediol, 2,3,4-trimethyl-; 1,3-pentanediol, 2-ethyl-2-methyl-; 1,3-pentanediol, 2-ethyl-3-methyl-; 1,3-pentanediol, 2-ethyl-4-methyl-; 1,3-pentanediol, 3-ethyl-2-methyl-; 1,4-pentanediol, 2-ethyl-2-methyl-; 1,4-pentanediol, 2-ethyl-3-methyl-; 1,4-pentanediol, 2-ethyl-4-methyl-; 1,4-pentanediol, 3-ethyl-2-methyl-; 1,4-pentanediol, 3-ethyl-3-methyl-; 1,5-pentanediol, 2-ethyl-2-methyl-; 1,5-pentanediol, 2-ethyl-3-methyl-; 1,5-pentanediol, 2-ethyl-4-methyl-; 1,5-pentanediol, 3-ethyl-3-methyl-; 2,4-pentanediol, 3-ethyl-2-methyl-; 1,3-pentanediol, 2-isopropyl-; 1,3-pentanediol, 2-propyl-; 1,4-pentanediol, 2-isopropyl-; 1,4-pentanediol, 2-propyl-; 1,4-pentanediol, 3-isopropyl-; 1,5-pentanediol, 2-isopropyl-; 2,4-pentanediol, 3-propyl-; 1,3-hexanediol, 2,2-dimethyl-; 1,3-hexanediol, 2,3-dimethyl-; 1,3-hexanediol, 2,4-dimethyl-; 1,3-hexanediol, 2,5-dimethyl-; 1,3-hexanediol, 3,4-dimethyl-; 1,3-hexanediol, 3,5-dimethyl-; 1,3-hexanediol, 4,5-dimethyl-; 1,4-hexanediol, 2,2-dimethyl-; 1,4-hexanediol, 2,3-dimethyl-; 1,4-hexanediol, 2,4-dimethyl-; 1,4-hexanediol, 2,5-dimethyl-; 1,4-hexanediol, 3,3-dimethyl-; 1,4-hexanediol, 3,4-dimethyl-; 1,4-hexanediol, 3,5-dimethyl-; 1,3-hexanediol, 4,4-dimethyl-; 1,4-hexanediol, 4,5-dimethyl-; 1,4-hexanediol, 5,5-dimethyl-; 1,5-hexanediol, 2,2-dimethyl-; 1,5-hexanediol, 2,3-dimethyl-; 1,5-hexanediol, 2,4-dimethyl-; 1,5-hexanediol, 2,5-dimethyl-; 1,5-hexanediol, 3,3-dimethyl-; 1,5-hexanediol, 3,4-dimethyl-; 1,5-hexanediol, 3,5-dimethyl-; 1,5-hexanediol, 4,5-dimethyl-; 1,6-hexanediol, 2,2-dimethyl-; 1,6-hexanediol, 2,3-dimethyl-; 1,6-hexanediol, 2,4-dimethyl-; 1,6-hexanediol, 2,5-dimethyl-; 1,6-hexanediol, 3,3-dimethyl-; 1,6-hexanediol, 3,4-dimethyl-; 2,4-hexanediol, 2,3-dimethyl-; 2,4-hexanediol, 2,4-dimethyl-; 2,4-hexanediol, 2,5-dimethyl-; 2,4-hexanediol, 3,3-dimethyl-; 2,4-hexanediol, 3,4-dimethyl-; 2,4-hexanediol, 3,5-dimethyl-; 2,4-hexanediol, 4,5-dimethyl-; 2,4-hexanediol, 5,5-dimethyl-; 2,5-hexanediol, 2,3-dimethyl-; 2,5-hexanediol, 2,4-dimethyl-; 2,5-hexanediol, 2,5-dimethyl-; 2,5-hexanediol, 3,3-dimethyl-; 2,5-hexanediol, 3,4-dimethyl-; 2,6-hexanediol, 3,3-dimethyl-; 1,3-hexanediol, 2-ethyl-; 1,3-hexanediol, 4-ethyl-; 1,4-hexanediol, 2-ethyl-; 1,4-hexanediol, 4-ethyl-; 1,5-hexanediol, 2-ethyl-; 2,4-hexanediol, 3-ethyl-; 2,4-hexanediol, 4-ethyl-; 2,5-hexanediol, 3-ethyl-; 1,3-heptanediol, 2-methyl-; 1,3-heptanediol, 3-methyl-; 1,3-heptanediol, 4-methyl-; 1,3-heptanediol, 5-methyl-; 1,3-heptanediol, 6-methyl-; 1,4-heptanediol, 2-methyl-; 1,4-heptanediol, 3-methyl-; 1,4-heptanediol, 4-methyl-; 1,4-heptanediol, 5-methyl-; 1,4-heptanediol, 6-methyl-; 1,5-heptanediol, 2-methyl-; 1,5-heptanediol, 3-methyl-; 1,5-heptanediol, 4-methyl-; 1,5-heptanediol, 1,6-heptanediol, 3-methyl-; 1,6-heptanediol, 4-methyl-; 1,6-heptanediol, 5-methyl-; 1,6-heptanediol, 6-methyl-; 2,4-heptanediol, 2-methyl-; 2,4-heptanediol, 3-methyl-; 2,4-heptanediol, 4-methyl-; 2,4-heptanediol, 5-methyl-; 2,4-heptanediol, 6-methyl-; 2,5-heptanediol, 2-methyl-; 2,5-heptanediol, 3-methyl-; 2,5-heptanediol, 4-methyl-; 2,5-heptanediol, 5-methyl-; 2,5-heptanediol, 6-methyl-; 2,6-heptanediol, 2-methyl-; 2,6-heptanediol, 3-methyl-; 2,6-heptanediol, 4-methyl-; 3,4-heptanediol, 3-methyl-; 3,5-heptanediol, 2-methyl-; 3,5-heptanediol, 3-methyl-; 3,5-heptanediol, 4-methyl-; 2,4-octanediol; 2,5-octanediol; 2,6-octanediol; 2,7-octanediol; 3,5-octanediol; and/or 3,6-octanediol;

V. nonane diol isomers including: 2,4-pentanediol, 2,3,3,4-tetramethyl-; 2,4-pentanediol, 3-tertiarybutyl-; 2,4-hexanediol, 2,5,5-trimethyl-; 2,4-hexanediol, 3,3,4-trimethyl-; 2,4-hexanediol, 3,3,5-trimethyl-; 2,4-hexanediol, 3,5,5-trimethyl-; 2,4-hexanediol, 4,5,5-trimethyl-; 2,5-hexanediol, 3,3,4-trimethyl-; and/or 2,5-hexanediol, 3,3,5-trimethyl-;

VI. glyceryl ethers and/or di(hydroxyalkyl)ethers including: 1,2-propanediol, 3-(n-pentyloxy)-; 1,2-propanediol, 3-(2-pentyloxy)-; 1,2-propanediol, 3-(3-pentyloxy)-; 1,2-propanediol, 3-(2-methyl-1-butyloxy)-; 1,2-propanediol, 3-(iso-amyloxy)-; 1,2-propanediol, 3-(3-methyl-2-butyloxy)-; 1,2-propanediol, 3-(cyclohexyloxy)-; 1,2-propanediol, 3-(1-cyclohex-1-enyloxy)-; 1,3-propanediol, 2-(pentyloxy)-; 1,3-propanediol, 2-(2-pentyloxy)-; 1,3-propanediol, 2-(3-pentyloxy)-; 1,3-propanediol, 2-(2-methyl-1-butyloxy)-; 1,3-propanediol, 2-(iso-amyloxy)-; 1,3-propanediol, 2-(3-methyl-2-butyloxy)-; 1,3-propanediol, 2-(cyclohexyloxy)-; 1,3-propanediol, 2-(1-cyclohex-1-enyloxy)-; 1,2-propanediol, 3-(butyloxy)-, triethoxylated; 1,2-propanediol, 3-(butyloxy)-, tetraethoxylated; 1,2-propanediol, 3-(butyloxy)-, pentaethoxylated; 1,2-propanediol, 3-(butyloxy)-, hexaethoxylated; 1,2-propanediol, 3-(butyloxy)-, heptaethoxylated; 1,2-propanediol, 3-(butyloxy)-, octaethoxylated; 1,2-propanediol, 3-(butyloxy)-, nonaethoxylated; 1,2-propanediol, 3-(butyloxy)-, monopropoxylated; 1,2-propanediol, 3-(butyloxy)-, dibutyleneoxylated; 1,2-propanediol, 3-(butyloxy)-, tributyleneoxylated; 1,2-propanediol, 3-phenyloxy-; 1,2-propanediol, 3-benzyloxy-; 1,2-propanediol, 3-(2-phenylethyloxy)-; 1,2-propanediol, 3-(1-phenyl-2-propanyloxy)-; 1,3-propanediol, 2-phenyloxy-; 1,3-propanediol, 2-(m-cresyloxy)-; 1,3-propanediol, 2-(p-cresyloxy)-; 1,3-propanediol, -benzyloxy-; 1,3-propanediol, 2-(2-phenylethyloxy)-; 1,3-propanediol, 2-(1-phenylethyloxy)-; bis(2-hydroxybutyl)ether; and/or bis(2-hydroxycyclopentyl)ether;

VII. saturated and unsaturated alicyclic diols and their derivatives including:

(a) the saturated diols and their derivatives, including: 1-isopropyl-1,2-cyclobutanediol; 3-ethyl-4-methyl-1,2-cyclobutanediol; 3-propyl-1,2-cyclobutanediol; 3-isopropyl-1,2-cyclobutanediol; 1-ethyl-1,2-cyclopentanediol; 1,2-dimethyl-1,2-cyclopentanediol; 1,4-dimethyl-1,2-cyclopentanediol; 2,4,5-trimethyl-1,3-cyclopentanediol; 3,3-dimethyl-1,2-cyclopentanediol; 3,4-dimethyl-1,2-cyclopentanediol; 3,5-dimethyl-1,2-cyclopentanediol; 3-ethyl-1,2-cyclopentanediol; 4,4-dimethyl-1,2-cyclopentanediol; 4-ethyl-1,2-cyclopentanediol; 1,1-bis(hydroxymethyl)cyclohexane; 1,2-bis(hydroxymethyl)cyclohexane; 1,2-dimethyl-1,3-cyclohexanediol; 1,3-bis(hydroxymethyl)cyclohexane; 1,3-dimethyl-1,3-cyclohexanediol; 1,6-dimethyl-1,3-cyclohexanediol; 1-hydroxy-cyclohexaneethanol; 1-hydroxy-cyclohexanemethanol; 1-ethyl-1,3-cyclohexanediol; 1-methyl-1,2-cyclohexanediol; 2,2-dimethyl-1,3-cyclohexanediol; 2,3-dimethyl-1,4-cyclohexanediol; 2,4-dimethyl-1,3-cyclohexanediol; 2,5-dimethyl-1,3-cyclohexanediol; 2,6-dimethyl-1,4-cyclohexanediol; 2-ethyl-1,3-cyclohexanediol; 2-hydroxycyclohexaneethanol; 2-hydroxyethyl-1-cyclohexanol; 2-hydroxymethylcyclohexanol; 3-hydroxyethyl-1-cyclohexanol; 3-hydroxycyclohexaneethanol; 3-hydroxymethylcyclohexanol; 3-methyl-1,2-cyclohexanediol; 4,4-dimethyl-1,3-cyclohexanediol; 4,5-dimethyl-1,3-cyclohexanediol; 4,6-dimethyl-1,3-cyclohexanediol; 4-ethyl-1,3-cyclohexanediol; 4-hydroxyethyl-1-cyclohexanol; 4-hydroxymethylcyclohexanol; 4-methyl-1,2-cyclohexanediol; 5,5-dimethyl-1,3-cyclohexanediol; 5-ethyl-1,3-cyclohexanediol; 1,2-cycloheptanediol; 2-methyl-1,3-cycloheptanediol; 2-methyl-1,4-cycloheptanediol; 4-methyl-1,3-cycloheptanediol; 5-methyl-1,3-cycloheptanediol; 5-methyl-1,4-cycloheptanediol; 6-methyl-1,4-cycloheptanediol; ; 1,3-cyclooctanediol; 1,4-cyclooctanediol; 1,5-cyclooctanediol; 1,2-cyclohexanediol, diethoxylate; 1,2-cyclohexanediol, triethoxylate; 1,2-cyclohexanediol, tetraethoxylate; 1,2-cyclohexanediol, pentaethoxylate; 1,2-cyclohexanediol, hexaethoxylate; 1,2-cyclohexanediol, heptaethoxylate; 1,2-cyclohexanediol, octaethoxylate; 1,2-cyclohexanediol, nonaethoxylate; 1,2-cyclohexanediol, monopropoxylate; 1,2-cyclohexanediol, monobutylenoxylate; 1,2-cyclohexanediol, dibutylenoxylate; and/or 1,2-cyclohexanediol, tributylenoxylate; and (b). the unsaturated alicyclic diols including: 1,2-cyclobutanediol, 1-ethenyl-2-ethyl-; 3-cyclobutene-1,2-diol, 1,2,3,4-tetramethyl-; 3-cyclobutene-1,2-diol, 3,4-diethyl-; 3-cyclobutene-1,2-diol, 3-(1,1-dimethylethyl)-; 3-cyclobutene-1,2-diol, 3-butyl-; 1,2-cyclopentanediol, 1,2-dimethyl-4-methylene-; 1,2-cyclopentanediol, 1-ethyl-3-methylene-; 1,2-cyclopentanediol, 4-(1-propenyl); 3-cyclopentene-1,2-diol, 1-ethyl-3-methyl-; 1,2-cyclohexanediol 1-ethenyl-; 1,2-cyclohexanediol, 1-methyl-3-methylene-; 1,2-cyclohexanediol, 1-methyl-4-methylene-; 1,2-cyclohexanediol, 3-ethenyl-; 1,2-cyclohexanediol, 4-ethenyl-; 3-cyclohexene-1,2-diol, 2,6-dime 3-cyclohexene-1,2-diol, 6,6-dimethyl-; 4-cyclohexene-1,2-diol, 3,6-dimethyl-; 4-cyclohexene-1,2-diol, 4,5-dimethyl-; 3-cyclooctene-1,2-diol; 4-cyclooctene-1,2-diol; and/or 5-cyclooctene-1,2-dio VIII. Alkoxylated derivatives of $C_{3-8}$ diols [In the following disclosure, "EO" means polyethoxylates, i.e., —$(CH_2CH_2O)_nH$; Me-$E_n$ means methyl-capped polyethoxylates —$(CH_2CH_2O)_nCH_3$;"2(Me-En)" means 2

Me-En groups needed; "PO" means polypropoxylates, —$(CH(CH_3)CH_2O)_nH$; "BO" means polybutyleneoxy groups, $(CH(CH_2CH_3)CH_2O)_nH$; and "n-BO" means poly(n-butyleneoxy) or poly(tetramethylene)oxy groups —$(CH_2CH_2CH_2CH_2O)_nH$. The use of the term "$(C_x)$" herein refers to the number of carbon atoms in the base material which is alkoxylated.] including:

1. 1,2-propanediol (C3) 2(Me-$E_{1-4}$); 1,2-propanediol (C3) $PO_4$; 1,2-propanediol, 2-methyl- (C4) (Me-$E_{4-10}$); 1,2-propanediol, 2-methyl- (C4) 2(Me-$E_1$); 1,2-propanediol, 2-methyl- (C4) $PO_3$; 1,2-propanediol, 2-methyl- (C4) $BO_1$; 1,3-propanediol (C3) 2(Me-$E_{6-8}$); 1,3-propanediol (C3) $PO_{5-6}$; 1,3-propanediol, 2,2-diethyl- (C7) $E_{1-7}$; 1,3-propanediol, 2,2-diethyl- (C7) $PO_1$; 1,3-propanediol, 2,2-diethyl- (C7) n-$BO_{1-2}$; 1,3-propanediol, 2,2-dimethyl- (C5) 2(Me $E_{1-2}$); 1,3-propanediol, 2,2-dimethyl- (C5) $PO_{3-4}$; 1,3-propanediol, 2-(1-methylpropyl)- (C7) $E_{1-7}$; 1,3-propanediol, 2-(1-methylpropyl)- (C7) $PO_1$; 1,3-propanediol, 2-(1-methylpropyl)- (C7) n-$BO_{1-2}$; 1,3-propanediol, 2-(2-methylpropyl)- (C7) $E_{1-7}$; 1,3-propanediol, 2-(2-methylpropyl)- (C7) $PO_1$; 1,3-propanediol, 2-(2-methylpropyl)- (C7) n-$BO_{1-2}$; 1,3-propanediol, 2-ethyl- (C5) (Me $E_{6-10}$); 1,3-propanediol, 2-ethyl- (C5) 2(Me $E_1$); 1,3-propanediol, 2-ethyl- (C5) $PO_3$; 1,3-propanediol, 2-ethyl-2-methyl- (C6) (Me $E_{1-6}$); 1,3-propanediol, 2-ethyl-2-methyl- (C6) $PO_2$; 1,3-propanediol, 2-ethyl-2-methyl- (C6) $BO_1$; 1,3-propanediol, 2-isopropyl- (C6) (Me $E_{1-6}$); 1,3-propanediol, 2-isopropyl- (C6) $PO_2$; 1,3-propanediol, 2-isopropyl- (C6) $BO_1$; 1,3-propanediol, 2-methyl- (C4) 2(Me $E_{2-5}$); 1,3-propanediol, 2-methyl- (C4) $PO_{4-5}$; 1,3-propanediol, 2-methyl- (C4) $BO_2$; 1,3-propanediol, 2-methyl-2-isopropyl- (C7) $E_{2-9}$; 1,3-propanediol, 2-methyl-2-isopropyl- (C7) $PO_1$; 1,3-propanediol, 2-methyl-2-isopropyl- (C7) n-$BO_{1-3}$; 1,3-propanediol, 2-methyl-2-propyl- (C7) $E_{1-7}$; 1,3-propanediol, 2-methyl-2-propyl- (C7) $PO_1$; 1,3-propanediol, 2-methyl-2-propyl- (C7) n-$BO_{1-2}$; 1,3-propanediol, 2-propyl- (C6) (Me $E_{1-4}$); 1,3-propanediol, 2-propyl- (C6) $PO_2$; 1,3-propanediol, 2-propyl- (C6) $BO_1$;

2. 1,2-butanediol (C4) (Me $E_{2-8}$); 1,2-butanediol (C4) $PO_{2-3}$; 1,2-butanediol (C4) $BO_1$; 1,2-butanediol, 2,3-dimethyl- (C6) $E_{1-6}$; 1,2-butanediol, 2,3-dimethyl- (C6) n-$BO_{1-2}$; 1,2-butanediol, 2-ethyl- (C6) $E_{1-3}$; 1,2-butanediol, 2-ethyl- (C6) n-$BO_1$; 1,2-butanediol 2-methyl- (C5) (Me $E_{1-2}$); 1,2-butanediol, 2-methyl- (C5) $PO_1$; 1,2-butanediol, 3,3-dimethyl- (C6) $E_{1-6}$; 1,2-butanediol, 3,3-dimethyl- (C6) n-$BO_{1-2}$; 1,2-butanediol, 3-methyl- (C5) (Me $E_{1-2}$); 1,2-butanediol, 3-methyl- (C5) $PO_1$; 1,3-butanediol (C4) 2(Me $E_{3-6}$); 1,3-butanediol (C4) $PO_5$; 1,3-butanediol (C4) $BO_2$; 1,3-butanediol, 2,2,3-trimethyl- (C7) (Me $E_{1-3}$); 1,3-butanediol, 2,2,3-trimethyl- (C7) $PO_{1-2}$; 1,3-butanediol, 2,2-dimethyl- (C6) (Me $E_{3-8}$); 1,3-butanediol, 2,2-dimethyl- (C6) $PO_3$; 1,3-butanediol, 2,3-dimethyl- (C6) (Me $E_{3-8}$); 1,3-butanediol, 2,3-dimethyl- (C6) $PO_3$; 1,3-butanediol, 2-ethyl- (C6) (Me $E_{1-6}$); 1,3-butanediol, 2-ethyl- (C6) $PO_{2-3}$; 1,3-butanediol, 2-ethyl- (C6) $BO_1$; 1,3-butanediol, 2-ethyl-2-methyl- (C7) (Me $E_1$); 1,3-butanediol, 2-ethyl-2-methyl- (C7) $PO_1$; 1,3-butanediol, 2-ethyl-2-methyl- (C7) n-$BO_{2-4}$; 1,3-butanediol, 2-ethyl-3-methyl- (C7) (Me $E_1$); 1,3-butanediol, 2-ethyl-3-methyl- (C7) $PO_1$; 1,3-butanediol, 2-ethyl-3-methyl- (C7) n-$BO_{2-4}$; 1,3-butanediol, 2-isopropyl- (C7) (Me $E_1$); 1,3-butanediol, 2-isopropyl- (C7) $PO_1$; 1,3-butanediol, 2-isopropyl- (C7) n-$BO_{2-4}$; 1,3-butanediol, 2-methyl- (C5) 2(Me $E_{1-3}$); 1,3-butanediol, 2-methyl- (C5) $PO_4$; 1,3-butanediol, 2-propyl- (C7) $E_{2-9}$; 1,3-butanediol, 2-propyl- (C7) $PO_1$; 1,3-butanediol, 2-propyl- (C7) n-$BO_{1-3}$; 1,3-butanediol, 3-methyl- (C5) 2(Me $E_{1-3}$); 1,3-butanediol, 3-methyl- (C5) $PO_4$; 1,4-butanediol (C4) 2(Me $E_{2-4}$); 1,4-butanediol (C4), $PO_{4-5}$; 1,4-butanediol (C4) $BO_2$; 1,4-butanediol, 2,2,3-trimethyl- (C7) $E_{2-9}$; 1,4-butanediol, 2,2,3-trimethyl- (C7) $PO_1$; 1,4-butanediol, 2,2,3-trimethyl- (C7) n-$BO_{1-3}$; 1,4-butanediol, 2,2-dimethyl- (C6) (Me $E_1$-$_6$); 1,4-butanediol, 2,2-dimethyl- (C6) $PO_2$; 1,4-butanediol, 2,2-dimethyl- (C6) $BO_1$; 1,4-butanediol, 2,3-dimethyl- (C6) (Me $E_{1-6}$); 1,4-butanediol, 2,3-dimethyl- (C6) $PO_2$; 1,4-butanediol, 2,3-dimethyl- (C6) $BO_1$; 1,4-butanediol, 2-ethyl- (C6) (Me $E_{1-4}$); 1,4-butanediol, 2-ethyl- (C6) $PO_2$; 1,4-butanediol, 2-ethyl- (C6) $BO_1$; 1,4-butanediol, 2-ethyl-2-methyl- (C7) $E_{1-7}$; 1,4-butanediol, 2-ethyl-2-methyl- (C7) $PO_1$; 1,4-butanediol, 2-ethyl-2-methyl- (C7) n-$BO_{1-2}$; 1,4-butanediol, 2-ethyl-3-methyl- (C7) $E_{1-7}$; 1,4-butanediol, 2-ethyl-3-methyl- (C7) $PO_1$; 1,4-butanediol, 2-ethyl-3-methyl- (C7) n-$BO_{1-2}$; 1,4-butanediol, 2-isopropyl- (C7) $E_{1-7}$; 1,4-butanediol, 2-isopropyl- (C7) $PO_1$; 1,4-butanediol, 2-isopropyl- (C7) n-$BO_{1-2}$; 1,4-butanediol, 2-methyl- (C5) (Me $E_{6-10}$); 1,4-butanediol, 2-methyl- (C5) 2(Me $E_1$); 1,4-butanediol, 2-methyl- (C5) $PO_3$; 1,4-butanediol, 2-methyl- (C5) $BO_1$; 1,4-butanediol, 2-propyl- (C7) $E_{1-5}$; 1,4-butanediol, 2-propyl- (C7) n-$BO_{1-2}$; 1,4-butanediol, 3-ethyl-1-methyl- (C7) $E_{2-9}$; 1,4-butanediol, 3-ethyl-1-methyl- (C7) $PO_1$; 1,4-butanediol, 3-ethyl-1-methyl- (C7) n-$BO_{1-3}$; 2,3-butanediol (C4) (Me E6-$_{10}$); 2,3-butanediol (C4) 2(Me $E_1$); 2,3-butanediol (C4) $PO_{3-4}$; 2,3-butanediol (C4) $BO_1$; 2,3-butanediol, 2,3-dimethyl- (C6) $E_{3-9}$; 2,3-butanediol, 2,3-dimethyl- (C6) $PO_1$; 2,3-butanediol, 2,3-dimethyl- (C6) n-$BO_{1-3}$; 2,3-butanediol, 2-methyl- (C5) (Me $E_{1-5}$); 2,3-butanediol, 2-methyl- (C5) $PO_2$; 2,3-butanediol, 2-methyl- (C5) $BO_1$;

3. 1,2-pentanediol (C5) $E_{3-10}$; 1,2-pentanediol, (C5) $PO_1$; 1,2-pentanediol, (C5) n-$BO_{2-3}$; 1,2-pentanediol, 2-methyl (C6) $E_{1-3}$; 1,2-pentanediol, 2-methyl (C6) n-$BO_1$; 1,2-pentanediol, 2-methyl (C6) $BO_1$; 1,2-pentanediol, 3-methyl (C6) $E_{1-3}$; 1,2-pentanediol, 3-methyl (C6) n-$BO_1$; 1,2-pentanediol, 4-methyl (C6) $E_{1-3}$; 1,2-pentanediol, 4-methyl (C6) n-$BO_1$; 1,3-pentanediol (C5) 2(Me-$E_{1-2}$); 1,3-pentanediol (C5) $PO_{3-4}$; 1,3-pentanediol, 2,2-dimethyl- (C7) (Me-$E_1$); 1,3-pentanediol, 2,2-dimethyl- (C7) $PO_1$; 1,3-pentanediol, 2,2-dimethyl- (C7) n-$BO_{2-4}$; 1,3-pentanediol, 2,3-dimethyl- (C7) (Me-$E_1$); 1,3-pentanediol, 2,3-dimethyl- (C7) $PO_1$; 1,3-pentanediol, 2,3-dimethyl- (C7) n-$BO_{2-4}$; 1,3-pentanediol, 2,4-dimethyl- (C7) (Me-$E_1$); 1,3-pentanediol, 2,4-dimethyl- (C7) $PO_1$; 1,3-pentanediol, 2,4-dimethyl- (C7) n-$BO_{2-4}$; 1,3-pentanediol, 2-ethyl- (C7) $E_{2-9}$; 1,3-pentanediol, 2-ethyl- (C7) $PO_1$; 1,3-pentanediol, 2-ethyl- (C7) n-$BO_{1-3}$; 1,3-pentanediol, 2-methyl- (C6) 2(Me-$E_{1-6}$); 1,3-pentanediol, 2-methyl- (C6) $PO_{2-3}$; 1,3-pentanediol, 2-methyl- (C6) $BO_1$; 1,3-pentanediol, 3,4-dimethyl- (C7) (Me-$E_1$); 1,3-pentanediol, 3,4-dimethyl- (C7) $PO_1$; 1,3-pentanediol, 3,4-dimethyl- (C7) n-$BO_{2-4}$; 1,3-pentanediol, 3-methyl- (C6) (Me-$E_{1-6}$); 1,3-pentanediol, 3-methyl- (C6) $PO_{2-3}$; 1,3-pentanediol, 3-methyl- (C6) $BO_1$; 1,3-pentanediol, 4,4-dimethyl- (C7) (Me-$E_1$); 1,3-pentanediol, 4,4-dimethyl- (C7) $PO_1$; 1,3-pentanediol, 4,4-dimethyl- (C7) n-$BO_{2-4}$; 1,3-pentanediol, 4-methyl- (C6) (Me-$E_{1-6}$); 1,3-pentanediol, 4-methyl- (C6) $PO_{2-3}$; 1,3-pentanediol, 4-methyl- (C6) $BO_1$; 1,4-pentanediol, (C5) 2(Me-$E_{1-2}$); 1,4-pentanediol (C5) $PO_{3-4}$; 1,4-pentanediol, 2,2-dimethyl- (C7) (Me-$E_1$); 1,4-pentanediol, 2,2-dimethyl- (C7) $PO_1$; 1,4-pentanediol, 2,2-dimethyl- (C7) n-$BO_{2-4}$; 1,4-pentanediol, 2,3-dimethyl- (C7) (Me-$E_1$); 1,4-pentanediol, 2,3-dimethyl- (C7) $PO_1$; 1,4-pentanediol, 2,3-dimethyl- (C7) n-$BO_{2-4}$; 1,4-pentanediol, 2,4-dimethyl- (C7) (Me-$E_1$); 1,4-pentanediol, 2,4-dimethyl- (C7) $PO_1$; 1,4-pentanediol, 2,4-dimethyl- (C7) n-$BO_{2-4}$; 1,4-pentanediol, 2-methyl- (C6) (Me-$E_{1-6}$); 1,4-pentanediol, 2-methyl- (C6) $PO_{2-3}$; 1,4-pentanediol, 2-methyl- (C6) $BO_1$; 1,4-pentanediol, 3,3-dimethyl- (C7) (Me-$E_1$); 1,4-pentanediol, 3,3-dimethyl- (C7) $PO_1$; 1,4-pentanediol, 3,3-dimethyl- (C7) n-$BO_{2-4}$; 1,4-pentanediol, 3,4-dimethyl- (C7) (Me-$E_1$); 1,4-pentanediol, 3,4-dimethyl- (C7) $PO_1$; 1,4-pentanediol, 3,4-dimethyl- (C7) n-$BO_{2-4}$; 1,4-pentanediol, 3-methyl- (C6) 2(Me-$E_{1-6}$); 1,4-pentanediol, 3-methyl- (C6) $PO_{2-3}$; 1,4-pentanediol, 3-methyl- (C6) $BO_1$; 1,4-pentanediol, 4-methyl- (C6) 2(Me-$E_{1-6}$); 1,4-pentanediol, 4-methyl- (C6) $PO_{2-3}$; 1,4-pentanediol, 4-methyl- (C6) $BO_1$; 1,5-pentanediol, (C5) (Me-$E_{4-10}$); 1,5-pentanediol (C5) 2(Me-$E_1$); 1,5-pentanediol (C5) $PO_3$; 1,5-pentanediol, 2,2-dimethyl- (C7) $E_{1-7}$; 1,5-pentanediol, 2,2-dimethyl- (C7) $PO_1$; 1,5-pentanediol, 2,2-dimethyl- (C7) n-$BO_{1-2}$; 1,5-pentanediol, 2,3-dimethyl- (C7) $E_{1-7}$; 1,5-pentanediol, 2,3-dimethyl- (C7) $PO_1$; 1,5-pentanediol, 2,3-dimethyl- (C7) n-$BO_{1-2}$; 1,5-pentanediol, 2,4-dimethyl- (C7) $E_{1-7}$; 1,5-pentanediol, 2,4-dimethyl- (C7) $PO_1$; 1,5-pentanediol, 2,4-dimethyl- (C7) n-$BO_{1-2}$; 1,5-pentanediol, 2-ethyl- (C7) $E_{1-5}$; 1,5-pentanediol, 2-ethyl- (C7) n-$BO_{1-2}$; 1,5-pentanediol, 2-methyl- (C6) (Me-$E_{1-4}$); 1,5-pentanediol, 2-methyl- (C6) $PO_2$; 1,5-pentanediol, 3,3-dimethyl- (C7) $E_{1-7}$; 1,5-pentanediol, 3,3-dimethyl- (C7) $PO_1$; 1,5-pentanediol, 3,3-dimethyl- (C7) n-$BO_{1-2}$; 1,5-pentanediol, 3-methyl- (C6) (Me-$E_{1-4}$); 1,5-pentanediol, 3-methyl- (C6) $PO_2$; 2,3-pentanediol, (C5) (Me-$E_{1-3}$); 2,3-pentanediol, (C5) $PO_2$; 2,3-pentanediol, 2-methyl- (C6) $E_{1-7}$; 2,3-pentanediol, 2-methyl- (C6) $PO_1$; 2,3-pentanediol, 2-methyl- (C6) n-$BO_{1-2}$; 2,3-pentanediol, 3-methyl- (C6) $E_{1-7}$; 2,3-pentanediol, 3-methyl- (C6) $PO_1$; 2,3-pentanediol, 3-methyl- (C6) n-$BO_{1-2}$; 2,3-pentanediol, 4-methyl- (C6) $E_{1-7}$; 2,3-pentanediol, 4-methyl- (C6) $PO_1$; 2,3-pentanediol, 4-methyl- (C6) n-$BO_{1-2}$; 2,4-pentanediol, (C5) 2(Me-$E_{1-4}$); 2,4-pentanediol (C5) $PO_4$; 2,4-pentanediol, 2,3-dimethyl- (C7) (Me-$E_{1-4}$); 2,4-pentanediol, 2,3-dimethyl- (C7) $PO_2$; 2,4-pentanediol, 2,4-dimethyl- (C7) (Me-$E_{1-4}$); 2,4-pentanediol, 2,4-dimethyl- (C7) $PO_2$; 2,4-pentanediol, 2-methyl- (C7) (Me-$E_{5-10}$); 2,4-pentanediol, 2-methyl- (C7) $PO_3$; 2,4-pentanediol, 3,3-dimethyl- (C7) (Me-$E_{1-4}$); 2,4-pentanediol, 3,3-dimethyl- (C7) $PO_2$; 2,4-pentanediol, 3-methyl- (C6) (Me-$E_{5-10}$); 2,4-pentanediol, 3-methyl- (C6) $PO_3$;

4. 1,3-hexanediol (C6) (Me-$E_{1-5}$); 1,3-hexanediol (C6) $PO_2$; 1,3-hexanediol (C6) $BO_1$; 1,3-hexanediol, 2-methyl- (C7) $E_{2-9}$; 1,3-hexanediol, 2-methyl- (C7) $PO_1$; 1,3-hexanediol, 2-methyl- (C7) n-$BO_{1-3}$; 1,3-hexanediol, 2-methyl- (C7) $BO_1$; 1,3-hexanediol, 3-methyl- (C7) $E_{2-9}$; 1,3-hexanediol, 3-methyl- (C7) $PO_1$; 1,3-hexanediol, 3-methyl- (C7) n-$BO_{1-3}$; 1,3-hexanediol, 4-methyl- (C7) $E_{2-9}$; 1,3-hexanediol, 4-methyl- (C7) $PO_1$; 1,3-hexanediol, 4-methyl- (C7) n-$BO_{1-3}$; 1,3-hexanediol, 5-methyl- (C7) $E_{2-9}$; 1,3-hexanediol, 5-methyl- (C7) $PO_1$; 1,3-hexanediol, 5-methyl- (C7) n-$BO_{1-3}$; 1,4-hexanediol (C6) (Me-$E_{1-5}$); 1,4-hexanediol (C6) $PO_2$; 1,4-hexanediol (C6) $BO_1$; 1,4-hexanediol, 2-methyl- (C7) $E_{2-9}$; 1,4-hexanediol, 2-methyl- (C7) $PO_1$; 1,4-hexanediol, 2-methyl- (C7) n-$BO_{1-3}$; 1,4-hexanediol, 3-methyl- (C7) $E_{2-9}$; 1,4-hexanediol, 3-methyl- (C7) $PO_1$; 1,4-hexanediol, 3-methyl- (C7) n-$BO_{1-3}$; 1,4-hexanediol, 4-methyl- (C7) $E_{2-9}$; 1,4-hexanediol, 4-methyl- (C7) $PO_1$; 1,4-hexanediol, 4-methyl- (C7) n-$BO_{1-3}$; 1,4-hexanediol, 5-methyl- (C7) $E_{2-9}$; 1,4-hexanediol, 5-methyl- (C7) $PO_1$; 1,4-hexanediol, 5-methyl- (C7) n-$BO_{1-3}$; 1,5-hexanediol (C6) (Me-$E_{1-5}$); 1,5-hexanediol (C6) $PO_2$; 1,5-hexanediol (C6) $BO_1$; 1,5-hexanediol, 2-methyl- (C7) $E_{2-9}$; 1,5-hexanediol, 2-methyl- (C7) $PO_1$; 1,5-hexanediol, 2-methyl- (C7) n-$BO_{1-3}$; 1,5-hexanediol, 3-methyl- (C7) $E_{2-9}$; 1,5-hexanediol, 3-methyl- (C7) $PO_1$; 1,5-hexanediol, 3-methyl- (C7) n-$BO_{1-3}$; 1,5-hexanediol, 4-methyl- (C7) $E_{2-9}$; 1,5-hexanediol, 4-methyl- (C7) $PO_1$; 1,5-hexanediol, 4-methyl- (C7) n-$BO_{1-3}$; 1,5-hexanediol, 5-methyl- (C7) $E_{2-9}$; 1,5-hexanediol, 5-methyl- (C7) $PO_1$; 1,5-hexanediol, 5-methyl- (C7) n-$BO_{1-3}$; 1,6-hexanediol (C6) (Me-$E_{1-2}$); 1,6-hexanediol (C6) $PO_{1-2}$; 1,6-hexanediol (C6) n-$BO_4$; 1,6-hexanediol, 2-methyl- (C7) $E_{1-5}$; 1,6-hexanediol, 2-methyl- (C7) n-$BO_{1-2}$; 1,6-hexanediol, 3-methyl- (C7) $E_{1-5}$; 1,6-hexanediol, 3-methyl- (C7) n-$BO_{1-2}$; 2,3-hexanediol (C6) $E_{1-5}$; 2,3-hexanediol (C6) n-$BO_1$; 2,3-hexanediol (C6) $BO_1$; 2,4-hexanediol (C6) (Me-$E_{3-8}$); 2,4-hexanediol (C6) $PO_3$; 2,4-hexanediol, 2-methyl- (C7) (Me-$E_{1-2}$); 2,4-hexanediol 2-methyl- (C7) $PO_{1-2}$; 2,4-hexanediol, 3-methyl- (C7) (Me-$E_{1-2}$); 2,4-hexanediol 3-methyl- (C7) $PO_{1-2}$; 2,4-hexanediol, 4-methyl- (C7) (Me-$E_{1-2}$); 2,4-hexanediol 4-methyl- (C7) $PO_{1-2}$; 2,4-hexanediol, 5-methyl- (C7) (Me-$E_{1-2}$); 2,4-hexanediol 5-methyl- (C7) $PO_{1-2}$; 2,5-hexanediol (C6) (Me-$E_{3-8}$); 2,5-hexanediol (C6) $PO_3$; 2,5-hexanediol, 2-methyl- (C7) (Me-$E_{1-2}$); 2,5-hexanediol 2-methyl- (C7) $PO_{1-2}$; 2,5-hexanediol, 3-methyl- (C7) (Me-$E_{1-2}$); 2,5-hexanediol 3-methyl- (C7) $PO_{1-2}$; 3,4-hexanediol (C6) $EO_{1-5}$; 3,4-hexanediol (C6) n-$BO_1$; 3,4-hexanediol (C6) $BO_1$;

5. 1,3-heptanediol (C7) $E_{1-7}$; 1,3-heptanediol (C7) $PO_1$; 1,3-heptanediol (C7) n-$BO_{1-2}$; 1,4-heptanediol (C7) $E_{1-7}$; 1,4-heptanediol (C7) $PO_1$; 1,4-heptanediol (C7) n-$BO_{1-2}$; 1,5-heptanediol (C7) $E_{1-7}$; 1,5-heptanediol (C7) $PO_1$; 1,5-heptanediol (C7) n-$BO_{1-2}$; 1,6-heptanediol (C7) $E_{1-7}$; 1,6-heptanediol (C7) $PO_1$; 1,6-heptanediol (C7) n-$BO_{1-2}$; 1,7-heptanediol (C7) $E_{1-2}$; 1,7-heptanediol (C7) n-$BO_1$; 2,4-heptanediol (C7) $E_{3-10}$; 2,4-heptanediol (C7) (Me-$E_1$); 2,4-heptanediol (C7) $PO_1$; 2,4-heptanediol (C7) n-$BO_3$; 2,5-heptanediol (C7) $E_{3-10}$; 2,5-heptanediol (C7) (Me-$E_1$); 2,5-heptanediol (C7) $PO_1$; 2,5-heptanediol (C7) n-$BO_3$; 2,6-heptanediol (C7) $E_{3-10}$; 2,6-heptanediol (C7) (Me-$E_1$); 2,6-heptanediol (C7) $PO_1$; 2,6-heptanediol (C7) n-$BO_3$; 3,5-heptanediol (C7) $E_{3-10}$; 3,5-heptanediol (C7) (Me-$E_1$); 3,5-heptanediol (C7) $PO_1$; 3,5-heptanediol (C7) n-$BO_3$;

6. 1,3-butanediol, 3-methyl-2-isopropyl- (C8) $PO_1$; 2,4-pentanediol, 2,3,3-trimethyl- (C8) $PO_1$; 1,3-butanediol, 2,2-diethyl- (C8) $E_{2-5}$; 2,4-hexanediol, 2,3-dimethyl- (C8) $E_{2-5}$; 2,4-hexanediol, 2,4-dimethyl- (C8) $E_{2-5}$; 2,4-hexanediol, 2,5-dimethyl- (C8) $E_{2-5}$; 2,4-hexanediol, 3,3-dimethyl- (C8) $E_{2-5}$; 2,4-hexanediol, 3,4-dimethyl- (C8) $E_{2-5}$; 2,4-hexanediol, 3,5-dimethyl- (C8) $E_{2-5}$; 2,4-hexanediol, 4,5-dimethyl- (C8) $E_{2-5}$; 2,4-hexanediol, 5,5-dimethyl- (C8) $E_{2-5}$; 2,5-hexanediol, 2,3-dimethyl- (C8) $E_{2-5}$; 2,5-hexanediol, 2,4-dimethyl- (C8) $E_{2-5}$; 2,5-hexanediol, 2,5-dimethyl- (C8) $E_{2-5}$; 2,5-hexanediol, 3,3-dimethyl- (C8) $E_{2-5}$; 2,5-hexanediol, 3,4-dimethyl- (C8) $E_{2-5}$; 3,5-heptanediol, 3-methyl- (C8) $E_{2-5}$; 1,3-butanediol, 2,2-diethyl- (C8) n-$BO_{1-2}$; 2,4-hexanediol, 2,3-dimethyl- (C8) n-$BO_{1-2}$; 2,4-hexanediol, 2,4-dimethyl- (C8) n-$BO_{1-2}$; 2,4-hexanediol, 2,5-dimethyl- (C8) n-$BO_{1-2}$; 2,4-hexanediol, 3,3-dimethyl- (C8) n-$BO_{1-2}$; 2,4-hexanediol, 3,4-dimethyl- (C8) n-$BO_{1-2}$; 2,4-hexanediol, 3,5-dimethyl- (C8) n-$BO_{1-2}$; 2,4-hexanediol, 4,5-dimethyl- (C8) n-$BO_{1-2}$; 2,4-hexanediol, 5,5-dimethyl-, n-$BO_{1-2}$; 2,5-hexanediol, 2,3-dimethyl- (C8) n-$BO_{1-2}$; 2,5-hexanediol, 2,4-dimethyl- (C8) n-$BO_{1-2}$; 2,5-hexanediol, 2,5-dimethyl- (C8) n-$BO_{1-2}$; 2,5-hexanediol, 3,3-dimethyl- (C8) n-$BO_{1-2}$; 2,5-hexanediol, 3,4-dimethyl- (C8) n-$BO_{1-2}$; 3,5-heptanediol, 3-methyl- (C8) n-$BO_{1-2}$; 1,3-propanediol, 2-(1,2-dimethylpropyl)- (C8) n-$BO_1$; 1,3-butanediol, 2-ethyl-2,3-dimethyl- (C8) n-$BO_1$; 1,3-butanediol, 2-methyl-2-isopropyl- (C8) n-$BO_1$; 1,4-butanediol, 3-methyl-2-isopropyl- (C8) n-$BO_1$; 1,3-pentanediol, 2,2,3-trimethyl- (C8) n-$BO_1$; 1,3-pentanediol, 2,2,4-trimethyl- (C8) n-$BO_1$; 1,3-pentanediol, 2,4,4-trimethyl- (C8) n-$BO_1$; 1,3-pentanediol, 3,4,4-trimethyl- (C8) n-$BO_1$; 1,4-pentanediol, 2,2,3-trimethyl- (C8) n-$BO_1$; 1,4-pentanediol, 2,2,4-trimethyl- (C8) n-$BO_1$; 1,4-pentanediol, 2,3,3-trimethyl- (C8) n-$BO_1$; 1,4-pentanediol, 2,3,4-trimethyl- (C8) n-$BO_1$; 1,4-pentanediol, 3,3,4-trimethyl- (C8) n-$BO_1$; 2,4-pentanediol, 2,3,4-trimethyl- (C8) n-$BO_1$; 2,4-hexanediol, 4-ethyl- (C8) n-$BO_1$; 2,4-heptanediol, 2-methyl- (C8) n-$BO_1$; 2,4-heptanediol, 3-methyl- (C8) n-$BO_1$; 2,4-heptanediol, 4-methyl- (C8) n-$BO_1$; 2,4-heptanediol, 5-methyl- (C8) n-$BO_1$; 2,4-heptanediol, 6-methyl- (C8) n-$BO_1$; 2,5-heptanediol, 2-methyl- (C8) n-$BO_1$; 2,5-heptanediol, 3-methyl- (C8) n-$BO_1$; 2,5-heptanediol, 4-methyl- (C8) n-$BO_1$; 2,5-heptanediol, 5-methyl- (C8) n-$BO_1$; 2,5-heptanediol, 6-methyl- (C8) n-$BO_1$; 2,6-heptanediol, 2-methyl- (C8) n-$BO_1$; 2,6-heptanediol, 3-methyl- (C8) n-$BO_1$; 2,6-heptanediol, 4-methyl- (C8) n-$BO_1$; 3,5-heptanediol, 2-methyl- (C8) n-$BO_1$; 1,3-propanediol, 2-(1,2-dimethylpropyl)- (C8) $E_{1-3}$; 1,3-butanediol, 2-ethyl-2,3-dimethyl- (C8) $E_{1-3}$; 1,3-butanediol, 2-methyl-2-isopropyl- (C8) $E_{1-3}$; 1,4-butanediol, 3-methyl-2-isopropyl- (C8) $E_{1-3}$; 1,3-pentanediol, 2,2,3-trimethyl- (C8) $E_{1-3}$; 1,3-pentanediol, 2,2,4-trimethyl- (C8) $E_{1-3}$; 1,3-pentanediol, 2,4,4-trimethyl- (C8) $E_{1-3}$; 1,3-pentanediol, 3,4,4-trimethyl- (C8) $E_{1-3}$; 1,4-pentanediol, 2,2,3-trimethyl- (C8) $E_{1-3}$; 1,4-pentanediol, 2,2,4-trimethyl- (C8) $E_{1-3}$; 1,4-pentanediol, 2,3,3-trimethyl- (C8) $E_{1-3}$; 1,4-pentanediol, 2,3,4-trimethyl- (C8) $E_{1-3}$; 1,4-pentanediol, 3,3,4-trimethyl- (C8) $E_3$; 2,4-pentanediol, 2,3,4-trimethyl- (C8) $E_{1-3}$; 2,4-hexanediol, 4-ethyl- (C8) $E_{1-3}$; 2,4-heptanediol, 2-methyl- (C8) $E_{1-3}$; 2,4-heptanediol, 3-methyl- (C8) $E_{1-3}$; 2,4-heptanediol, 4-methyl- (C8) $E_{1-3}$; 2,4-heptanediol, 5-methyl- (C8) $E_{1-3}$; 2,4-heptanediol, 6-methyl- (C8) $E_{1-3}$; 2,5-heptanediol, 2-methyl- (C8) $E_{1-3}$; 2,5-heptanediol, 3-methyl- (C8) $E_{1-3}$; 2,5-heptanediol, 4-methyl- (C8) $E_{1-3}$; 2,5-heptanediol, 5-methyl- (C8) $E_{1-3}$; 2,5-heptanediol, 6-methyl- (C8) $E_{1-3}$; 2,6-heptanediol, 2-methyl- (C8) $E_{1-3}$; 2,6-heptanediol, 3-methyl- (C8) $E_{1-3}$; 2,6-heptanediol, 4-methyl- (C8) $E_{1-3}$; and/or 3,5-heptanediol, 2-methyl- (C8) $E_{1-3}$; and 7. mixtures thereof;

IX. aromatic diols including: 1-phenyl-1,2-ethanediol; 1-phenyl-1,2-propanediol; 2-phenyl-1,2-propanediol; 3-phenyl-1,2-propanediol; 1-(3-methylphenyl)-1,3-propanediol; 1-(4-methylphenyl)-1,3-propanediol; 2-methyl-1-phenyl-1,3-propanediol; 1-phenyl-1,3-butanediol; 3-phenyl-1,3-butanediol; 1-phenyl-1,4-butanediol; 2-phenyl-1,4-butanediol; and/or 1-phenyl-2,3-butanediol;

X. principal solvents which are homologs, or analogs, of the above structures where one, or more, $CH_2$ groups are added while, for each $CH_2$ group added, two hydrogen atoms are removed from adjacent carbon atoms in the molecule to form one carbon-carbon double bond, thus holding the number of hydrogen atoms in the molecule constant, including the following:

1,3-Propanediol, 2,2-di-2-propenyl-; 1,3-Propanediol, 2-(1-pentenyl)-; 1,3-Propanediol, 2-(2-methyl-2-propenyl)-2-(2-propenyl)-; 1,3-Propanediol, 2-(3-methyl-1-butenyl)-; 1,3-Propanediol, 2-(4-pentenyl)-; 1,3-Propanediol, 2-ethyl-2-(2-methyl-2-propenyl)-; 1,3-Propanediol, 2-ethyl-2-(2-propenyl)-; 1,3-Propanediol, 2-methyl-2-(3-methyl-3-butenyl)-; 1,3-Butanediol, 2,2-diallyl-; 1,3-Butanediol, 2-(1-ethyl-1-propenyl)-; 1,3-Butanediol, 2-(2-butenyl)-2-methyl-; 1,3-Butanediol, 2-(3-methyl-2-butenyl)-; 1,3-Butanediol, 2-ethyl-2-(2-propenyl)-; 1,3-Butanediol, 2-methyl-2-(1-methyl-2-propenyl)-; 1,4-Butanediol, 2,3-bis(1-methylethylidene)-; 1,4-Butanediol, 2-(3-methyl-2-butenyl)-3-methylene-; 2-Butene-1,4-diol, 2-(1,1-dimethylpropyl)-; 2-Butene-1,4-diol, 2-(1-methylpropyl)-; 2-Butene-1,4-diol, 2-butyl-; 1,3-Pentanediol, 2-ethenyl-3-ethyl-; 1,3-Pentanediol, 2-ethenyl-4,4-dimethyl-; 1,4-Pentanediol, 3-methyl-2-(2-propenyl)-; 1,5-Pentanediol, 2-(1-propenyl)-; 1,5-Pentanediol, 2-(2-propenyl)-; 1,5-Pentanediol, 2-ethylidene-3-methyl-; 1,5-Pentanediol, 2-propylidene-; 2,4-Pentanediol, 3-ethylidene-2,4-dimethyl-; 4-Pentene-1,3-diol, 2-(1,1-dimethylethyl)-; 4-Pentene-1,3-diol, 2-ethyl-2,3-dimethyl-; 1,4-Hexanediol, 4-ethyl-2-methylene-; 1,5-Hexadiene-3,4-diol, 2,3,5-trimethyl-; 1,5-Hexadiene-3,4-diol, 5-ethyl-3-methyl-; 1,5-Hexanediol, 2-(1-methylethenyl)-; 1,6-Hexanediol, 2-ethenyl-; 1-Hexene-3,4-diol, 5,5-dimethyl-; 1-Hexene-3,4-diol, 5,5-dimethyl-; 2-Hexene-1,5-diol, 4-ethenyl-2,5-dimethyl-; 3-Hexene-1,6-diol, 2-ethenyl-2,5-dimethyl-; 3-Hexene-1,6-diol, 2-ethyl-; 3-Hexene-1,6-diol, 3,4-dimethyl-; 4-Hexene-2,3-diol, 2,5-dimethyl-; 4-Hexene-2,3-diol, 3,4-dimethyl-; 5-Hexene-1,3-diol, 3-(2-propenyl)-; 5-Hexene-2,3-diol, 2,3-dimethyl-; 5-Hexene-2,3-diol, 3,4-dimethyl-; 5-Hexene-2,3-diol, 3,5-dimethyl-; 5-Hexene-2,4-diol, 3-ethenyl-2,5-dimethyl-; 1,4-Heptanediol, 6-methyl-5-methylene-; 1,5-Heptadiene-3,4-diol, 2,3-dimethyl-; 1,5-Heptadiene-3,4-diol, 2,5-dimethyl-; 1,5-Heptadiene-3,4-diol, 3,5-dimethyl-; 1,7-Heptanediol, 2,6-bis(methylene)-; 1,7-Heptanediol, 4-methylene-; 1-Heptene-3,5-diol, 2,4-dimethyl-; 1-Heptene-3,5-diol, 2,6-dimethyl-; 1-Heptene-3,5-diol, 3-ethenyl-5-methyl; 1-Heptene-3,5-diol, 6,6-dimethyl-2,4-Heptadiene-2,6-diol, 4,6-dimethyl-; 2,5-Heptadiene-1,7-diol, 4,4-dimethyl-; 2,6-Heptadiene-1,4-diol, 2,5,5-trimethyl-; 2-Heptene-1,4-diol, 5,6-dimethyl-; 2-Heptene-1,5-diol, 5-ethyl-; 2-Heptene-1,7-diol, 2-methyl-; 3-Heptene-1,5-diol, 4,6-dimethyl-; 3-Heptene-1,7-diol, 3-methyl-6-methylene-; 3-Heptene-2,5-diol, 2,4-dimethyl-; 3-Heptene-2,5-diol, 2,5-dimethyl-; 3-Heptene-2,6-diol, 2,6-dimethyl-; 3-Heptene-2,6-diol, 4,6-dimethyl-; 5-Heptene-1,3-diol, 2,4-dimethyl-; 5-Heptene-1,3-diol, 3,6-dimethyl-; 5-Heptene-1,4-diol, 2,6-dimethyl-; 5-Heptene-1,4-diol, 3,6-dimethyl-; 5-Heptene-2,4-diol, 2,3-dimethyl-; 6-Heptene-1,3-diol, 2,2-dimethyl-; 6-Heptene-1,4-diol, 4-(2-propenyl)-; 6-Heptene-1,4-diol, 5,6-dimethyl-; 6-Heptene-1,5-diol, 2,4-dimethyl-; 6-Heptene-1,5-diol, 2-ethylidene-6-methyl-; 6-Heptene-2,4-diol, 4-(2-propenyl)-; 6-Heptene-2,4-diol, 5,5-dimethyl-; 6-Heptene-2,5-diol, 4,6-dimethyl-; 6-Heptene-2,5-diol, 5-ethenyl-4-methyl-; 1,3-Octanediol, 2-methylene-; 1,6-Octadiene-3,5-diol, 2,6-dimethyl-; 1,6-Octadiene-3,5-diol, 3,7-dimethyl-; 1,7-Octadiene-3,6-diol, 2,6-dimethyl-; 1,7-Octadiene-3,6-diol, 2,7-dimethyl-; 1,7-Octadiene-3,6-diol, 3,6-dimethyl-; 1-Octene-3,6-diol, 3-ethenyl-; 2,4,6-Octatriene-1,8-diol, 2,7-dimethyl-; 2,4—Octadiene-1,7-diol, 3,7-dimethyl-; 2,5-Octadiene-1,7-diol, 2,6-dimethyl-; 2,5-Octadiene-1,7-diol, 3,7-dimethyl-; 2,6-Octadiene-1,4-diol, 3,7-dimethyl-(Rosiridol); 2,6-Octadiene-1,8-diol, 2-methyl-; 2,7—Octadiene-1,4-diol, 3,7-dimethyl-; 2,7-Octadiene-1,5-diol, 2,6-dimethyl-; 2,7-Octadiene-1,6-diol, 2,6-dimethyl-(8-Hydroxylinalool); 2,7-Octadiene-1,6-diol, 2,7-dimethyl-; 2-Octene-1,4-diol; 2-Octene-1,7-diol; 2-Octene-1,7-diol, 2-methyl-6-methylene-; 3,5-Octadiene-1,7-diol, 3,7-dimethyl-; 3,5-Octadiene-2,7-diol, 2,7-dimethyl-; 3,5-Octanediol, 4-methylene-; 3,7-Octadiene-1,6-diol, 2,6-dimethyl-; 3,7-Octadiene-2,5-diol, 2,7-dimethyl-; 3,7-Octadiene-2,6-diol, 2,6-dimethyl-; 3-Octene-1,5-diol, 4-methyl-; 3-Octene-1,5-diol, 5-methyl-; 4,6-Octadiene-1,3-diol, 2,2-dimethyl-; 4,7-Octadiene-2,3-diol, 2,6-dimethyl-; 4,7-Octadiene-2,6-diol, 2,6-dimethyl-; 4-Octene-1,6-diol, 7-methyl-; 2,7-bis(methylene)-; 2-methylene-; 5,7-Octadiene-1,4-diol, 2,7-dimethyl-; 5,7-Octadiene-1,4-diol, 7-methyl-; 5—Octene-1,3-diol; 6-Octene-1,3-diol, 7-methyl-;

6-Octene-1,4-diol, 7-methyl-; 6-Octene-1,5-diol; 6-Octene-1,5-diol, 7-methyl-; 6-Octene-3,5-diol, 2-methyl-; 6-Octene-3,5-diol, 4-methyl-; 7-Octene-1,3-diol, 2-methyl-; 7-Octene-1,3-diol, 4-methyl-; 7-Octene-1,3-diol, 7-methyl-; 7-Octene-1,5-diol; 7-Octene-1,6-diol; 7-Octene-1,6-diol, 5-methyl-; 7-Octene-2,4-diol, 2-methyl-6-methylene-; 7-Octene-2,5-diol, 7-methyl-; 7-Octene-3,5-diol, 2-methyl-; 1-Nonene-3,5-diol; 1-Nonene-3,7-diol; 3-Nonene-2,5-diol; 4,6-Nonadiene-1,3-diol, 8-methyl-; 4-Nonene-2,8-diol; 6,8-Nonadiene-1,5-diol; 7-Nonene-2,4-diol; 8-Nonene-2,4-diol; 8-Nonene-2,5-diol; 1,9-Decadiene-3,8-diol; and/or 1,9-Decadiene-4,6-diol; and XI. mixtures thereof;

E. optionally, but preferably, an effective amount, sufficient to improve clarity, of low molecular weight water soluble solvents like ethanol, isopropanol, propylene glycol, 1,3-propanediol, propylene carbonate, etc., said water soluble solvents being at a level that will not form clear compositions by themselves;

F. optionally, but preferably, from 0% to about 15%, preferably from about 0.1% to about 8%, and more preferably from about 0.2% to about 5%, of perfume;

G. optionally, from 0% to about 2%, preferably from about 0.01% to about 0.2%, and more preferably from about 0.035% to about 0.1%, of stabilizer;

H. optionally, but preferably, an effective amount to improve clarity, of water soluble calcium and/or magnesium salt, preferably chloride; and I. the balance being water.

Preferably, the compositions herein are aqueous, translucent or clear, preferably clear, compositions containing from about 3% to about 95%, preferably from about 5% to about 80%, more preferably from about 15% to about 70%, and even more preferably from about 40% to about 60%, water and from about 3% to about 40%, preferably from about 10% to about 35%, more preferably from about 12% to about 25%, and even more preferably from about 14% to about 20%, of the above principal alcohol solvent C. These preferred products (compositions) are not translucent or clear without principal solvent C. The amount of principal solvent C. required to make the compositions translucent or clear is preferably more than 50%, more preferably more than about 60%, and even more preferably more than about 75%, of the total organic solvent present.

The principal solvents are desirably kept to the lowest levels that provide acceptable stability/clarity in the present compositions. The presence of water exerts an important effect on the need for the principal solvents to achieve clarity of these compositions. The higher the water content, the higher the principal solvent level (relative to the softener level) is needed to attain product clarity. Inversely, the less the water content, the less principal solvent (relative to the softener) is needed. Thus, at low water levels of from about 5% to about 15%, the softener active-to-principal solvent weight ratio is preferably from about 55:45 to about 85:15, more preferably from about 60:40 to about 80:20. At water levels of from about 15% to about 70%, the softener active-to-principal solvent weight ratio is preferably from about 45:55 to about 70:30, more preferably from about 55:45 to about 70:30. But at high water levels of from about 70% to about 80%, the softener active-to-principal solvent weight ratio is preferably from about 30:70 to about 55:45, more preferably from about 35:65 to about 45:55. At higher water levels, the softener to principal solvent ratios should be even higher.

In general compositions containing high IV, unsaturated amine softener active and suitable principal solvent and cosolvent are clear and phase stable at room and low temperature, while compositions containing low IV, more saturated amine softener active and/or without enough principal solvent and cosolvent are opaque.

The pH of the compositions should be from about 1 to about 5, preferably from about 1.5 to about 5, more preferably from about 2 to about 3.5.

DETAILED DESCRIPTION OF THE INVENTION

I. Fabric Softening Active

Compositions of the present invention contain as an essential component from about 2% to about 80%, preferably from about 13% to about 75%, more preferably from about 17% to about 70%, and even more preferably from about 19% to about 65% by weight of the composition, of neutralized amine fabric softener active selected from the compounds identified hereinafter, and mixtures thereof.

Fabric softeners that can be used herein are disclosed, at least generically for the basic corresponding quaternary ammonium structures, in U.S. Pat. No. 3,861,870, Edwards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; and U.S. Pat. No. 4,237,016, Rudkin, Clint, and Young, all of said patents being incorporated herein by reference.

The primary softener actives herein are preferably those that are highly unsaturated amine versions of the traditional softener actives, i.e., di-long chain alkyl nitrogen derivatives, normally cationic materials, such as dioleyldimethylammonium chloride and imidazolinium compounds. More biodegradable fabric softener compounds are the amine versions of such fabric softeners as can be found in U.S. Pat. No. 3,408,361, Mannheimer, issued Oct. 29, 1968; U.S. Pat. No. 4,709,045, Kubo et al., issued Nov. 24, 1987; U.S. Pat. No. 4,233,451, Pracht et al., issued Nov. 11, 1980; U.S. Pat. No. 4,127,489, Pracht et al., issued Nov. 28, 1979; U.S. Pat. No. 3,689,424, Berg et al., issued Sep. 5, 1972; U.S. Pat. No. 4,128,485, Baumann et al., issued Dec. 5, 1978; U.S. Pat. No. 4,161,604, Elster et al., issued Jul. 17, 1979; U.S. Pat. No. 4,189,593, Wechsler et al., issued Feb. 19, 1980; and U.S. Pat. No. 4,339,391, Hoffman et al., issued Jul. 13, 1982, said patents being incorporated herein by reference.

Preferred fabric softener actives of the invention comprise a majority of compounds as follows:

A. from about 2% to about 80%, preferably from about 13% to about 75%, more preferably from about 17% to about 70%, and even more preferably from about 19% to about 65%, by weight of the composition, of neutralized amine fabric softener active which is selected from:

(1) softener having the formula:

$$(R_{3-m}—NH^{(+)}—[(CH_2)_n—Y—R^1]_m\ R^1_p)\ A^-$$

wherein each m and p is 0, 1, or 2, the total of m and p being 2, each $R^1$ is a $C_6$–$C_{22}$, preferably $C_{14}$–$C_{20}$, but no more than one being less than about $C_{12}$ and then the other is at least about 16, hydrocarbyl, or substituted hydrocarbyl substituent, preferably $C_{10}$–$C_{20}$ alkyl or alkenyl (unsaturated alkyl, including polyunsaturated alkyl, also referred to sometimes as "alkylene"), most preferably $C_{12}$–$C_{18}$ alkyl or alkenyl, and where the Iodine Value (hereinafter referred to as "IV") of a fatty acid containing this $R^1$ group is from about 0 to about 140, more preferably from about 80 to about 130; and most preferably from about 90 to about 115 (as used herein, the term "Iodine Value" means the Iodine Value of a "parent" fatty acid, or "corresponding" fatty acid, which is used to define a level of unsaturation for an $R^1$ group that is the same as the level of unsaturation that would be present in a fatty acid containing the same $R^1$ group) with, preferably, a cis/trans ratio of from about 1:1 to about 50:1, the minimum being 1:1, preferably from about 2:1 to about 40:1, more preferably from about 3:1 to about 30:1, and even more preferably from about 4:1 to about 20: 1; each $R^1$ can also preferably be a branched chain $C_{14}$–$C_{22}$ alkyl group, preferably a branched chain $C_{16}$–$C_{18}$ group; each R is a short chain $C_1$–$C_6$, preferably $C_1$–$C_3$ alkyl or hydroxyalkyl group, e.g., methyl (most preferred), ethyl, propyl, hydroxyethyl, and the like, benzyl, or $(R^2\ O)_{2\text{-}4}H$ where each $R^2$ is a $C_{1\text{-}6}$ alkylene group; each n is 1 to 4, preferably 2; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$–$C_{22}$, preferably $C_{14}$–$C_{20}$, with each $R^1$ being a hydrocarbyl, or substituted hydrocarbyl group. (As used herein, the "percent of softener active" containing a given $R^1$ group is based upon taking a percentage of the total active based upon the percentage that the given $R^1$ group is, of the total $R^1$ groups present.); and $A^-$ is a softener compatible anion, preferably, chloride, bromide, sulfate, and nitrate, more preferably chloride;

(2) softener having the formula:

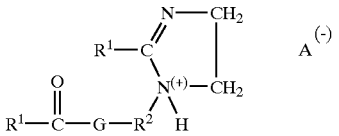

wherein each $R^1$, and $A^-$ have the definitions given above; each $R^2$ is a $C_{1\text{-}6}$ alkylene group, preferably an ethylene group; and G is an oxygen atom or an —NR— group;

(3) reaction products of substantially unsaturated and/or branched chain higher fatty acids with dialkylenetriamines in, e.g., a molecular ratio of about 2:1, said reaction products containing compounds of the formula:

$$R^1\text{—C(O)—NH—}R^2\text{—NH—}R^3\text{—NH—C(O)—}R^1$$

wherein each $R^1$, $R^2$ are defined as above;

(4) softener having the formula:

$$[R^1\text{—C(O)—NR—}R^2\text{—NRH—}R^2\text{—NR—C(O)—}R^1]^+\ A^-$$

wherein each R, $R^1$, $R^2$, and $A^-$ are defined as above;

(5) the reaction product of substantially unsaturated and/or branched chain higher fatty acid with triethanolamine, and subsequently neutralized with an acid having the anion $A^-$;

(6) softener having the formula:

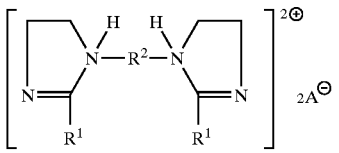

wherein R, $R^1$, $R^2$, and $A^-$ are defined as above; and (7) mixtures thereof, Examples of Compound (1) are di(alkenoyloxyethyl)methylammonium salts such as di(canolaoxyethyl)2-hydroxyethylammonium chloride, di(canolaoxyethyl)methylammonium chloride, di(partially hydrogenated soybean oxyethyl, cis/trans ratio of about 4:1)methylammonium chloride, di(oleoyloxyethyl)methylammonium chloride, and di(oleoyloxyethyl)2-hydroxyethylammonium chloride. Di(oleoyloxyethyl)methylammonium chloride and di(canola oxyethyl)methylammonium chloride are preferred. A preferred example of Compound (1) mixed ester-amide fabric softener actives is $RC(O)NHCH_2CH_2CH_2N^+H(CH_3)CH_2CH_2OC(O)R\ Cl^-$, wherein the RC(O) group is preferably derived from oleic and canola fatty acids. Other examples of Compound (1) include dioleylmethylamine, di(canola alkyl)methyl amine, di(tallow alkyl)methylamine, di(hardened tallow alkyl)methylamine, distearylmethylamine, and mixture thereof.

An example of Compound (2) is 1-oleylamidoethyl-2-oleylimidazolinium chloride wherein $R^1$ is an acyclic aliphatic $C_{15}$–$C_{17}$ hydrocarbon group, $R^2$ is an ethylene group, G is a NH group, $R^5$ is a methyl group and $A^-$ is a chloride anion.

An example of Compound (3) is reaction products of oleic acids with diethylenetriamine in a molecular ratio of about 2:1, said reaction product mixture containing N,N"-dioleoyldiethylenetriamine with the formula:

$$R^1\text{—C(O)—NH—}CH_2CH_2\text{—NH—}CH_2CH_2\text{—NH—C(O)—}R^1$$

wherein $R^1$—C(O) is oleoyl group of a commercially available oleic acid derived from a vegetable or animal source, such as Emersol® 223LL or Emersol® 7021, available from Henkel Corporation, and $R^2$ and $R^3$ are divalent ethylene groups.

An example of Compound (4) is a difatty amidoamine based softener having the formula:

$$[R^1\text{—C(O)—NH—}CH_2CH_2\text{—NH}(CH_2CH_2OH)\text{—}CH_2CH_2\text{—NH—C(O)—}R^1]^+\ Cl^-$$

wherein $R^1$—C(O) is oleoyl group.

An example of Compound (5) is reaction products of oleic acids with N-2-hydroxyethylethylenediamine in a molecular ratio of about 2:1, said reaction product mixture containing a compound of the formula:

$$R^1\text{—C(O)—NH—}CH_2CH_2\text{—N}(CH_2CH_2OH)\text{—C(O)—}R^1$$

wherein $R^1$—C(O) is oleoyl group of a commercially available oleic acid derived from a vegetable or animal source, such as Emersol® 223LL or Emersol® 7021, available from Henkel Corporation.

An example of Compound (6) is the compound having the formula:

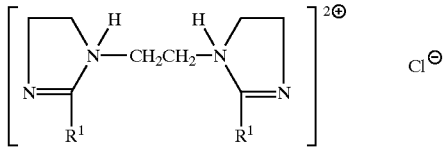

wherein $R^1$ is derived from oleic acid.

The above individual Compounds (actives) can be used individually or as mixtures.

Anion A

In the amine nitrogenous fabric softener salts herein, the anion $A^-$, which is any softener compatible anion, provides electrical neutrality for the protonated amine. Most often, the anion used to provide electrical neutrality in these salts is from a strong acid, especially a halide, such as chloride, bromide, or iodide. However, other anions can be used, such as acetate, formate, sulfate, carbonate, and the like. Chloride and methylsulfate are preferred herein as anion A.

Preferred biodegradable ammonium fabric softening compounds can contain the group —(O)$CR^1$ which is derived from animal fats, unsaturated, and polyunsaturated, fatty acids, e.g., oleic acid, and/or partially hydrogenated fatty acids, derived from vegetable oils and/or partially hydrogenated vegetable oils, such as, canola oil, safflower oil, peanut oil, sunflower oil, corn oil, soybean oil, tall oil, rice bran oil, etc. Non-limiting examples of fatty acids (FA) have the following approximate distributions:

| | Fatty Acyl Group | | | | |
|---|---|---|---|---|---|
| | $FA^1$ | $FA^2$ | $FA^3$ | $FA^4$ | $FA^5$ |
| C12 | trace | trace | 0 | 0 | 0 |
| C14 | 3 | 3 | 0 | 0 | 0 |
| C16 | 4 | 4 | 5 | 5 | 5 |
| C18 | 0 | 0 | 5 | 6 | 6 |
| C14:1 | 3 | 3 | 0 | 0 | 0 |
| C16:1 | 11 | 7 | 0 | 0 | 3 |
| C18:1 | 74 | 73 | 71 | 68 | 67 |
| C18:2 | 4 | 8 | 8 | 11 | 11 |
| C18:3 | 0 | 1 | 1 | 2 | 2 |
| C20:1 | 0 | 0 | 2 | 2 | 2 |
| C20 and up | 0 | 0 | 2 | 0 | 0 |
| Unknowns | 0 | 0 | 6 | 6 | 7 |
| Total | 99 | 99 | 100 | 100 | 102 |
| IV | 86–90 | 88–95 | 99 | 100 | 95 |
| cis/trans (C18:1) | 20–30 | 20–30 | 4 | 5 | 5 |
| TPU | 4 | 9 | 10 | 13 | 13 |

TPU is the percentage of polyunsaturates present.

Mixtures of fatty acids, and mixtures of FAs that are derived from different fatty acids can be used, and are preferred. Nonlimiting examples of FA's that can be blended, to form FA's of this invention are as follows:

| Fatty Acyl Group | $FA^6$ | $FA^7$ |
|---|---|---|
| C14 | 0 | 1 |
| C16 | 11 | 25 |
| C18 | 4 | 20 |
| C14:1 | 0 | 0 |
| C16:1 | 1 | 0 |
| C18:1 | 27 | 45 |
| C18:2 | 50 | 6 |
| C18:3 | 7 | 0 |
| Unknowns | 0 | 3 |
| Total | 100 | 100 |
| IV | 125–138 | 56 |
| cis/trans (C 18:1) | Not Available | 7 |
| TPU | 57 | 6 |

$FA^6$ is prepared from a soy bean fatty acid, and $FA^7$ is prepared from a slightly hydrogenated tallow fatty acid.

Also, optionally, the fatty acids can be replaced, where appropriate, by the corresponding alkenyl groups. The $R^1$ groups can also comprise branched chains, e.g., from isostearic acid, for at least part of the $R^1$ groups. The total of active represented by the branched chain groups, when they are present, is typically from about 1% to about 100%, preferably from about 10% to about 70%, more preferably from about 20% to about 50%.

| Fatty Acyl Group | $FA^8$ | $FA^9$ | $FA^{10}$ |
|---|---|---|---|
| Isomyristic acid | — | 1–2 | — |
| Myristic acid | 7–11 | 0.5–1 | — |
| Isopalmitic acid | 6–7 | 6–7 | 1–3 |
| Palmitic acid | 4–5 | 6–7 | — |
| Isostearic acid | 70–76 | 80–82 | 60–66 |
| Stearic acid | — | 2–3 | 8–10 |
| Isoleic acid | — | — | 13–17 |
| Oleic acid | — | — | 6–12 |
| IV | 3 | 2 | 7–12 |

$FA^8$–$FA^{10}$ are prepared from different commercially available isostearic acids.

The more preferred softener actives are those that are prepared as a single softener active from blends of all the different fatty acids that are represented (total fatty acid blend), rather than from blends of mixtures of separate finished softener actives that are prepared from different portions of the total fatty acid blend.

It is preferred that at least a majority of the fatty acyl, or alkyl, groups are unsaturated, e.g., from about 50% to 100%, preferably from about 55% to about 95%, more preferably from about 60% to about 90%, and that the total level of active containing polyunsaturated fatty acyl groups (TPU) be preferably from about 3% to about 30%. The cis/trans ratio for the unsaturated fatty acyl groups is usually important, with the cis/trans ratio being from 1:1 to about 50:1, the minimum being 1:1, preferably at least 3:1, and more preferably from about 4:1 to about 20:1. (As used herein, the "percent of softener active" containing a given $R^1$ group is the same as the percentage of that same $R^1$ group is to the total $R^1$ groups used to form all of the softener actives.)

The unsaturated, including the preferred polyunsaturated, fatty acyl and/or alkylene groups, discussed hereinbefore and hereinafter, surprisingly provide effective softening, but also provide better rewetting characteristics, good antistatic characteristics, and especially, superior recovery after freezing and thawing.

The highly unsaturated materials are also easier to formulate into concentrated premixes that maintain their low viscosity and are therefore easier to process, e.g., pump, mixing, etc. These highly unsaturated materials (total level of active containing polyunsaturated fatty acyl groups (TPU) being typically from about 3% to about 30%, with only the low amount of solvent that normally is associated with such materials, i.e., from about 5% to about 20%, preferably from about 8% to about 25%, more preferably from about 10% to about 20%, weight of the total softener/solvent mixture, are also easier to formulate into concentrated, stable compositions of the present invention, even at ambient temperatures. This ability to process the actives at low temperatures is especially important for the polyunsaturated groups, since it minimizes degradation. Additional protection against degradation can be provided when the compounds and softener compositions contain effective antioxidants, chelants, and/or reducing agents, as disclosed hereinafter.

The present invention can contain medium-chain cationic ammonium fabric softening compound, including softener actives having the above formula (1) and/or formula (2), below, wherein:

each Y is —O—(O)C—, —(R)N—(O)C—, —C(O)—N(R)—, or —C(O)—O—, preferably —O—(O)C—;

m is 2 or 3, preferably 2;

each n is 1 to 4, preferably 2;

each R is as defined hereinbefore;

each $R^1$, or $YR^1$ hydrophobic group is a saturated, $C_8$–$C_{14}$, preferably a $C_{12-14}$ hydrocarbyl, or substituted hydrocarbyl substituent (the IV is preferably about 10 or less, more preferably less than about 5). The sum of the carbons in the hydrophobic group is the number of carbon atoms in the $R^1$ group, or in the $YR^1$ group when Y is —O—(O)C— or —(R)N—(O)C—. The counterion, $A^-$, is the same as above. Preferably $A^-$ does not include phosphate salts.

The saturated $C_8$–$C_{14}$ fatty acyl groups can be pure derivatives or can be mixed chainlengths.

Suitable fatty acid sources for said fatty acyl groups are coco, lauric, caprylic, and capric acids.

For $C_{12}$–$C_{14}$ (or $C_{11}$–$C_{13}$) hydrocarbyl groups, the groups are preferably saturated, e.g., the IV is preferably less than about 10, preferably less than about 5.

It will be understood that substituents R and $R^1$ can optionally be substituted with various groups such as alkoxyl or hydroxyl groups, and can be straight, or branched so long as the $R^1$ groups maintain their basically hydrophobic character.

A preferred long chain amine softener active is one prepared from sources containing high levels of polyunsaturation, i.e., N,N-di(acyl-oxyethyl)-N-methyl ammonium chloride, where the acyl is derived from fatty acids containing sufficient polyunsaturation, e.g., mixtures of tallow fatty acids and soybean fatty acids. Another preferred long chain amine softener active is the dioleyl (nominally) DEQA, i.e., amine softener active in which N,N-di(oleoyl-oxyethyl)-N-methyl ammonium chloride is the major ingredient. Preferred sources of fatty acids for such amine softener actives are vegetable oils, and/or partially hydrogenated vegetable oils, with high contents of unsaturated, e.g., oleoyl groups.

As used herein, when the amine softener active diester is specified, it can include the monoester that is present. Preferably, at least about 80% of the amine softener active is in the diester form, and from 0% to about 20% can be amine softener active monoester, e.g., one $YR^1$ group is either OH, or —C(O)OH, and, for Formula 1., m is 2. The corresponding diamide and/or mixed ester-amide can also include the active with one long chain hydrophobic group, e.g., one $YR^1$ group is either —N(R)H , or —C(O)OH. In the following, any disclosure, e.g., levels, for the monoester actives is also applicable to the monoamide actives. For softening, under no/low detergent carry-over laundry conditions the percentage of monoester should be as low as possible, preferably no more than about 5%. However, under high, anionic detergent surfactant or detergent builder carry-over conditions, some monoester can be preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in manufacturing the amine softener active.

The above compounds, used as the biodegradable ester-amine softening material in the practice of this invention, can be prepared using standard reaction chemistry. In one synthesis of a di-ester variation of unquatemized DTDMAC, an amine of the formula $RN(CH_2CH_2OH)_2$ where R is e.g., alkyl, is esterified at both hydroxyl groups with an acid chloride of the formula $R^1C(O)Cl$, to form an amine which can be made cationic by acidification (one R is H) to be one type of amine softener active. However, it will be appreciated by those skilled in the chemical arts that this reaction sequence allows a broad selection of agents to be prepared.

Yet another amine softener active that is suitable for the formulation of the concentrated, clear liquid fabric softener compositions of the present invention has the above formula (1) wherein one R group is a $C_{1-4}$ hydroxy alkyl group, preferably one wherein one R group is a hydroxyethyl group. An example of such a hydroxyethyl ester active is di(acyloxyethyl)(2-hydroxyethyl) ammonium chloride, wherein the acyl group is derived from $FA^1$ described herein before.

(2) The second type of DEQA active has the general formula:

$$R_2—NH^+—CH_2—CH(YR^1)—CH_2—YR^1\ A^-$$

wherein each Y, R, $R^1$, and $A^-$ have the same meanings as before. Such compounds include those having the formula:

$$R_2\ NH^{(+)}[CH_2CH(CH_2O(O)CR^1)O(O)CR^1]\ Cl^{(-)}$$

where each R is a methyl or ethyl group and preferably each $R^1$ is in the range of $C_{15}$ to $C_{19}$. Degrees of branching and substitution can be present in the alkyl or alkenyl chains.

The anion $X^{(-)}$ in the molecule is the same as in amine softener active (1) above. As used herein, when the diester is specified, it can include the monoester that is present. The amount of monoester that can be present is the same as in amine softener active (1). An example of a preferred amine softener active of formula (2) is the "propyl" ester ammonium fabric softener active having the formula 1,2-di(acyloxy)-3-dimethylammoniopropane chloride, wherein the acyl group is the same as that of $FA^5$.

The preparation of these types of agents and general methods of making them as intermediates for the preparation of quaternary ammonium compounds are disclosed in U.S. Pat. No. 4,137,180, Naik et al., issued Jan. 30, 1979, which is incorporated herein by reference.

In preferred amine softener actives (1) and (2), each $R^1$ is a hydrocarbyl, or substituted hydrocarbyl, group, preferably, alkyl, monounsaturated alkenyl, and polyunsaturated alkenyl groups, with the softener active containing polyunsaturated alkenyl groups being preferably at least about 3%, more preferably at least about 5%, more preferably at least about 10%, and even more preferably at least about 15%, by weight of the total softener active present; the actives preferably containing mixtures of $R^1$ groups, especially within the individual molecules, and also, optionally, but preferably, the saturated $R^1$ groups comprising branched chains, e.g., from isostearic acid, for at least part of the saturated $R^1$ groups, the total of active represented by the branched chain groups preferably being from about 1% to about 90%, preferably from about 10% to about 70%, more preferably from about 20% to about 50%.

In preferred amine softener actives, —(O)$CR^1$ is derived from unsaturated fatty acid, e.g., oleic acid, and/or fatty acids and/or partially hydrogenated fatty acids, derived from animal fats, vegetable oils and/or partially hydrogenated vegetable oils, such as: canola oil; safflower oil; peanut oil; sunflower oil; soybean oil; corn oil; tall oil; rice bran oil; etc. As used herein, similar biodegradable fabric softener actives containing ester linkages are referred to as "DEQA", which includes both diester, triester, and monoester compounds containing from one to three, preferably two, long chain hydrophobic groups. The corresponding amide softener actives and the mixed ester-amide softener actives can also contain from one to three, preferably two, long chain hydrophobic groups. These fabric softener actives have the characteristic that they can be processed by conventional mixing means at ambient temperature, at least in the presence of about 15% of solvent C. as disclosed hereinbefore.

The amine softener actives herein can also contain a low level of fatty acid, which can be from unreacted starting material used to form the amine softener active and/or as a by-product of any partial degradation (hydrolysis) of the softener active in the finished composition. It is preferred that the level of free fatty acid be low, preferably below about 10%, and more preferably below about 5%, by weight of the softener active.

B. Materials to Increase Cationic Density (1) Polycationic materials

Polycationic materials include polymers, which are typically used at from about 0.001% to about 10%, preferably from about 0.01% to about 5%, more preferably from about 0. 1% to about 2%, of cationic polymer, by weight of the composition. Said polymers typically have a molecular weight of from about 500 to about 1,000,000, preferably from about 1,000 to about 500,000, more preferably from about 1,000 to about 250,000, and even more preferably from about 2,000 to about 100,000 and a charge density of at least about 0.01 meq/gm., preferably from about 0.1 to about 8 meq/gm., more preferably from about 0.5 to about 7, and even more preferably from about 2 to about 6.

The cationic polymers of the present invention can be amine salts or quaternary ammonium salts. Preferred are quaternary ammonium salts. They include cationic derivatives of natural polymers such as some polysaccharide, gums, starch and certain cationic synthetic polymers such as polymers and co-polymers of cationic vinyl pyridine or vinyl pyridinium halides. Preferably the polymers are water soluble, for instance to the extent of at least 0.5% by weight at 20° C. Preferably they have molecular weights of from about 600 to about 1,000,000, more preferably from about 600 to about 500,000, even more preferably from about 800 to about 300,000, and especially from about 1000 to 10,000. As a general rule, the lower the molecular weight the higher the degree of substitution (D.S.) by cationic, usually quaternary groups, which is desirable, or, correspondingly, the lower the degree of substitution the higher the molecular weight which is desirable, but no precise relationship appears to exist. In general, the cationic polymers should have a charge density of at least about 0.01 meq/gm., preferably from about 0.1 to about 8 meq/gm., more preferably from about 0.5 to about 7, and even more preferably from about 2 to about 6.

Suitable desirable cationic polymers are disclosed in "CTFA International Cosmetic Ingredient Dictionary", Fourth Edition, J. M. Nikitakis, et al, Editors, published by the Cosmetic, Toiletry, and Fragrance Association, 1991, incorporated herein by reference. The list includes the following:

Polyquaternium-1

CAS Number: 68518-54-7

Definition: Polyquaternium-1 is the polymeric quaternary ammonium salt that conforms generally to the formula:

$$\{(HOCH_2CH_2)_3N^+—CH_2CH=CHCH_2—[N^+(CH_3)_2—CH_2CH=CHCH_2]_x—N^+(CH_2CH_2OH)_3\}[Cl^-]_{x+2}$$

Polyquaternium-2

CAS Number: 63451-27-4

Definition: Polyquaternium-2 is the polymeric quaternary ammonium salt that conforms generally to the formula:

$$[—N(CH_3)_2—CH_2CH_2CH_2—NH—C(O)—NH—CH_2CH_2CH_2—N(CH_3)_2—CH_2CH_2OCH_2CH_2—]^{2+}(Cl^-)_2$$

Other Names: Mirapol A-15 (Rhone-Poulenc)

Polyquaternium-4

Definition: Polyquaternium-4 is a copolymer of hydroxyethylcellulose and diallyldimethyl ammonium chloride.

Other Names:

Celquat H 100 (National Starch)

Celquat L200 (National Starch)

Diallyldimoniurm Chloride/Hydroxyethyl-cellulose Copolymer

Polyquaternium-5

CAS Number: 26006-22-4

Definition: Polyquaternium-5 is the copolymer of acrylamide and beta-methacrylyloxyethyl trimethyl ammonium methosulfate.

Other Names:

Ethanaminium, N,N,N-Trimethyl-N-2-[(2-Methyl-1-Oxo-2-Propenyl)Oxy]-, Methyl Sulfate, Polymer with 2-Propenamide Nalco 7113 (Nalco)

Quaternium-39

Reten 210 (Hercules)

Reten 220 (Hercules)

Reten 230 (Hercules)

Reten 240 (Hercules)

Reten 1104 (Hercules)

Reten 1105 (Hercules)

Reten 1106 (Hercules)

Polyquaternium-6

CAS Number: 26062-79-3

Empirical Formula: $(C_8H_{16}N—Cl)_x$

Definition: Polyquaternium-6 is a polymer of dimethyl diallyl ammonium chloride.

Other Names:

Agequat-400 (CPS)

Conditioner P6 (3V-SIGMA)

N,N-Dimethyl-N-2-Propenyl-2-Propen-1-aminium Chloride, Homopolymer

Hoe S 3654 (Hoechst AG)

Mackemium 006 (McIntyre)

Merquat 100 (Calgon)

Nalquat 6-20 (Nalco)

Poly-DAC 40 (Rhone-Poulenc)

Poly(Dimethyl Diallyl Ammonium Chloride)

Poly(DMDAAC)

2-Propen-1-aminium, N,N-Dimethyl-N-2-Propenyl-, Chloride, Homopolymer

Quatemium-40

Salcare SC30 (Allied Colloids)

Polyquaternium-7

CAS Number: 26590-05-6

Empirical Formula: $(C_8H_{16}N·C_3H_5NO·Cl)_x$

Definition: Polyquaternium-7 is the polymeric quaternary ammonium salt consisting of acrylamide and dimethyl diallyl ammonium chloride monomers.

Other Names:

Agequat-500 (CPS)

Agequat-5008 (CPS)

Agequat C-505 (CPS)

Conditioner P7 (3V-SIGMA)

N,N-Dimethyl-N-2-Propenyl-2-Propen-1-aminium Chloride, Polymer with 2-Propenamide
Mackemium 007 (McIntyre)
Merquat 550 (Calgon)
Merquat S (Calgon)
2-Propen-1-aminium, N,N-Dimethyl-N-2-Propenyl-, Chloride, Polymer with 2-Propenamide
Quatemium-41
Salcare SC10(Allied Colloids)
Polyquaternium-8
Definition: Polyquaternium-8 is the polymeric quatemary ammonium salt of methyl and stearyl dimethylaminoethyl methacrylate quaternized with dimethyl sulfate.
Other Names:
Methyl and Stearyl Dimethylaminoethyl Methacrylate Quaternized with Dimethyl Sulfate
Quatemium-42
Polyquaternium-9
Definition: Polyquaternium-9 is the polymeric quaternary ammonium salt of polydimethylaminoethyl methacrylate quaternized with methyl bromide.
Other Names:
Polydimethylaminoethyl Methacrylate Quaternized with Methyl Bromide
Quaternium-49
Polyquaternium-10
CAS Numbers: 53568-66-4; 55353-19-0; 54351-50-7; 81859-24-7; 68610-92-4; 81859-24-7
Definition: Polyquaternium-10 is a polymeric quaternary ammonium salt of hydroxyethyl cellulose reacted with a trimethyl ammonium substituted epoxide.
Other Names:
Cellulose, 2-[2-Hydroxy-3-Trimethylammono) propoxy] Ethyl ether, chloride
Celquat SC-240 (National Starch)
Quatemium-19
UCARE Polymer JR-125 (Amerchol)
UCARE Polymer JR-400 (Amerchol)
UCARE Polymer JR-30M (Amerchol)
UCARE Polymer LR 400 (Amerchol)
UCARE Polymer LR 30M (Amerchol)
Ucare Polymer SR-10 (Amerchol)
Polyquaternium-11
Empirical Formula: $(C_8H_{15}NO_2.C_6H_9NO)_x.xC_4H_{10}0_4S$
Definition: Polyquaternium-11 is a quaternary ammonium polymer formed by the reaction of diethyl sulfate and a copolymer of vinyl pyrrolidone and dimethyl aminoethylmethacrylate.
Other Names:
Gafquat 734 (GAF)
Gafquat 755 (GAF)
Gafquat 755N (GAF)
2-Propenol Acid, 2-Methyl-2-(Dimethylamino) Ethyl Ester, Polymer and 1-Ethenyl-2-Pyrrolidinone, Compound with Diethyl Sulfate
2-Pyrrolidinone, 1-Ethenyl- Polymer and 2-(Dimethylamino) Ethyl 2-Methyl-2-Propenoate, Compound and Diethyl Sulfate
2-Pyrrolidinone, 1-Ethenyl-, Polymer and 2-(Dimethylamino) Ethyl 2-Methyl-2-Propenoate, compound with Diethyl Sulfate
Quaternium-23
Polyquaternium-12
CAS Number: 68877-50-9
Definition: Polyquaternium-12 is a polymeric quaternary ammonium salt prepared by the reaction of ethyl methacrylate/abietyl methacrylate/diethylaminoethyl methacrylate copolymer with dimethyl sulfate.
Other Names:
Ethyl Methacrylate/Abietyl Methacrylate/Diethylaminoethyl
Methacrylate-Quaternized with Dimethyl Sulfate
Quatemium-37
Polyquaternium-13
CAS Number: 68877-47-4
Definition: Polyquaternium-13 is a polymeric quaternary ammonium salt prepared by the reaction of ethyl methacrylate/oleyl methacrylate/diethylaminoethyl methacrylate copolymer with dimethyl sulfate.
Other Names:
Ethyl Methacrylate/Oleyl Methacrylate/Diethylaminoethyl Methacrylate-Quaternized with Dimethyl Sulfate
Quaternium 38
Polyquaternium-14
CAS Number: 27103-90-8
Definition: Polyquaternium-14 is the polymeric quaternary ammonium salt that conforms generally to the formula:

$$—\{—CH_2—C—(CH_3)—[C(O)O—CH_2CH_2—N(CH_3)_3-]\}_x^+ [CH_3SO_4]^-_x$$

Other Names:
Ethanaminium, N,N,N-Trimethyl-2-[(2-Methyl-1—Oxo-2-Propenyl)Oxy]-, Methyl Sulfate,
Homopolymer
Reten 300 (Hercules)
Polyquaternium-15
CAS Number: 35429-19-7
Definition: Polyquaternium-15 is the copolymer of acrylamide and betamethacrylyloxyethyl trimethyl ammonium chloride.
Other Names:
Rohagit KF 400 (Rohm GmbH)
Rohagit KF 720 (Rohm GmbH)
Polyquaternium-16
Definition: Polyquaternium-16 is a polymeric quaternary ammonium salt formed from methylvinylimidazolium chloride and vinylpyrrolidone.
Other Names:
Luviquat FC 370 (BASF)
Luviquat FC 550 (BASF)
Luviquat FC 905 (BASF)
Luviquat HM-552 (BASF)
Polyquaternium-17
Definition: Polyquaternium-17 is a polymeric quaternary salt prepared by the reaction of adipic acid and dimethylaminopropylamine, reacted with dichloroethyl ether. It conforms generally to the formula:

$$—[—N^+(CH_2)_3NH(O)C—(CH_2)_4—C(O)NH—(CH_2)_3—N(CH_3)_2—(CH_2)_2—O—(CH_2)_2-]_x Cl^-_x$$

Other Names:
Mirapol AD-1 (Rhône-Poulenc)
Polyquaternium-18
Definition: Polyquaternium-18 is a polymeric quaternary salt prepared by the reaction of azelaic acid and dimethylaminopropylamine reacted with dichloroethyl ether. It conforms generally to the formula:

$$—[—N^+(CH_2)_3NH—(O)C—(CH_2)_3C(O)—NH—(CH_2)_3—N(CH_3)_2—(—CH_2)_2—O—(CH_2)_2-]_x Cl^-_x$$

Other Names:
Mirapol AZ-1 (Rhône-Poulenc)
Polyquaternium-19
Definition: Polyquaternium-19 is the polymeric quaternary ammonium salt prepared by the reaction of polyvinyl alcohol with 2,3-epoxypropylamine.

Other Names:

Arlatone PQ-220 (ICI Americas)

Polyquaternium-20

Definition: Polyquaternium-20 is the polymeric quaternary ammonium salt prepared by the reaction of polyvinyl octadecyl ether with 2,3-epoxypropylamine.

Other Names:

Arlatone PQ-225 (ICI Americas)

Polyquaternium-22

CAS Number: 53694-17-0

Empirical Formula:

$(C_8H_{16}NCl)\ (C_3H_3O_2)$

Definition: Polyquaternium-22 is a copolymer of dimethyldiallyl ammonium chloride and acrylic acid. It conforms generally to the formula:

$-[DMDA]_x-\quad —[—CH_2CH(C(O)OH)—]_y—$ where $-[DMDA]_x-$ is:

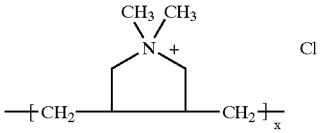

Other Names:

Merquat 280 (Calgon)

Polyquaternium-24

Definition: Polyquaternium-24 is a polymeric quaternary ammonium salt of hydroxyethyl cellulose reacted with a lauryl dimethyl ammonium substituted epoxide.

Other Names:

Quatrisoft Polymer LM-200 (Amerchol)

Polyquaternium-27

Definition: Polyquaternium-27 is the block copolymer formed by the reaction of Polyquaternium-2 with Polyquaternium-17.

Other Names:

Mirapol 9 (Rhône-Poulenc)

Mirapol-95 (Rhône-Poulenc)

Mirapol 175 (Rhône-Poulenc)

Polyquaternium-28

Definition: Polyquaternium-28 is a polymeric quaternary ammonium salt consisting of vinylpyrrolidone and dimethylaminopropyl methacrylamide monomers. It conforms generally to the formula:

$-\{VP\}_x-\{—CH_2—CH(CH_3)[C(O)—NH—CH_2CH_2CH_2N^+(CH_3)_3-]\}_y\ Cl^-_y$ where [VP] is:

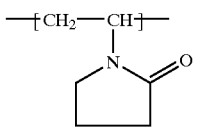

Other Names:

Gafquat HS-100 (GAF)

Vinylpyrrolidone/Methacrylamidopropyltrimethylammonium Chloride Copolymer.

Polyquaternium-29

Definition: Polyquaternium-29 is Chitosan that has been reacted with propylene oxide and quaternized with epichlorohydrin.

Other Names:

Lexquat CH (Inolex).

Polyquaternium-30

Definition: Polyquaternium-30 is the polymeric quaternary ammonium salt that conforms generally to the formula:

$—[CH_2C(CH_3)(C(O)OCH_3)]_x—[CH_2C(CH_3)(C(O)OCH_2CH_2N^+(CH_3)_2CH_2COO^-)]_y—$

Other Names:

Mexomere PX (Chimex)

Of the polysaccharide gums, guar and locust bean gums, which are galactomannam gums are available commercially, and are preferred. Thus guar gums are marketed under Trade Names CSAA M/200, CSA 200/50 by Meyhall and Stein-Hall, and hydroxyalkylated guar gums are available from the same suppliers. Other polysaccharide gums commercially available include: Xanthan Gum; Ghatti Gum; Tamarind Gum; Gum Arabic; and Agar.

Cationic guar gums and methods for making them are disclosed in British Pat. No. 1,136,842 and U.S. Pat. No. 4,031,307. Preferably they have a D.S. of from 0.1 to about 0.5.

An effective cationic guar gum is Jaguar C-13S (Trade Name—Meyhall), believed to be derived from guar gum of molecular weight about 220,000, and to have a degree of substitution about 0.13, wherein the cationic moiety has the formula:

$—CH_2CH(OH)CH_2N^+(CH_3)_3\ Cl^-$

Very effective also is guar gum quaternized to a D.S. of about 0.2 to 0.5 with the quaternary grouping:

$—CH_2CH(OH)CH_2N^+(CH_3)_3\ Cl^-$ or $—CH_2CH{=}CHCH_2N^+(CH_3)_3\ Cl^-$

Cationic guar gums are a highly preferred group of cationic polymers in compositions according to the invention and act both as scavengers for residual anionic surfactant and also add to the softening effect of cationic textile softeners even when used in baths containing little or no residual anionic surfactant. The cationic guar gums are effective at levels from about 0.03 to 0.7% by weight of the compositions preferably up to 0.4%.

The other polysaccharide-based gums can be quaternized similarly and act substantially in the same way with varying degrees of effectiveness. Suitable starches and derivatives are the natural starches such as those obtained from maize, wheat, barley etc., and from roots such as potato, tapioca etc., and dextrins, particularly the pyrodextrins such as British gum and white dextrin.

In particular, cationic dextrins such as the above, which have molecular weights (as dextrins) in the range from about 1,000 to about 10,000, usually about 5,000, are effective scavengers for anionic surfactants. Preferably the D.S. is in the range from 0.1 upwards, especially from about 0.2 to 0.8. Also suitable are cationic starches, especially the linear fractions, amylose, quaternized in the usual ways. Usually the D.S. is from 0.01 to 0.9, preferably from 0.2 to 0.7, that is rather higher than in most conventional cationic starches.

The cationic dextrins usually are employed at levels in the range from about 0.05 to 0.7% of the composition, especially from about 0.1 to 0.5%. Polyvinyl pyridine and co-polymers thereof with for instance styrene, methyl methacrylate, acrylamides, N-vinyl pyrrolidone, quaternized at the pyridine nitrogens are very effective, and can be employed at even lower levels than the polysaccharide derivatives discussed above, for instance at 0.01 to 0.2% by weight of the composition, especially from 0.02 to 0.1%. In some instances the performance seems to fall off when the content exceeds some optimum level such as about 0.05% by weight for polyvinyl pyridinium chloride and its co-polymer with styrene.

Some very effective individual cationic polymers are the following: Polyvinyl pyridine, molecular weight about 40,000, with about 60% of the available pyridine nitrogens quaternized.; Co-polymer of 70/30 molar proportions of vinyl pyridine/styrene, molecular weight about 43,000, with about 45% of the available pyridine nitrogens quaternized as above.; Co-polymers of 60/40 molar proportions of vinyl pyridine/acrylamide, with about 35% of the available pyridine nitrogens quaternized as above. Co-polymers of 77/23 and 57/43 molar proportions of vinyl pyridine/methyl methacrylate, molecular weight about 43,000, with about 97% of the available pyridine nitrogens quaternized as above.

These cationic polymers are effective in the compositions at very low concentrations for instance from 0.001% by weight to 0.2% especially from about 0.02% to 0.1%. In some instances the effectiveness seems to fall off, when the content exceeds some optimum level, such as for polyvinyl pyridine and its styrene co-polymer about 0.05%.

Some other effective cationic polymers are: Co-polymer of vinyl pyridine and N-vinyl pyrrolidone (63/37) with about 40% of the available pyridine nitrogens quaternized.; Co-polymer of vinyl pyridine and acrylonitrile (60/40), quaternized as above.; Co-polymer of N,N-dimethyl amino ethyl methacrylate and styrene (55/45) quaternized as above at about 75% of the available amino nitrogens. Eudragit E (Trade Name of Rohm GmbH) quaternized as above at about 75% of the available amino nitrogens. Eudragit E is believed to be co-polymer of N,N-dialkyl amino alkyl methacrylate and a neutral acrylic acid ester, and to have molecular weight about 100,000 to 1,000,000.; Co-polymer of N-vinyl pyrrolidone and N,N-diethyl amino methyl methacrylate (40/50), quaternized at about 50% of the available amino nitrogens.; These cationic polymers can be prepared in a known manner by quaternizing the basic polymers.

Yet other co-polymers are condensation polymers, formed by the condensation of two or more reactive monomers both of which are bifunctional. Two broad classes of these polymers can be formed which are then made cationic, viz. (a) those having a nitrogen atom which can be cationic in the back bone or which can be made cationic in the back bone.

Compounds of class (a) can be prepared by condensing a tertiary or secondary amine of formula:

$$R_{11}N(R_{12}OH)_2$$

wherein $R_{11}$ is H or a $C_{1-6}$ alkyl group, preferably methyl, or $R_{12}$ OH and each $R_{12}$ independently is a $C_{1-6}$ alkylene group, preferably ethylene, with a dibasic acid, or the corresponding acyl halide having formula $$XOOC(R_{13})COOX$$

or the anhydride thereof, wherein $R_{13}$ is a $C_{1-6}$ alkylene, hydroxy alkylene or alkenyl group or an aryl group, and X is H, or a halide preferably chloride. Some suitable acids are succinic, malic, glutaric, adipic, pimelic, suberic, maleic, ortho-, meta- and tere-phthalic, and their mono and di-chlorides. Very suitable anhydrides include maleic and phthalic anhydrides. The condensation leads to polymers having repeating units of structure $$[—R_{12}—N(R_{11})—R_{12}—O(O)C—R_{13}—C(O)O—]$$

Reactions of this sort are described in British Pat. No. 602.048. These can be rendered cationic for instance by addition of an alkyl or alkoyl halide or a di-alkyl sulphate at the back bone nitrogen atoms or at some of them. When $R_{11}$ is ($R_{12}$ OH) this group can be esterified by reaction with a carboxylic acid, e.g. a $C_{1-20}$ saturated or unsaturated fatty acid or its chloride or anhydride as long as the resulting polymers remain sufficiently water soluble. When long chain, about RIO and higher, fatty acids are employed these polymers can be described as "comb" polymers. Alternatively when $R_{11}$ is ($R_{12}$ OH) the $R_{11}$ groups can be reacted with a cationic e.g. a quaternary ammonium group such as glycidyl trimethyl ammonium chloride or 1-chlorobut-2-ene trimethyl ammonium chloride, and like agents mentioned hereinafter.

Some cationic polymers of this class can also be made by direct condensation of a dicarboxylic acid etc. with a difunctional quaternary ammonium compound having for instance the formula $$R_{11}R_{14}N^+(R_{12}OH)_2\,Z^-$$

where $R_{14}$ is an H or $C_{1-6}$ alkyl group, and $R_{11}$ and $R_{12}$ are as defined above, and $Z^-$ is an anion.

Another class of copolymer with nitrogens which can be made cationic in the back bone can be prepared by reaction of a dicarboxylic acid, etc. as defined above with a dialkylene triamine, having structure $$H_2NR_{15}N(R_{17})R_{16}NH_2$$

where $R_{15}$ and $R_{16}$ independently each represent a $C_{2-6}$ alkylene group, and $R_{17}$ is hydrogen or a $C_{1-6}$ alkyl group. This leads to polymers having the repeating unit $$[—(O)C—R_{13}—C(O)—NH—R_{15}—N(R_{17})—R_{16}—NH—]$$

wherein the nitrogen not directly linked to a CO group i.e. not an amide nitrogen, can be rendered cationic, as by reaction with an alkyl halide or dialkyl sulphate.

Commercial examples of a condensation polymers believed to be of this class are sold under the generic Trade Name Alcostat by Allied Colloids.

Yet other cationic polymeric salts are quaternized polyethyleneimines. These have at least 10 repeating units, some or all being quaternized.

Commercial examples of polymers of this class are also sold under the generic Trade Name Alcostat by Allied Colloids.

It will be appreciated by those skilled in the art that these quaternization and esterification reactions do not easily go to completion, and usually a degree of substitution up to about 60% of the available nitrogen is achieved and is quite effective. Thus it should be understood that usually only some of the units constituting the cationic polymers have the indicated structures.

Polymers of class (b), with no nitrogen in the back bone can be made by reacting a triol or higher polyhydric alcohol with a dicarboxylic acid etc. as described above, employing glycerol, for example. These polymers can be reacted with cationic groups at all the hydroxyls, or at some of them.

Typical examples of the above types of polymers are disclosed in U.S. Pat. 4,179,382, incorporated hereinbefore by reference.

Other cationic polymers of the present invention are water-soluble or dispersible, modified polyamines. The polyamine cationic polymers of the present invention are water-soluble or dispersible, modified polyamines. These polyamines comprise backbones that can be either linear or cyclic. The polyamine backbones can also comprise polyamine branching chains to a greater or lesser degree. In general, the polyamine backbones described herein are modified in such a manner that each nitrogen of the polyamine chain is thereafter described in terms of a unit that is substituted, quaternized, oxidized, or combinations thereof.

For the purposes of the present invention the term "modification" is defined as replacing a backbone —NH hydrogen atom by an E unit (substitution), quaternizing a backbone nitrogen (quaternized) or oxidizing a backbone nitrogen to the N-oxide (oxidized). The terms "modification" and "substitution" are used interchangably when referring to the process of replacing a hydrogen atom attached to a backbone nitrogen with an E unit. Quaternization or oxidation may take place in some circumstances without substitution, but preferably substitution is accompanied by oxidation or quaternization of at least one backbone nitrogen.

The linear or non-cyclic polyamine backbones that comprise the polyamine cationic polymers of the present invention have the general formula:

$$[H_2N—R]_{n+1}—[N(H)—R]_m—[N(H)—R]_n—NH_2$$

said backbones prior to subsequent modification, comprise primary, secondary and tertiary amine nitrogens connected by R "linking" units. The cyclic polyamine backbones comprising the polyamine cationic polymers of the present invention have the general formula:

$$[H_2N—R]_{n-k+1}—[N(H)—R]_m—[N(-)—R]_n—[N(R)—R]_k—NH_2$$

wherein (–) indicates a covalent bond, said backbones prior to subsequent modification, comprise primary, secondary and tertiary amine nitrogens connected by R "linking" units For the purpose of the present invention, primary amine nitrogens comprising the backbone or branching chain once modified are defined as V or Z "terminal" units. For example, when a primary amine moiety, located at the end of the main polyamine backbone or branching chain having the structure $$[H_2N—R]—$$

is modified according to the present invention, it is thereafter defined as a V "terminal" unit, or simply a V unit. However, for the purposes of the present invention, some or all of the primary amine moieties can remain unmodified subject to the restrictions further described herein below. These unmodified primary amine moieties by virtue of their position in the backbone chain remain "terminal" units. Likewise, when a primary amine moiety, located at the end of the main polyamine backbone having the structure $$—NH_2$$

is modified according to the present invention, it is thereafter defined as a Z "terminal" unit, or simply a Z unit. This unit can remain unmodified subject to the restrictions further described herein below.

In a similar manner, secondary amine nitrogens comprising the backbone or branching chain once modified are defined as W "backbone" units. For example, when a secondary amine moiety, the major constituent of the back bones and branching chains of the present invention, having the structure $$—[N(H)—R]—$$

is modified according to the present invention, it is thereafter defined as a W "backbone" unit, or simply a W unit. However, for the purposes of the present invention, some or all of the secondary amine moieties can remain unmodified. These unmodified secondary amine moieties by virtue of their position in the backbone chain remain "backbone" units.

In a further similar manner, tertiary amine nitrogens comprising the backbone or branching chain once modified are further referred to as Y "branching" units. For example, when a tertiary amine moiety, which is a chain branch point of either the polyamine backbone or other branching chains or rings, having the structure $$—[N(-)—R]—$$

wherein (–) indicates a covalent bond, is modified according to the present invention, it is thereafter defined as a Y "branching" unit, or simply a Y unit. However, for the purposes of the present invention, some or all or the tertiary amine moieties can remain unmodified. These unmodified tertiary amine moieties by virtue of their position in the backbone chain remain "branching" units. The R units associated with the V, W and Y unit nitrogens which serve to connect the polyamine nitrogens, are described herein below.

The final modified structure of the polyamines of the present invention can be therefore represented by the general formula $$V_{(n+1)}W_mY_nZ$$

for linear polyamine cotton soil release polymers and by the general formula $$V_{(n-k+1)}W_mY_nY'_kZ$$

for cyclic polyamine cotton soil release polymers. For the case of polyamines comprising rings, a Y' unit of the formula $$—[N(R—)—R]—$$

serves as a branch point for a backbone or branch ring. For every Y' unit there is a Y unit having the formula $$—[N(-)—R]—$$

that will form the connection point of the ring to the main polymer chain or branch. In the unique case where the backbone is a complete ring, the polyamine backbone has the formula $$[H_2N—R]_n—[N(H)—R]_m—[N(-)—R]_n—$$

therefore comprising no Z terminal unit and having the formula $$V_{n-k}W_mY_nY'_k$$

wherein k is the number of ring forming branching units. Preferably the polyamine backbones of the present invention comprise no rings.

In the case of non-cyclic polyamines, the ratio of the index n to the index m relates to the relative degree of branching. A fully non-branched linear modified polyamine according to the present invention has the formula $$VW_mZ$$

that is, n is equal to 0. The greater the value of n (the lower the ratio of m to n), the greater the degree of branching in the molecule. Typically the value for m ranges from a minimum value of 4 to about 400, however larger values of m, especially when the value of the index n is very low or nearly 0, are also preferred.

Each polyamine nitrogen whether primary, secondary or tertiary, once modified according to the present invention, is further defined as being a member of one of three general classes; simple substituted, quaternized or oxidized. Those polyamine nitrogen units not modified are classed into V, W, Y, or Z units depending on whether they are primary, secondary or tertiary nitrogens. That is unmodified primary amine nitrogens are V or Z units, unmodified secondary amine nitrogens are W units and unmodified tertiary amine nitrogens are Y units for the purposes of the present invention.

Modified primary amine moieties are defined as V "terminal" units having one of three forms:

a) simple substituted units having the structure:

$N(E_2)—R—$ b) quaternized units having the structure:

$N(E_3)—R—(X^-)$ wherein X is a suitable counter ion providing charge balance; and c) oxidized units having the structure:

$(—R)(E_2)N→O$

Modified secondary amine moieties are defined as W "backbone" units having one of three forms:

a) simple substituted units having the structure:

$—N(E)—R—$ b) quaternized units having the structure:

$—N^+(E_2)—R—$ wherein X is a suitable counter ion providing charge balance; and c) oxidized units having the structure:

$—N(E)(R—)→O$

Modified tertiary amine moieties are defined as Y "branching" units having one of three forms:

a) unmodified units having the structure:

$(-)_2N —R—,$ b) quaternized units having the structure:

$(-)_2(E)N^+—R—,$ wherein X is a suitable counter ion providing charge balance; and c) oxidized units having the structure:

$—R—N(-)_2→O,$

Certain modified primary amine moieties are defined as Z "terminal" units having one of three forms:

a) simple substituted units having the structure:

$—N(E)_2$ b) quaternized units having the structure:

$—N^+(E)_3 X^-$ wherein X is a suitable counter ion providing charge balance; and c) oxidized units having the structure:

$—R—N(E)_2→O,$

When any position on a nitrogen is unsubstituted, or unmodified, it is understood that hydrogen will substitute for E. For example, a primary amine unit comprising one E unit in the form of a hydroxyethyl moiety is a V terminal unit having the formula $(HOCH_2CH_2)HN—.$ For the purposes of the present invention there are two types of chain terminating units, the V and Z units. The Z "terminal" unit derives from a terminal primary amino moiety of the structure $-NH_2$. Non-cyclic polyamine backbones according to the present invention comprise only one Z unit whereas cyclic polyamines can comprise no Z units. The Z "terminal" unit can be substituted with any of the E units described further herein below, except when the Z unit is modified to form an N-oxide. In the case where the Z unit nitrogen is oxidized to an N-oxide, the nitrogen must be modified and therefore E cannot be a hydrogen.

The polyamines of the present invention comprise backbone R "linking" units that serve to connect the nitrogen atoms of the backbone. R units comprise units that for the purposes of the present invention are referred to as "hydrocarbyl R" units and "oxy R" units. The "hydrocarbyl" R units are $C_2$–$C_{12}$ alkylene, $C_4$–$C_{12}$ alkenylene, $C_3$–$C_{12}$ hydroxyalkylene wherein the hydroxyl moiety can take any position on the R unit chain except the carbon atoms directly connected to the polyamine backbone nitrogens; $C_4$–$C_{12}$ dihydroxyalkylene wherein the hydroxyl moieties can occupy any two of the carbon atoms of the R unit chain except those carbon atoms directly connected to the polyamine backbone nitrogens; $C_8$–$C_{12}$ dialkylarylene which for the purpose of the present invention are arylene moieties having two alkyl substituent groups as part of the linking chain. For example, a dialkylarylene unit has the formula

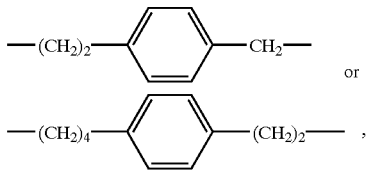

although the unit need not be 1,4-substituted, but can also be 1,2 or 1,3 substituted $C_2$–$C_{12}$ alkylene, preferably ethylene, 1,2-propylene, and mixtures thereof, more preferably ethylene. The "oxy" R units comprise $—(R^1O)_xR^5(OR^1)_x—$, $CH_2CH(OR^2)CH_2O)_z(R^1O)_yR^1(OCH_2CH(OR^2)CH_2)_w—$, $—CH_2CH(OR^2)CH_2—$, $—(R^1O)_xR^1—$, and mixtures thereof. Preferred R units are $C_2$–$C_{12}$ alkylene, $C_3$–$C_{12}$ hydroxyalkylene, $C_4$–$C_{12}$ dihydroxyalkylene, $C_8$–$C_{12}$ dialkylarylene, $—(R^1O)_xR^1—$, $CH_2CH(OR^2)CH_2—$, $—(CH_2CH(OH)CH_2O)_z(R^1O)_yR^1(OCH_2CH—(OH)CH_2)_w—$, $(R^1O)_xR^5(OR^1)_x—$, more preferred R units are $C_2$–$C_{12}$ alkylene, $C_3$–$C_{12}$ hydroxy-alkylene, $C_4$–$C_{12}$ dihydroxyalkylene, $—(R^1O)_xR^1—$, $—(R^1O)_xR^5(OR^1)_x—$, $(CH_2CH(OH)CH_2O),(R^1O)_yR^1(OCH_2CH—(OH)CH_2)_w—$, and mixtures thereof, even more preferred R units are $C_2$–$C_{12}$ alkylene, $C_3$ hydroxyalkylene, and mixtures thereof, most preferred are $C_2$–$C_6$ alkylene. The most preferred backbones of the present invention comprise at least 50% R units that are ethylene.

$R^1$ units are $C_2$–$C_6$ alkylene, and mixtures thereof, preferably ethylene. $R^2$ is hydrogen, and —$(R^1O)_xB$, preferably hydrogen.

$R^3$ is $C_1$–$C_{18}$ alkyl, $C_7$–$C_{12}$ arylalkylene, $C_7$–$C_{12}$ alkyl substituted aryl, $C_6$–$C_{12}$ aryl, and mixtures thereof, preferably $C_1$–$C_{12}$ alkyl, $C_7$–$C_{12}$ arylalkylene, more preferably $C_1$–$C_{12}$ alkyl, most preferably methyl. $R^3$ units serve as part of E units described hereinbelow.

$R^4$ is $C_1$–$C_{12}$ alkylene, $C_4$–$C_{12}$ alkenylene, $C_8$–$C_{12}$ arylalkylene, $C_6$–$C_{10}$ arylene, preferably $C_1$–$C_{10}$ alkylene, $C_8$–$C_{12}$ arylalkylene, more preferably $C_2$–$C_8$ alkylene, most preferably ethylene or butylene.

$R^5$ is $C_1$–$C_{12}$ alkylene, $C_3$–$C_{12}$ hydroxyalkylene, $C_4$–$C_{12}$ dihydroxyalkylene, $C_8$–$C_{12}$ dialkylarylene, —C(O)—, —C(O)NHR$^6$NHC(O)—, —C(O)$(R^4)_r$C(O)—, —$R^1(OR^1)$-, —$CH_2CH(OH)CH_2O(R^1O)_yR^1OCH_2CH(OH)CH_2$—, C(O)$(R^4)_r$C(O)—, —$CH_2CH(OH)CH_2$—, $R^5$ is preferably ethylene, —C(O)—, C(O)NHR$^6$NHC(O)—, —$R^1(OR^1)$-, —$CH_2CH(OH)CH_2$—, $CH_2CH(OH)CH_2O(R^1O)_yR^1OCH_2CH$—(OH)$CH_2$—, more preferably —$CH^2CH(OH)CH_2$—$R^6$ is $C_2$–$C_{12}$ alkylene or $C_6$–$C_{12}$ arylene.

The preferred "oxy" R units are further defined in terms of the $R^1$, $R^2$, and $R^5$ units. Preferred "oxy" R units comprise the preferred $R^1$, $R^2$, and $R^5$ units. The preferred cotton soil release agents of the present invention comprise at least 50% $R^1$ units that are ethylene. Preferred $R^1$, $R^2$, and $R^5$ units are combined with the "oxy" R units to yield the preferred "oxy" R units in the following manner.

i) Substituting more preferred $R^5$ into —$(CH_2CH_2O)_xR^5(OCH_2CH_2)_x$—yields—$(CH_2CH_2O)_xCH_2CHOHCH_2(OCH_2CH_2)_x$—.

ii) Substituting preferred $R^1$ and $R^2$ into —$(CH_2CH(OR^2)CH_2O)_z$—$(R^1O)_yR^1O(CH_2CH(OR^2)CH_2)_w$- yields—$(CH_2CH(OH)CH_2O)_z$—$(CH_2CH_2O)_yCH_2C$ iii) Substituting preferred $R^2$ into —$CH_2CH(OR^2)CH_2$— yields —$CH_2CH(OH)CH_2$—.

E units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_pPO_3M$, —$(R^1O)_mB$, —C(O)$R^3$, preferably hydrogen, $C_2$–$C_{22}$ hydroxyalkylene, benzyl, $C_1$–$C_{22}$ alkylene, —$(R^1O)_mB$, —C(O)$R^3$, —$(CH_2)_pCO_2M$, —$(CH_2)_qSO_3M$, —$CH(CH_2CO_2M)CO_2M$, more preferably $C_1$–$C_{22}$ alkylene, —$(R^1O)_xB$, —C(O)$R^3$, —$(CH_2)_pCO_2M$, —$(CH_2)_qSO_3M$, —$CH(CH_2CO_2M)CO_2M$, most preferably $C_1$–$C_{22}$ alkylene, —$(R^1O)_xB$, and —C(O)$R^3$. When no modification or substitution is made on a nitrogen then hydrogen atom will remain as the moiety representing E.

E units do not comprise hydrogen atom when the V, W or Z units are oxidized, that is the nitrogens are N-oxides. For example, the backbone chain or branching chains do not comprise units of the following structures:

$$(-)_{0-1}(R)_{0-1}(H)_{1-2}N\rightarrow O$$

Additionally, E units do not comprise carbonyl moieties directly bonded to a nitrogen atom when the V, W or Z units are oxidized, that is, the nitrogens are N-oxides. According to the present invention, the E unit —C(O)$R^3$ moiety is not bonded to an N-oxide modified nitrogen, that is, there are no N-oxide amides having the structures $$R^3—C(O)N(E)_{0-1}(-)_{0-1}\Delta O$$

or combinations thereof.

B is hydrogen, $C_1$–$C_6$ alkyl, —$(CH_2)_qSO_3M$, —$(CH_2)_pCO_2M$, —$(CH_2)_q$—$(CHSO_3M)CH_2SO_3M$, $(CH_2)_q(CHSO_2M)CH_2SO_3M$, —$(CH_2)_pPO_3M$, —$PO_3M$, preferably hydrogen, —$(CH_2)_qSO_3M$, $(CH_2)_q(CHSO_3M)CH_2SO_3M$, —$(CH_2)_q$—$(CHSO_2M)CH_2SO_3M$, more preferably hydrogen or —$(CH_2)_qSO_3M$.

M is hydrogen or a water soluble cation in sufficient amount to satisfy charge balance. For example, a sodium cation equally satisfies —$(CH_2)_pCO_2M$, and —$(CH_2)_qSO_3M$, thereby resulting in —$(CH_2)_pCO_2Na$, and —$(CH_2)_qSO_3Na$ moieties. More than one monovalent cation, (sodium, potassium, etc.) can be combined to satisfy the required chemical charge balance. However, more than one anionic group may be charge balanced by a divalent cation, or more than one mono-valent cation may be necessary to satisfy the charge requirements of a poly-anionic radical. For example, a —$(CH_2)_pPO_3M$ moiety substituted with sodium atoms has the formula —$(CH_2)_pPO_3Na_3$. Divalent cations such as calcium ($Ca^{2+}$) or magnesium ($Mg^{2+}$) may be substituted for or combined with other suitable mono-valent water soluble cations. Preferred cations are sodium and potassium, more preferred is sodium.

X is a water soluble anion such as chlorine ($Cl^-$), bromine ($Br^-$) and iodine ($I^-$) or X can be any negatively charged radical such as sulfate ($SO_4^{2-}$) and methosulfate ($CH_3SO_3^-$).

The formula indices have the following values: p has the value from 1 to 6, q has the value from 0 to 6; r has the value 0 or 1; w has the value 0 or 1, x has the value from 1 to 100; y has the value from 0 to 100; z has the value 0 or 1; k is less than or equal to the value of n; m has the value from 4 to about 400, n has the value from 0 to about 200; m +n has the value of at least 5.

The preferred polyamine cationic polymers of the present invention comprise polyamine backbones wherein less than about 50% of the R groups comprise "oxy" R units, preferably less than about 20% , more preferably less than 5%, most preferably the R units comprise no "oxy" R units.

The most preferred polyamine cationic polymers which comprise no "oxy" R units comprise polyamine backbones wherein less than 50% of the R groups comprise more than 3 carbon atoms. For example, ethylene, 1,2-propylene, and 1,3-propylene comprise 3 or less carbon atoms and are the preferred "hydrocarbyl" R units. That is when backbone R units are $C_2$–$C_{12}$ alkylene, preferred is $C_2$–$C_3$ alkylene, most preferred is ethylene.

The polyamine cationic polymers of the present invention comprise modified homogeneous and non-homogeneous polyamine backbones, wherein 100% or less of the —NH units are modified. For the purpose of the present invention the term "homogeneous polyamine backbone" is defined as a polyamine backbone having R units that are the same (i.e., all ethylene). However, this sameness definition does not exclude polyamines that comprise other extraneous units comprising the polymer backbone which are present due to an artifact of the chosen method of chemical synthesis. For example, it is known to those skilled in the art that ethanolamine may be used as an "initiator" in the synthesis of polyethyleneimines, therefore a sample of polyethyleneimine that comprises one hydroxyethyl moiety resulting from the polymerization "initiator" would be considered to comprise a homogeneous polyamine backbone for the purposes of the present invention. A polyamine backbone comprising all ethylene R units wherein no branching Y units are present is a homogeneous backbone. A polyamine backbone comprising all ethylene R units is a homogeneous backbone regardless of the degree of branching or the number of cyclic branches present.

For the purposes of the present invention the term "non-homogeneous polymer backbone" refers to polyamine backbones that are a composite of various R unit lengths and R unit types. For example, a non-homogeneous backbone comprises R units that are a mixture of ethylene and 1,2-propylene units. For the purposes of the present invention a mixture of "hydrocarbyl" and "oxy" R units is not necessary to provide a non-homogeneous backbone. The proper manipulation of these "R unit chain lengths," provides the formulator with the ability to modify the solubility and fabric substantivity of the polyamine cationic polymers of the present invention.

One type of preferred polyamine cationic polymers of the present invention comprise homogeneous polyamine backbones that are totally or partially substituted by polyethyleneoxy moieties, totally or partially quaternized amines, nitrogens totally or partially oxidized to N-oxides, and mixtures thereof. However, not all backbone amine nitrogens must be modified in the same manner, the choice of modification being left to the specific needs of the formulator. The degree of ethoxylation is also determined by the specific requirements of the formulator.

The preferred polyamines that comprise the backbone of the compounds of the present invention are generally polyalkyleneamines (PAA's), polyalkyleneimines (PAI's), preferably polyethyleneamine (PEA's), polyethyleneimines (PEI's), or PEA's or PEI's connected by moieties having longer R units than the parent PAA's, PAI's, PEA's or PEI's. A common polyalkyleneamine (PAA) is tetrabutylenepentamine. PEA's are obtained by reactions involving ammonia and ethylene dichloride, followed by fractional distillation. The common PEA's obtained are triethylenetetramine (TETA) and teraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372, Dickinson, issued May 14, 1957, which describes the preparation of PEA's.

Preferred amine polymer backbones comprise R units that are $C_2$ alkylene (ethylene) units, also known as polyethylenimines (PEI's). Preferred PEI's have at least moderate branching, that is the ratio of m to n is less than 4:1, however PEI's having a ratio of m to n of about 2:1 are most preferred. Preferred backbones, prior to modification have the general formula:

$$[H_2NCH_2CH_2]_n—[N(H)CH_2CH_2]_m—N(-)CH_2CH_2]_nNH_2$$

wherein (–), m, and n are the same as defined herein above. Preferred PEI's, prior to modification, will have a molecular weight greater than about 200 daltons.

The relative proportions of primary, secondary and tertiary amine units in the polyamine backbone, especially in the case of PEI's, will vary, depending on the manner of preparation. Each hydrogen atom attached to each nitrogen atom of the polyamine backbone chain represents a potential site for subsequent substitution, quaternization or oxidation.

These polyamines can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

Examples of modified polyamine cationic polymers of the present invention comprising PEI's, are illustrated in Formulas I–II:

Formula I depicts a polyamine cationic polymer comprising a PEI backbone wherein all substitutable nitrogens are modified by replacement of hydrogen with a polyoxyalkyleneoxy unit, $—(CH_2CH_2O)_7H$, having the formula Formula I
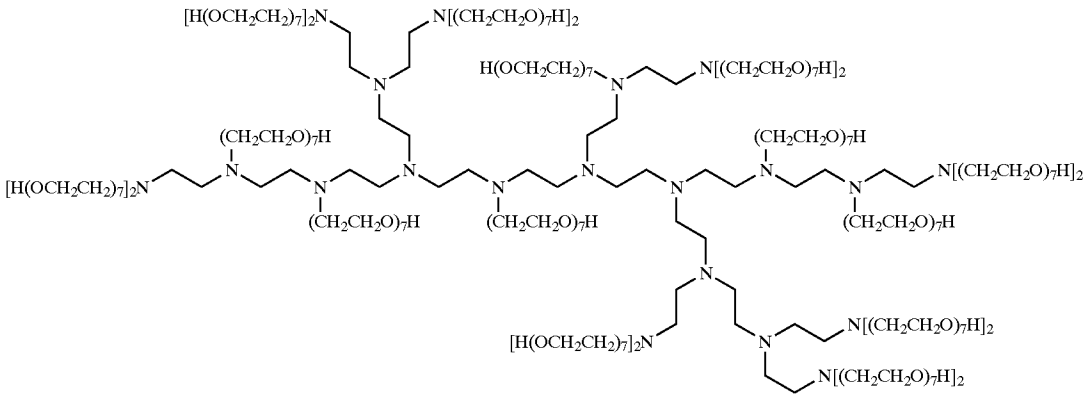

This is an example of a polyamine cationic polymer that is fully modified by one type of moiety.

Formula II depicts a polyamine cationic polymer comprising a PEI backbone wherein all substitutable primary amine nitrogens are modified by replacement of hydrogen with a polyoxyalkyleneoxy unit, —$(CH_2CH_2O)_7H$, the molecule is then modified by subsequent oxidation of all oxidizable primary and secondary nitrogens to N-oxides, said polyamine cationic polymer having the formula Formula II
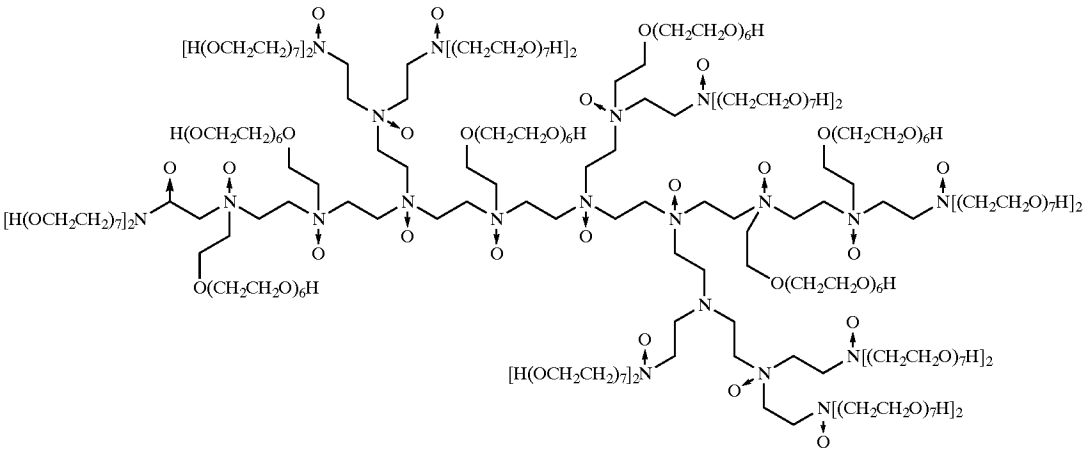

Another related polyamine cationic polymer comprises a PEI backbone wherein all backbone hydrogen atoms are substituted and some backbone amine units are quaternized. The substituents are polyoxyalkyleneoxy units, —$(CH_2CH_2O)_7H$, or methyl groups. Yet another related polyamine cationic polymer comprises a PEI backbone wherein the backbone nitrogens are modified by substitution (i.e. by —$(CH_2CH_2O)_7H$ or methyl), quaternized, oxidized to N-oxides or combinations thereof.

These polyamine cationic polymers, in addition to providing improved softening, can operate as cotton soil release agents, when used in an effective amount, e.g., from about 0.001% to about 10%, preferably from about 0.01% to about 5%, and more preferably from about 0. 1% to about 1%.

Preferred cationic polymeric materials, as discussed hereinbefore, are the cationic polysaccharides, especially cationic galactomannam gums (such as guar gum) and cationic derivatives. These materials are commercially available and relatively inexpensive. They have good compatibility with cationic surfactants and allow stable, highly effective softening compositions according to the invention to be prepared. Such polymeric materials are preferably used at a level of from 0.03% to 0.5% of the composition.

Of course, mixtures of any of the above described cationic polymers can be employed, and the selection of individual polymers or of particular mixtures can be used to control the physical properties of the compositions such as their viscosity and the stability of the aqueous dispersions.

These cationic polymers are usually effective at levels of from about 0.001% to about 10% by weight of the compositions depending upon the benefit sought. The molecular weights are in the range of from about 500 to about 1,000,000, preferably from about 1,000 to about 500,000, more preferably from about 1,000 to about 250,000.

In order to be effective, the cationic polymers herein should be, at least to the level disclosed herein, in the continuous aqueous phase. In order to ensure that the polymers are in the continuous aqueous phase, they are preferably added at the very end of the process for making the compositions. In one aspect of the invention, the fabric softener actives are present in the form of vesicles. After the vesicles have formed, and while the temperature is less than about 85° F., the polymers are added.

(2) Single Long Chain Cationic Compounds

Single long chain cationic compounds include mono-alkyl cationic quaternary ammonium compound, typically present at a level of from about 2% to about 25%, preferably from about 3% to about 17%, more preferably from about 4% to about 15%, and even more preferably from 5% to about 13% by weight of the composition, the total mono-alkyl cationic quaternary ammonium compound being at least at an effective level.

(a) Such mono-alkyl cationic quaternary ammonium compounds useful in the present invention are, preferably, quaternary ammonium salts of the general formula:

$$[R^4N^+(R^5)_3]\ A^-$$

wherein $R^4$ is $C_8$–$C_{22}$ alkyl or alkenyl group, preferably $C_{10}$–$C_{18}$ alkyl or alkenyl group; more preferably $C_{10}$–$C_{14}$ or $C_{16}$–$C_{18}$ alkyl or alkenyl group; each $R^5$ is a $C_1$–$C_6$ alkyl or substituted alkyl group (e.g., hydroxy alkyl), preferably $C_1$–$C_3$ alkyl group, e.g., methyl (most preferred), ethyl, propyl, and the like, a benzyl group, hydrogen, a polyethoxylated chain with from about 2 to about 20 oxyethylene units, preferably from about 2.5 to about 13 oxyethylene units, more preferably from about 3 to about 10 oxyethylene units, and mixtures thereof, and $A^-$ is as defined hereinbefore.

Especially preferred dispersibility aids are monolauryl trimethyl ammonium chloride and monotallow trimethyl ammonium chloride available from Witco under the trade name Varisoft® 471 and monooleyl trimethyl ammonium chloride available from Witco under the tradename Varisoft® 417.

The $R^4$ group can also be attached to the cationic nitrogen atom through a group containing one, or more, ester, amide, ether, amine, etc., linking groups which can be desirable for increased concentratability of component (1), etc. Such linking groups are preferably within from about one to about three carbon atoms of the nitrogen atom.

(b) Mono-long chain alkyl cationic quaternary ammonium compounds also include $C_8$–$C_{22}$ alkyl choline esters. The preferred compounds of this type have the formula:

$$R^1C(O)—O—CH_2CH_2N^+(R)_3\ A^-$$

wherein $R^1$, R and $A^-$ are as defined previously.

Highly preferred single long chain cationics include $C_{12}$–$C_{14}$ coco choline ester and $C_{16}$–$C_{18}$ tallow choline ester.

Suitable biodegradable single-long-chain cationic quaternary ammonium compounds containing an ester linkage in the long chains are described in U.S. Pat. No. 4,840,738, Hardy and Walley, issued Jun. 20, 1989, said patent being incorporated herein by reference.

(c) Ethoxylated quaternary ammonium compounds which can serve as the single-long-chain cationic quaternary ammonium compound include ethylbis(polyethoxy ethanol)alkylammonium ethyl-sulfate with 17 moles of ethylene oxide, available under the trade name Variquat® 66 from Sherex Chemical Company; polyethylene glycol (15) oleammonium chloride, available under the trade name Ethoquad® 0/25 from Akzo; and polyethylene glycol (15) cocomonium chloride, available under the trade name Ethoquad® C/25 from Akzo.

(d) Suitable mono-long chain materials correspond to the quaternized softener actives disclosed above, where only one long chain group is present in the molecule.

(e) substituted imidazolinium salts having the formula:

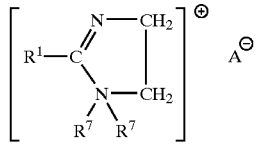

wherein $R^7$ is a $C_1$–$C_4$ saturated alkyl or hydroxyalkyl group, and $R^1$ and $A^-$ are defined as hereinabove;

(f) alkylpyridinium salts having the formula:

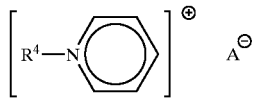

wherein $R^4$ is an acyclic aliphatic $C_8$–$C_{22}$ hydrocarbon group and $A^-$ is an anion; and (g) alkanamide alkylene pyridinium salts having the formula:

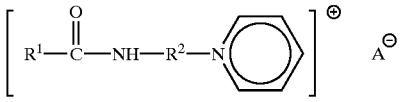

wherein $R^1$, $R^2$ and $A^-$ are defined as herein above; and mixtures thereof.

Examples of Compound (a) are the monoalkenyltrimethylammonium salts such as monooleyltrimethylammonium chloride, monocanolatrimethylammonium chloride, and soyatrimethylammonium chloride. Monooleyltrimethylammonium chloride and monocanolatrimethylammonium chloride are preferred. Other examples of Compound (a) are soyatrimethylammonium chloride available from Witco Corporation under the trade name Adogen® 415, erucyltrimethylammonium chloride wherein $R^1$ is a $C_{22}$ hydrocarbon group derived from a natural source; soyamethylethylammonium ethylsulfate wherein $R^1$ is a $C_{16}$–$C_{18}$ hydrocarbon group, $R^5$ is a methyl group, $R^6$ is an ethyl group, and $A^-$ is an ethylsulfate anion; and methyl bis(2-hydroxyethyl)oleylammonium chloride wherein $R^1$ is a $C_{18}$ hydrocarbon group, $R^5$ is a 2-hydroxyethyl group and $R^6$ is a methyl group.

An example of Compound (b) is 1-ethyl-1-(2-hydroxyethyl)-2-isoheptadecylimidazolinium ethylsulfate wherein $R^1$ is a $C_{17}$ hydrocarbon group, $R^2$ is an ethylene group, $R^5$ is an ethyl group, and $A^-$ is an ethylsulfate anion.

Also, these quaternary compounds having only a single long alkyl chain, can protect the softener from interacting with anionic surfactants and/or detergent builders that are carried over into the rinse from the wash solution. It is highly desirable to have sufficient single long chain quaternary compound, or cationic polymer to tie up the anionic surfactant. This provides improved wrinkle control. The ratio of fabric softener active to single long chain compound is typically from about 100:1 to about 2:1, preferably from about 50:1 to about 5:1, more preferably from about 13:1 to about 8:1. Under high detergent carry-over conditions, the ratio is preferably from about 5:1 to about 7:1. Typically the single long chain compound is present at a level of about 10 ppm to about 25 ppm in the rinse. These compounds are especially useful in dispersion compositions.

(3) Acids and Especially Carboxylic Acid to Lower the Rinse pH by at Least About 0.5 pH Unit.

Acid is used to provide positive charges to the amine softener active, in order to improve both product phase stability and softness performance. Any acid that contains a softener compatible anion $A^-$ can be used to lower the pH of the composition and/or of the rinse water. However, mineral acids are preferably used only to neutralize the amines present and to adjust the pH of the composition to the range of from about 2 to about 8, preferably from about 2.5 to about 5.0. The majority of the acid buffering capacity is desirably provided by carboxylic acids to maximize safety. Thus, strong acids such as hydrochloric acid and hydrobromic acid can preferably be used in about equimolar amounts to neutralize the amine softener active. Most strong acids are mineral acids. Weaker organic acids, or mixtures of strong and weak acids, can also be used for the neutralization step.

Strong acids can also be used in excess in the composition of the present invention to lower the pH of the rinse water if the composition contains only nonhydrolyzable amine actives such as di(long chain alkyl)methylamine (of general formula $R_2NCH_3$). When used in a composition that contains the more easily hydrolyzable amine actives, such as di(long chain alkoyloxyethyl)methylamine (of general formula $(RCOOCH_2CH_2)_2NCH_3$), it is preferably that a strong acid is used at about an equivalent amount or only slightly in excess, enough to neutralize the amine softener active. Additional acid used in the latter composition to lower the rinse water pH is preferably selected from the weaker organic carboxylic acids.

In general, the carboxylic materials are useful with both dispersion and clear compositions, but are especially useful with clear compositions. The mode of action is independent of the composition type. Whatever amine groups are in contact with the rinse water will be affected by the pH of the water. Depending on the laundry conditions, e.g., the type of washing process (machine or hand wash), the type of detergent, the amounts of wash and rinse water, the numbers of wash and/or rinse cycles, the pH of the final rinse water can vary widely. An amount of acid, in addition to the amount needed to neutralize the amine softener active, is used to lower the rinse water by at least about 0.5 pH unit, more preferably by at least about 1 pH unit, and preferably sufficiently to give the final rinse water a pH of from about 6.5 to about 7.5.. However, excess acid is not desirable, especially an amount that lowers the rinse water pH to about 5.5 or lower. The total amount of acid required is typically from about 0.5% to about 40%, preferably from about 1% to about 30%, and more preferably from about 3% to about 20% by weight of the softener composition.

The carboxylic acid works in the rinse by lowering the pH of the rinse solution, thus increasing the level of cationic species for the amine softener active by promoting protonation of the active. The large amount of acid required to provide even a one unit drop in the pH makes it highly desirable to use low equivalent weight carboxylic acids, e.g., those having an equivalent weight of from about 45 to about 200, preferably from about 50 to about 135, more preferably from about 60 to about 100, and especially those that are not highly acidic, like alpha-chloroacetic acid, to minimize the acidity in the composition. This is especially true for those compositions containing actives with ester linkages, since pHs below about 2 tend to cause significant hydrolysis.

Suitable carboxylic acids, and in particular the low molecular weight ($C_1$–$C_6$) carboxylic acids are described in European Patent Application No. 404,471, Machin et al., published on Dec. 27, 1990, supra,. which is herein incorporated by reference. Preferably the organic acid is selected from the group consisting of formic acid (not preferred), acetic acid, glycolic acid (hydroxyacetic acid), propionic acid, adipic acid, benzoic acid, 4-hydroxy benzoic acid, phenylacetic acid, citric acid, salicylic acid, tartaric acid, succinic acid, fumaric acid, maleic acid, oxalic acid, oxalacetic acid, tricarballylic acid (1,2,3-propanetricarboxylic acid), 1,2,3,4-butanetetracarboxylic acid, dihydrofumaric acid, ethylenediaminetetraacetic acid, nitrilotriacetic acid, diethylenetriaminepentaacetic acid, and mixtures thereof. Low equivalent weight carboxylic acids, and especially those that are not substituted, like alpha-chloroacetic acid, are preferred.

It is a special advantage of the acids that the addition of relatively large amounts of acid improves the antistatic benefits conferred by using the compositions herein.

(4) Mixtures of the Above

Mixtures of the above materials can be used to increase the cationic charge density and improve performance.

C. Optional Quaternary Softener Active

The compositions herein can also contain from about 2% to about 80%, preferably from about 13% to about 75%, more preferably from about 17% to about 70%, and even more preferably from about 19% to about 65%, by weight of the composition, of quaternary ammonium cationic fabric softener active which is selected from:

(1) Di-ester and/or di-amide linked fabric softener compounds (DEQA) of the formula:

$$[(R)_{4-m}—N^+—[(CH_2)_n—Y—R^1]_m\ R^1_p\ ]\ A^-$$

wherein: each R and $A^-$ are as defined hereinbefore; each m and p is 0, 1, 2, or 3, the total of m and p being 2 or 3; each n is from 1 to about 4, preferably 2; each Y is —O—(O)C—, —(R)N—(O)C—, —C(O)—N(R)—, or —C(O)—O—, preferably —O(O)C—, but not —OC(O)O—; the sum of carbons in each $R^1$, plus one when Y is —O—(O)C— or —(R)N— (O)C—, is $C_6$–$C_{22}$, preferably $C_{14}$–$C_{20}$, but no more than one $YR^1$ sum being less than about 12 and then the other $YR^1$ sum is at least about 16, with each $R^1$ being a long chain $C_8$–$C_{22}$ (or $C_7$–$C_{21}$)hydrocarbyl, or substituted hydrocarbyl substituent, preferably $C_{10}$–$C_{20}$ (or $C_9$–$C_{19}$) alkyl or alkenyl, most preferably $C_{12}$–$C_{18}$ (or $C_{11}$–$C_{17}$) alkyl or alkenyl, and where, when said sum of carbons is $C_{16}$–$C_{18}$ and $R^1$ is a straight chain alkyl or alkenyl group, the Iodine Value (hereinafter referred to as IV) of the parent fatty acid of this $R^1$ group is preferably from about 20 to about 140, more preferably from about 50 to about 130; and most preferably from about 70 to about 115;

(2) softener having the formula:

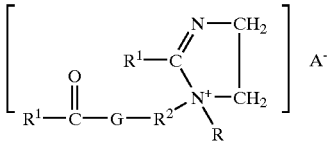

wherein each R, $R^1$, and $A^-$ have the definitions given above; each $R^2$ is a $C_{1-6}$ alkylene group, preferably an ethylene group; and G is an oxygen atom or an —NR— group;

(3) softener having the formula:

$$[R^1—(O)—NR—R^2—N(R)_2—R^3—NR(O)—R^1]^+\ A^-$$

wherein R, $R^1$, $R^2$, $R^3$ and $A^-$ are defined as above;

(4) softener having the formula:

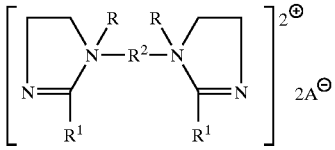

wherein R, $R^1$, $R^2$, and $A^-$ are defined as above; and (5) mixtures thereof;

As before, the counterion, $A^-$ above, can be any softener-compatible anion, preferably the anion of a strong acid, for example, chloride, bromide, methylsulfate, ethylsulfate, sulfate, nitrate and the like, more preferably chloride. The anion can also, but less preferably, carry a double charge in which case $A^-$ represents half a group.

D. Optional Principal Solvent System

The compositions of the present invention comprise less than about 40%, preferably from about 10% to about 35%, more preferably from about 12% to about 25%, and even more preferably from about 14% to about 20%, of the principal solvent, by weight of the composition. Said principal solvent is selected to minimize solvent odor impact in the composition and to provide a low viscosity to the final composition. For example, isopropyl alcohol is not very effective and has a strong odor. n-Propyl alcohol is more effective, but also has a distinct odor. Several butyl alcohols also have odors but can be used for effective clarity/stability, especially when used as part of a principal solvent system to minimize their odor. The alcohols are also selected for optimum low temperature stability, that is they are able to form compositions that are liquid with acceptable low viscosities and translucent, preferably clear, down to about 40° F. (about 4.4° C.) and are able to recover after storage down to about 20° F. (about 6.7° C.).

The suitability of any principal solvent for the formulation of the liquid, concentrated, preferably clear, fabric softener compositions herein with the requisite stability is surprisingly selective. Suitable solvents can be selected based upon their octanol/water partition coefficient (P). Octanol/water partition coefficient of a principal solvent is the ratio between its equilibrium concentration in octanol and in water. The partition coefficients of the principal solvent ingredients of this invention are conveniently given in the form of their logarithm to the base 10, logP.

The logP of many ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. The ClogP values, which are the most reliable and widely used estimates for this physicochemical property, are preferably used instead of the experimental logP values in the selection of the principal solvent ingredients which are useful in the present invention. Other methods that can be used to compute ClogP include, e.g., Crippen's fragmentation method as disclosed in J. Chem. Inf. Comput. Sci., 27, 21 (1987); Viswanadhan's fragmentation method as disclose in J. Chem. Inf Comput. Sci., 29, 163 (1989); and Broto's method as disclosed in Eur. J. Med. Chem.—Chim. Theor., 19, 71 (1984).

The principal solvents herein are selected from those having a ClogP of from about 0.15 to about 0.64, preferably from about 0.25 to about 0.62, and more preferably from about 0.40 to about 0.60, said principal solvent preferably being asymmetric, and preferably having a melting, or solidification, point that allows it to be liquid at, or near room temperature. Solvents that have a low molecular weight and are biodegradable are also desirable for some purposes. The more asymmetric solvents appear to be very desirable, whereas the highly symmetrical solvents, having a center of symmetry, such as 1,7-heptanediol, or 1,4-bis (hydroxymethyl)cyclohexane, appear to be unable to provide the essentially clear compositions when used alone, even though their ClogP values fall in the preferred range. One can select the most suitable principal solvent by determining whether a composition containing about 27% di(oleyoyloxyethyl)dimethylammonium chloride, about 16–20% of principal solvent, and about 4–6% ethanol remains clear during storage at about 40° F. (about 4.4° C.) and recovers from being frozen at about 0° F. (about −18° C.).

The most preferred principal solvents can be identified by the appearance of the freeze-dried dilute treatment compositions used to treat fabrics. These dilute compositions appear to have dispersions of fabric softener that exhibit a more uni-lamellar appearance than conventional fabric softener compositions. The closer to uni-lamellar the appearance, the better the compositions seem to perform. These compositions provide surprisingly good fabric softening as compared to similar compositions prepared in the conventional way with the same fabric softener active. The compositions also inherently provide improved perfume deposition as compared to conventional fabric softening compositions, especially when the perfume is added to the compositions at, or near, room temperature.

Operable principal solvents are listed below under various listings, e.g., aliphatic and/or alicyclic diols with a given number of carbon atoms; monols; derivatives of glycerine; alkoxylates of diols; and mixtures of all of the above. The preferred principal solvents are in italics and the most preferred principal solvents are in bold type. The reference numbers are the Chemical Abstracts Service Registry numbers (CAS No.) for those compounds that have such a number. Novel compounds have a method identified, described hereinafter, that can be used to prepare the compounds. Some inoperable principal solvents are also listed below for comparison purposes. The inoperable principal solvents, however, can be used in mixtures with operable principal solvents. Operable principal solvents can be used to make concentrated fabric softener compositions that meet the stability/clarity requirements set forth herein.

Many diol principal solvents that have the same chemical formula can exist as many stereoisomers and/or optical isomers. Each isomer is normally assigned with a different CAS No. For examples, different isomers of 4-methyl-2,3-hexanediol are assigned to at least the following CAS Nos: 146452-51-9; 146452-50-8; 146452-49-5; 146452-48-4; 123807-34-1; 123807-33-0; 123807-32-9; and 123807-31-8.

In the following listings, for simplicity, each chemical formula is listed with only one CAS No. This disclosure is only for exemplification and is sufficient to allow the practice of the invention. The disclosure is not limiting. Therefore, it is understood that other isomers with other CAS Nos, and their mixtures, are also included. By the same token, when a CAS No. represents a molecule which contains some particular isotopes, e.g., deuterium, tritium, carbon-13, etc., it is understood that materials which contain naturally distributed isotopes are also included, and vice versa. The methods disclosed for making the solvents are described fully in the copending application, U.S. Ser. No. 08/679,694, filed Jul. 11, 1996 in the names of E. H. Wahl, T. Trinh, E. P. Gosselink, J. C. Letton, and M. R. Sivik, for Fabric Softening Compound/Composition, said application being incorporated herein by reference.

TABLE I

| MONO-OLS | CAS No. |
|---|---|
| n-propanol | 71-23-8 |
| 2-butanol | 15892-23-6 |
| 2-methyl-2-propanol | 75-65-0 |

TABLE II

| C6 DIOLS | |
|---|---|
| Operable Isomers | CAS No. |
| 2,3-butanediol, 2,3-dimethyl- | 76-09-5 |
| 1,2-butanediol, 2,3-dimethyl- | 66553-15-9 |
| 1,2-butanediol, 3,3-dimethyl- | 59562-82-2 |
| 2,3-pentanediol, 2-methyl- | 7795-80-4 |
| 2,3-pentanediol, 3-methyl- | 63521-37-9 |
| 2,3-pentanediol, 4-methyl- | 7795-79-1 |
| 2,3-hexanediol | 617-30-1 |
| 3,4-hexanediol | 922-17-8 |
| 1,2-butanediol, 2-ethyl- | 66553-16-0 |
| 1,2-pentanediol, 2-methyl- | 20667-05-4 |
| 1,2-pentanediol, 3-methyl- | 159623-53-7 |
| 1,2-pentanediol, 4-methyl- | 72110-08-8 |
| 1,2-hexanediol | 6920-22-5 |

TABLE III

| C7 DIOLS | CAS No. |
|---|---|
| Operable Isomers | |
| 1,3-propanediol, 2-butyl- | 2612-26-2 |
| 1,3-propanediol, 2,2-diethyl- | 115-76-4 |
| 1,3-propanediol, 2-(1-methylpropyl)- | 33673-01-7 |
| 1,3-propanediol, 2-(2-methylpropyl)- | 26462-20-8 |
| 1,3-propanediol, 2-methyl-2-propyl- | 78-26-2 |
| 1,2-butanediol, 2,3,3-trimethyl- | Method B |
| 1,4-butanediol, 2-ethyl-2-methyl- | 76651-98-4 |
| 1,4-butanediol, 2-ethyl-3-methyl- | 66225-34-1 |
| 1,4-butanediol, 2-propyl- | 62946-68-3 |
| 1,4-butanediol, 2-isopropyl- | 39497-66-0 |
| 1,5-pentanediol, 2,2-dimethyl- | 3121-82-2 |
| 1,5-pentanediol, 2,3-dimethyl- | 81554-20-3 |
| 1,5-pentanediol, 2,4-dimethyl- | 2121-69-9 |
| 1,5-pentanediol, 3,3-dimethyl- | 53120-74-4 |
| 2,3-pentanediol, 2,3-dimethyl- | 6931-70-0 |
| 2,3-pentanediol, 2,4-dimethyl- | 66225-53-4 |
| 2,3-pentanediol, 3,4-dimethyl- | 37164-04-8 |
| 2,3-pentanediol, 4,4-dimethyl- | 89851-45-6 |
| 3,4-pentanediol, 2,3-dimethyl- | Method B |
| 1,5-pentanediol, 2-ethyl- | 14189-13-0 |
| 1,6-hexanediol, 2-methyl- | 25258-92-8 |
| 1,6-hexanediol, 3-methyl- | 4089-71-8 |
| 2,3-hexanediol, 2-methyl- | 59215-55-3 |
| 2,3-hexanediol, 3-methyl- | 139093-40-6 |
| 2,3-hexanediol, 4-methyl- | *** |
| 2,3-hexanediol, 5-methyl- | Method B |
| 3,4-hexanediol, 2-methyl- | Method B |
| 3,4-hexanediol, 3-methyl- | 18938-47-1 |
| 1,3-heptanediol | 23433-04-7 |
| 1,4-heptanediol | 40646-07-9 |
| 1,5-heptanediol | 60096-09-5 |
| 1,6-heptanediol | 13175-27-4 |
| Preferred Isomers | |
| 1,3-propanediol, 2-butyl- | 2612-26-2 |
| 1,4-butanediol, 2-propyl- | 62946-68-3 |
| 1,5-pentanediol, 2-ethyl- | 14189-13-0 |
| 2,3-pentanediol, 2,3-dimethyl- | 6931-70-0 |

TABLE III-continued

| C7 DIOLS | CAS No. |
|---|---|
| 2,3-pentanediol, 2,4-dimethyl- | 66225-53-4 |
| 2,3-pentanediol, 3,4-dimethyl- | 37164-04-8 |
| 2,3-pentanediol, 4,4-dimethyl- | 89851-45-6 |
| 3,4-pentanediol, 2,3-dimethyl- | Method B |
| 1,6-hexanediol, 2-methyl- | 25258-92-8 |
| 1,6-hexanediol, 3-methyl- | 4089-71-8 |
| 1,3-heptanediol | 23433-04-7 |
| 1,4-heptanediol | 40646-07-9 |
| 1,5-heptanediol | 60096-09-5 |
| 1,6-heptanediol | 13175-27-4 |
| More Preferred Isomers | |
| 2,3-pentanediol, 2,3-dimethyl- | 6931-70-0 |
| 2,3-pentanediol, 2,4-dimethyl- | 66225-53-4 |
| 2,3-pentanediol, 3,4-dimethyl- | 37164-04-8 |
| 2,3-pentanediol, 4,4-dimethyl- | 89851-45-6 |
| 3,4-pentanediol, 2,3-dimethyl- | Method B |
| and mixtures thereof. | |

TABLE IV

| OCTANEDIOL ISOMERS | |
|---|---|
| Chemical Name | CAS No. |
| PROPANEDIOL DERIVATIVES | |
| Operable Isomers | |
| 1,3-propanediol, 2-(2-methylbutyl)- | 87194-40-9 |
| 1,3-propanediol, 2-(1,1-dimethylpropyl)- | Method D |
| 1,3-propanediol, 2-(1,2-dimethylpropyl)- | Method D |
| 1,3-propanediol, 2-(1-ethylpropyl)- | 25462-28-6 |
| 1,3-propanediol, 2-(1-methylbutyl)- | 22131-29-9 |
| 1,3-propanediol, 2-(2,2-dimethylpropyl)- | Method D |
| 1,3-propanediol, 2-(3-methylbutyl)- | 25462-27-5 |
| 1,3-propanediol, 2-butyl-2-methyl- | 3121-83-3 |
| 1,3-propanediol, 2-ethyl-2-isopropyl- | 24765-55-7 |
| 1,3-propanediol, 2-ethyl-2-propyl- | 25450-88-8 |
| 1,3-propanediol, 2-methyl-2-(1-methylpropyl)- | 813-60-5 |
| 1,3-propanediol, 2-methyl-2-(2-methylpropyl)- | 25462-42-4 |
| 1,3-propanediol, 2-tertiary-butyl-2-methyl- | 25462-45-7 |
| More Preferred Isomers | |
| 1,3-propanediol, 2-(1,1-dimethylpropyl)- | Method D |
| 1,3-propanediol, 2-(1,2-dimethylpropyl)- | Method D |
| 1,3-propanediol, 2-(1-ethylpropyl)- | 25462-28-6 |
| 1,3-propanediol, 2-(2,2-dimethylpropyl)- | Method D |
| 1,3-propanediol, 2-ethyl-2-isopropyl- | 24765-55-7 |
| 1,3-propanediol, 2-methyl-2-(1-methylpropyl)- | 813-60-5 |
| 1,3-propanediol, 2-methyl-2-(2-methylpropyl)- | 25462-42-4 |
| 1,3-propanediol, 2-tertiary-butyl-2-methyl- | 25462-45-7 |
| BUTANEDIOL DERIVATIVES | |
| Operable Isomers | |
| 1,3-butanediol, 2,2-diethyl- | 99799-77-6 |
| 1,3-butanediol, 2-(1-methylpropyl)- | Method C |
| 1,3-butanediol, 2-butyl- | 83988-22-1 |
| 1,3-butanediol, 2-ethyl-2,3-dimethyl- | Method D |
| 1,3-butanediol, 2-(1,1-dimethylethyl)- | 67271-58-3 |
| 1,3-butanediol, 2-(2-methylpropyl)- | Method C |
| 1,3-butanediol, 2-methyl-2-isopropyl- | Method C |
| 1,3-butanediol, 2-methyl-2-propyl- | 99799-79-8 |
| 1,3-butanediol, 3-methyl-2-isopropyl- | Method C |
| 1,3-butanediol, 3-methyl-2-propyl- | Method D |
| 1,4-butanediol, 2,2-diethyl- | Method H |
| 1,4-butanediol, 2-methyl-2-propyl- | Method H |
| 1,4-butanediol, 2-(1-methylpropyl)- | Method H |
| 1,4-butanediol, 2-ethyl-2,3-dimethyl- | Method F |
| 1,4-butanediol, 2-ethyl-3,3-dimethyl- | Method F |
| 1,4-butanediol, 2-(1,1-dimethylethyl)- | 36976-70-2 |

TABLE IV-continued

| OCTANEDIOL ISOMERS | |
|---|---|
| Chemical Name | CAS No. |
| 1,4-butanediol, 2-(2-methylpropyl)- | Method F |
| 1,4-butanediol, 2-methyl-3-propyl- | 90951-76-1 |
| 1,4-butanediol, 3-methyl-2-isopropyl- | 99799-24-3 |
| Preferred Isomers | |
| 1,3-butanediol, 2,2-diethyl- | 99799-77-6 |
| 1,3-butanediol, 2-(1-methylpropyl)- | Method C |
| 1,3-butanediol, 2-butyl- | 83988-22-1 |
| 1,3-butanediol, 2-ethyl-2,3-dimethyl- | Method D |
| 1,3-butanediol, 2-(1,1-dimethylethyl)- | 67271-58-3 |
| 1,3-butanediol, 2-(2-methylpropyl)- | Method C |
| 1,3-butanediol, 2-methyl-2-isopropyl- | Method C |
| 1,3-butanediol, 2-methyl-2-propyl- | 99799-79-8 |
| 1,3-butanediol, 3-methyl-2-propyl- | Method D |
| 1,4-butanediol, 2,2-diethyl- | Method H |
| 1,4-butanediol, 2-ethyl-2,3-dimethyl- | Method F |
| 1,4-butanediol, 2-ethyl-3,3-dimethyl- | Method F |
| 1,4-butanediol, 2-(1,1-dimethylethyl)- | 36976-70-2 |
| 1,4-butanediol, 3-methyl-2-isopropyl- | 99799-24-3 |
| More Preferred Isomers | |
| 1,3-butanediol, 2-(1-methylpropyl)- | Method C |
| 1,3-butanediol, 2-(2-methylpropyl)- | Method C |
| 1,3-butanediol, 2-butyl- | 83988-22-1 |
| 1,3-butanediol, 2-methyl-2-propyl- | 99799-79-8 |
| 1,3-butanediol, 3-methyl-2-propyl- | Method D |
| 1,4-butanediol, 2,2-diethyl- | Method H |
| 1,4-butanediol, 2-ethyl-2,3-dimethyl- | Method F |
| 1,4-butanediol, 2-ethyl-3,3-dimethyl- | Method F |
| 1,4-butanediol, 2-(1,1-dimethylethyl)- | 36976-70-2 |
| TRIMETHYLPENTANEDIOL ISOMERS | |
| Operable Isomers | |
| 1,3-pentanediol, 2,2,3-trimethyl- | 35512-54-0 |
| 1,3-pentanediol, 2,2,4-trimethyl- | 144-19-4 |
| 1,3-pentanediol, 2,3,4-trimethyl- | 116614-13-2 |
| 1,3-pentanediol, 2,4,4-trimethyl- | 109387-36-2 |
| 1,3-pentanediol, 3,4,4-trimethyl- | 81756-50-5 |
| 1,4-pentanediol, 2,2,3-trimethyl- | Method H |
| 1,4-pentanediol, 2,2,4-trimethyl- | 80864-10-4 |
| 1,4-pentanediol, 2,3,3-trimethyl- | Method H |
| 1,4-pentanediol, 2,3,4-trimethyl- | 92340-74-4 |
| 1,4-pentanediol, 3,3,4-trimethyl- | 16466-35-6 |
| 1,5-pentanediol, 2,2,3-trimethyl- | Method F |
| 1,5-pentanediol, 2,2,4-trimethyl- | 3465-14-3 |
| 1,5-pentanediol, 2,3,3-trimethyl- | Method A |
| 1,5-pentanediol, 2,3,4-trimethyl- | 85373-83-7 |
| 2,4-pentanediol, 2,3,3-trimethyl- | 24892-51-1 |
| 2,4-pentanediol, 2,3,4-trimethyl- | 24892-52-2 |
| Preferred Isomers | |
| 1,3-pentanediol, 2,2,3-trimethyl- | 35512-54-0 |
| 1,3-pentanediol, 2,2,4-trimethyl- | 144-19-4 |
| 1,3-pentanediol, 2,3,4-trimethyl- | 116614-13-2 |
| 1,3-pentanediol, 2,4,4-trimethyl- | 109387-36-2 |
| 1,3-pentanediol, 3,4,4-trimethyl- | 81756-50-5 |
| 1,4-pentanediol, 2,2,3-trimethyl- | Method H |
| 1,4-pentanediol, 2,2,4-trimethyl- | 80864-10-4 |
| 1,4-pentanediol, 2,3,3-trimethyl- | Method F |
| 1,4-pentanediol, 2,3,4-trimethyl- | 92340-74-4 |
| 1,4-pentanediol, 3,3,4-trimethyl- | 16466-35-6 |
| 1,5-pentanediol, 2, 2,3-trimethyl- | Method A |
| 1,5-pentanediol, 2,2,4-trimethyl- | 3465-14-3 |
| 1,5-pentanediol, 2,3,3-trimethyl- | Method A |
| 2,4-pentanediol, 2,3,4-trimethyl- | 24892-52-2 |
| More Preferred Isomers | |
| 1,3-pentanediol, 2,3,4-trimethyl- | 116614-13-2 |
| 1,4-pentanediol, 2,3,4-trimethyl- | 92340-74-4 |
| 1,5-pentanediol, 2,2,3-trimethyl- | Method A |
| 1,5-pentanediol, 2,2,4-trimethyl- | 3465-14-3 |
| 1,5-pentanediol, 2,3,3-trimethyl- | Method A |

TABLE IV-continued

OCTANEDIOL ISOMERS

| Chemical Name | CAS No. |
|---|---|
| **ETHYLMETHYLPENTANEDIOL ISOMERS** | |
| Operable Isomers | |
| 1,3-pentanediol, 2-ethyl-2-methyl- | Method C |
| 1,3-pentanediol, 2-ethyl-3-methyl- | Method D |
| 1,3-pentanediol, 2-ethyl-4-methyl- | 148904-97-6 |
| 1,3-pentanediol, 3-ethyl-2-methyl- | 55661-05-7 |
| 1,4-pentanediol, 2-ethyl-2-methyl- | Method H |
| 1,4-pentanediol, 2-ethyl-3-methyl- | Method F |
| 1,4-pentanediol, 2-ethyl-4-methyl- | Method C |
| 1,4-pentanediol, 3-ethyl-2-methyl- | Method F |
| 1,4-pentanediol, 3-ethyl-3-methyl- | Method F |
| 1,5-pentanediol, 2-ethyl-2-methyl- | Method F |
| 1,5-pentanediol, 2-ethyl-3-methyl- | 54886-83-8 |
| 1,5-pentanediol, 2-ethyl-4-methyl- | Method F |
| 1,5-pentanediol, 3-ethyl-3-methyl- | 57740-12-2 |
| 2,4-pentanediol, 3-ethyl-2-methyl- | Method G |
| More Preferred Isomers | |
| 1,3-pentanediol, 2-ethyl-2-methyl- | Method C |
| 1,3-pentanediol, 2-ethyl-3-methyl- | Method D |
| 1,3-pentanediol, 2-ethyl-4-methyl- | 148904-97-6 |
| 1,3-pentanediol, 3-ethyl-2-methyl- | 55661-05-7 |
| 1,4-pentanediol, 2-ethyl-2-methyl- | Method H |
| 1,4-pentanediol, 2-ethyl-3-methyl- | Method F |
| 1,4-pentanediol, 2-ethyl-4-methyl- | Method G |
| 1,5-pentanediol, 3-ethyl-3-methyl- | 57740-12-2 |
| 2,4-pentanediol, 3-ethyl-2-methyl- | Method G |
| **PROPYLPENTANEDIOL ISOMERS** | |
| Operable Isomers | |
| 1,3-pentanediol, 2-isopropyl- | Method D |
| 1,3-pentanediol, 2-propyl- | Method C |
| 1,4-pentanediol, 2-isopropyl- | Method H |
| 1,4-pentanediol, 2-propyl- | Method H |
| 1,4-pentanediol, 3-isopropyl- | Method H |
| 1,5-pentanediol, 2-isopropyl- | 90951-89-6 |
| 2,4-pentanediol, 3-propyl- | Method C |
| More Preferred Isomers | |
| 1,3-pentanediol, 2-isopropyl- | Method D |
| 1,3-pentanediol, 2-propyl- | Method C |
| 1,4-pentanediol, 2-isopropyl- | Method H |
| 1,4-pentanediol, 2-propyl- | Method H |
| 1,4-pentanediol, 3-isopropyl- | Method H |
| 2,4-pentanediol, 3-propyl- | Method C |
| **DIMETHYLHEXANEDIOL ISOMERS** | |
| Operable Isomers | |
| 1,3-hexanediol, 2,2-dimethyl- | 22006-96-8 |
| 1,3-hexanediol, 2,3-dimethyl- | Method D |
| 1,3-hexanediol, 2,4-dimethyl- | 78122-99-3 |
| 1,3-hexanediol, 2,5-dimethyl- | Method C |
| 1,3-hexanediol, 3,4-dimethyl- | Method D |
| 1,3-hexanediol, 3,5-dimethyl- | Method D |
| 1,3-hexanediol, 4,4-dimethyl- | Method C |
| 1,3-hexanediol, 4,5-dimethyl- | Method C |
| 1,4-hexanediol, 2,2-dimethyl- | Method F |
| 1,4-hexanediol, 2,3-dimethyl- | Method F |
| 1,4-hexanediol, 2,4-dimethyl- | Method G |
| 1,4-hexanediol, 2,5-dimethyl- | 22417-60-3 |
| 1,4-hexanediol, 3,3-dimethyl- | Method F |
| 1,4-hexanediol, 3,4-dimethyl- | Method E |
| 1,4-hexanediol, 3,5-dimethyl- | Method H |
| 1,4-hexanediol, 4,5-dimethyl- | Method E |
| 1,4-hexanediol, 5,5-dimethyl- | 38624-38-3 |
| 1,5-hexanediol, 2,2-dimethyl- | Method A |
| 1,5-hexanediol, 2,3-dimethyl- | 62718-05-2 |
| 1,5-hexanediol, 2,4-dimethyl- | 73455-82-0 |
| 1,5-hexanediol, 2,5-dimethyl- | 58510-28-4 |
| 1,5-hexanediol, 3,3-dimethyl- | 41736-99-6 |
| 1,5-hexanediol, 3,4-dimethyl- | Method A |

TABLE IV-continued

OCTANEDIOL ISOMERS

| Chemical Name | CAS No. |
|---|---|
| 1,5-hexanediol, 3,5-dimethyl- | Method G |
| 1,5-hexanediol, 4,5-dimethyl- | Method F |
| 1,6-hexanediol, 2,2-dimethyl- | 13622-91-8 |
| 1,6-hexanediol, 2,3-dimethyl- | Method F |
| 1,6-hexanediol, 2,4-dimethyl- | Method F |
| 1,6-hexanediol, 2,5-dimethyl- | 49623-11-2 |
| 1,6-hexanediol, 3,3-dimethyl- | Method F |
| 1,6-hexanediol, 3,4-dimethyl- | 65363-45-3 |
| 2,4-hexanediol, 2,3-dimethyl- | 26344-17-2 |
| 2,4-hexanediol, 2,4-dimethyl- | 29649-22-7 |
| 2,4-hexanediol, 2,5-dimethyl- | 3899-89-6 |
| 2,4-hexanediol, 3,3-dimethyl- | 42412-51-1 |
| 2,4-hexanediol, 3,4-dimethyl- | 90951-83-0 |
| 2,4-hexanediol, 3,5-dimethyl- | 159300-34-2 |
| 2,4-hexanediol, 4,5-dimethyl- | Method D |
| 2,4-hexanediol, 5,5-dimethyl- | 108505-10-8 |
| 2,5-hexanediol, 2,3-dimethyl- | Method G |
| 2,5-hexanediol, 2,4-dimethyl- | Method G |
| 2,5-hexanediol, 2,5-dimethyl- | 110-03-2 |
| 2,5-hexanediol, 3,3-dimethyl- | Method H |
| 2,5-hexanediol, 3,4-dimethyl- | 99799-30-1 |
| 2,6-hexanediol, 3,3-dimethyl- | Method A |
| More Preferred Isomers | |
| 1,3-hexanediol, 2,2-dimethyl- | 22006-96-8 |
| 1,3-hexanediol, 2,3-dimethyl- | Method D |
| 1,3-hexanediol, 2,4-dimethyl- | 78122-99-3 |
| 1,3-hexanediol, 2,5-dimethyl- | Method C |
| 1,3-hexanediol, 3,4-dimethyl- | Method D |
| 1,3-hexanediol, 3,5-dimethyl- | Method D |
| 1,3-hexanediol, 4,4-dimethyl- | Method C |
| 1,3-hexanediol, 4,5-dimethyl- | Method C |
| 1,4-hexanediol, 2,2-dimethyl- | Method H |
| 1,4-hexanediol, 2,3-dimethyl- | Method F |
| 1,4-hexanediol, 2,4-dimethyl- | Method G |
| 1,4-hexanediol, 2,5-dimethyl- | 22417-60-3 |
| 1,4-hexanediol, 3,3-dimethyl- | Method F |
| 1,4-hexanediol, 3,4-dimethyl- | Method E |
| 1,4-hexanediol, 3,5-dimethyl- | Method H |
| 1,4-hexanediol, 4,5-dimethyl- | Method E |
| 1,4-hexanediol, 5,5-dimethyl- | 38624-38-3 |
| 1,5-hexanediol, 2,2-dimethyl- | Method A |
| 1,5-hexanediol, 2,3-dimethyl- | 62718-05-2 |
| 1,5-hexanediol, 2,4-dimethyl- | 73455-82-0 |
| 1,5-hexanediol, 2,5-dimethyl- | 58510-28-4 |
| 1,5-hexanediol, 3,3-dimethyl- | 41736-99-6 |
| 1,5-hexanediol, 3,4-dimethyl- | Method A |
| 1,5-hexanediol, 3,5-dimethyl- | Method G |
| 1,5-hexanediol, 4,5-dimethyl- | Method F |
| 2,6-hexanediol, 3,3-dimethyl- | Method A |
| **ETHYLHEXANEDIOL ISOMERS** | |
| More Preferred Isomers | |
| 1,3-hexanediol, 2-ethyl- | 94-96-2 |
| 1,3-hexanediol, 4-ethyl- | Method C |
| 1,4-hexanediol, 2-ethyl- | 148904-97-6 |
| 1,4-hexanediol, 4-ethyl- | 1113-00-4 |
| 1,5-hexanediol, 2-ethyl- | 58374-34-8 |
| 2,4-hexanediol, 3-ethyl- | Method C |
| 2,4-hexanediol, 4-ethyl- | 33683-47-5 |
| 2,5-hexanediol, 3-ethyl- | Method F |
| **METHYHEPTANEDIOL ISOMERS** | |
| Operable Isomers | |
| 1,3-heptanediol, 2-methyl- | 109417-38-1 |
| 1,3-heptanediol, 3-methyl- | 165326-88-5 |
| 1,3-heptanediol, 4-methyl- | Method C |
| 1,3-heptanediol, 5-methyl- | Method D |
| 1,3-heptanediol, 6-methyl- | Method C |
| 1,4-heptanediol, 2-methyl- | 15966-03-7 |
| 1,4-heptanediol, 3-methyl- | 7748-38-1 |
| 1,4-heptanediol, 4-methyl- | 72473-94-0 |
| 1,4-heptanediol, 5-methyl- | 63003-04-3 |

TABLE IV-continued

| OCTANEDIOL ISOMERS | |
|---|---|
| Chemical Name | CAS No. |
| 1,4-heptanediol, 6-methyl- | 99799-25-4 |
| 1,5-heptanediol, 2-methyl- | 141605-00-7 |
| 1,5-heptanediol, 3-methyl- | Method A |
| 1,5-heptanediol, 4-methyl- | Method A |
| 1,5-heptanediol, 5-methyl- | 99799-26-5 |
| 1,5-heptanediol, 6-methyl- | 57740-00-8 |
| 1,6-heptanediol, 2-methyl- | 132148-22-2 |
| 1,6-heptanediol, 3-methyl- | Method G |
| 1,6-heptanediol, 4-methyl- | 156307-84-5 |
| 1,6-heptanediol, 5-methyl- | Method A |
| 1,6-heptanediol, 6-methyl- | 5392-57-4 |
| 2,4-heptanediol, 2-methyl- | 38836-26-9 |
| 2,4-heptanediol, 3-methyl- | 6964-04-1 |
| 2,4-heptanediol, 4-methyl- | 165326-87-4 |
| 2,4-heptanediol, 5-methyl- | Method C |
| 2,4-heptanediol, 6-methyl- | 79356-95-9 |
| 2,5-heptanediol, 2-methyl- | 141605-02-9 |
| 2,5-heptanediol, 3-methyl- | Method G |
| 2,5-heptanediol, 4-methyl- | 156407-38-4 |
| 2,5-heptanediol, 5-methyl- | 148843-72-5 |
| 2,5-heptanediol, 6-methyl- | 51916-46-2 |
| 2,6-heptanediol, 2-methyl- | 73304-48-0 |
| 2,6-heptanediol, 3-methyl- | 29915-96-6 |
| 2,6-heptanediol, 4-methyl- | 106257-69-6 |
| 3,4-heptanediol, 3-methyl- | 18938-50-6 |
| 3,5-heptanediol, 2-methyl- | Method C |
| 3,5-heptanediol, 3-methyl- | 99799-27-6 |
| 3,5-heptanediol, 4-methyl- | 156407-37-3 |
| More Preferred Isomers | |
| 1,3-heptanediol, 2-methyl- | 109417-38-1 |
| 1,3-heptanediol, 3-methyl- | 165326-88-5 |
| 1,3-heptanediol, 4-methyl- | Method C |
| 1,3-heptanediol, 5-methyl- | Method D |
| 1,3-heptanediol, 6-methyl- | Method C |
| 1,4-heptanediol, 2-methyl- | 15966-03-7 |
| 1,4-heptanediol, 3-methyl- | 7748-38-1 |
| 1,4-heptanediol, 4-methyl- | 72473-94-0 |
| 1,4-heptanediol, 5-methyl- | 63003-04-3 |
| 1,4-heptanediol, 6-methyl- | 99799-25-4 |
| 1,5-heptanediol, 2-methyl- | 141605-00-7 |
| 1,5-heptanediol, 3-methyl- | Method A |
| 1,5-heptanediol, 4-methyl- | Method A |
| 1,5-heptanediol, 5-methyl- | 99799-26-5 |
| 1,5-heptanediol, 6-methyl- | 57740-00-8 |
| 1,6-heptanediol, 2-methyl- | 132148-22-2 |
| 1,6-heptanediol, 3-methyl- | Method G |
| 1,6-heptanediol, 4-methyl- | 156307-84-5 |
| 1,6-heptanediol, 5-methyl- | Method A |
| 1,6-heptanediol, 6-methyl- | 5392-57-4 |
| 2,4-heptanediol, 2-methyl- | 38836-26-9 |
| 2,4-heptanediol, 3-methyl- | 6964-04-1 |
| 2,4-heptanediol, 4-methyl- | 165326-87-4 |
| 2,4-heptanediol, 5-methyl- | Method C |
| 2,4-heptanediol, 6-methyl- | 79356-95-9 |
| 2,5-heptanediol, 2-methyl- | 141605-02-9 |
| 2,5-heptanediol, 3-methyl- | Method H |
| 2,5-heptanediol, 4-methyl- | 156407-38-4 |
| 2,5-heptanediol, 5-methyl- | 148843-72-5 |
| 2,5-heptanediol, 6-methyl- | 51916-46-2 |
| 2,6-heptanediol, 2-methyl- | 73304-48-0 |
| 2,6-heptanediol, 3-methyl- | 29915-96-6 |
| 2,6-heptanediol, 4-methyl- | 106257-69-6 |
| 3,4-heptanediol, 3-methyl- | 18938-50-6 |
| 3,5-heptanediol, 2-methyl- | Method C |
| 3,5-heptanediol, 4-methyl- | 156407-37-3 |
| OCTANEDIOL ISOMERS | |
| More Preferred Isomers | |
| 2,4-octanediol | 90162-24-6 |
| 2,5-octanediol | 4527-78-0 |

TABLE IV-continued

| OCTANEDIOL ISOMERS | |
|---|---|
| Chemical Name | CAS No. |
| 2,6-octanediol | Method A |
| 2,7-octanediol | 19686-96-5 |
| 3,5-octanediol | 24892-55-5 |
| 3,6-octanediol | 24434-09-1 |

TABLE V

| NONANEDIOL ISOMERS | |
|---|---|
| Chemical Name | CAS No. |
| Preferred Isomers | |
| 2,4-pentanediol, 2,3,3,4-tetramethyl- | 19424-43-2 |
| Operable Isomers | |
| 2,4-pentanediol, 3-tertiarybutyl- | 142205-14-9 |
| 2,4-hexanediol, 2,5,5-trimethyl- | 97460-08-7 |
| 2,4-hexanediol, 3,3,4-trimethyl- | Method D |
| 2,4-hexanediol, 3,3,5-trimethyl- | 27122-58-3 |
| 2,4-hexanediol, 3,5,5-trimethyl- | Method D |
| 2,4-hexanediol, 4,5,5-trimethyl- | Method D |
| 2,5-hexanediol, 3,3,4-trimethyl- | Method H |
| 2,5-hexanediol, 3,3,5-trimethyl- | Method G |

TABLE VI

| ALKYL GLYCERYL ETHERS,DI(HYDROXYALKYL) ETHERS, AND ARYL GLYCERYL ETHERS | |
|---|---|
| Preferred Monoglycerol Ethers and Derivatives | |
| 1,2-propanediol, 3-(butyloxy)-, triethoxylated | |
| 1,2-propanediol, 3-(butyloxy)-, tetraethoxylated | |
| | CAS No. |
| More Preferred Monoglycerol Ethers and Derivatives | |
| 1,2-propanediol, 3-(n-pentyloxy)- | 22636-32-4 |
| 1,2-propanediol, 3-(2-pentyloxy)- | |
| 1,2-propanediol, 3-(3-pentyloxy)- | |
| 1,2-propanediol, 3-(2-methyl-1-butyloxy)- | |
| 1,2-propanediol, 3-(iso-amyloxy)- | |
| 1,2-propanediol, 3-(3-methyl-2-butyloxy)- | |
| 1,2-propanediol, 3-(cyclohexyloxy)- | |
| 1,2-propanediol, 3-(1-cyclohex-1-enyloxy)- | |
| 1,3-propanediol, 2-(pentyloxy)- | |
| 1,3-propanediol, 2-(2-pentyloxy)- | |
| 1,3-propanediol, 2-(3-pentyloxy)- | |
| 1,3-propanediol, 2-(2-methyl-1-butyloxy)- | |
| 1,3-propanediol, 2-(iso-amyloxy)- | |
| 1,3-propanediol, 2-(3-methyl-2-butyloxy)- | |
| 1,3-propanediol, 2-(cyclohexyloxy)- | |
| 1,3-propanediol, 2-(1-cyclohex-1-enyloxy)- | |
| 1,2-propanediol, 3-(butyloxy)-, pentaethoxylated | |
| 1,2-propanediol, 3-(butyloxy)-, hexaethoxylated | |
| 1,2-propanediol, 3-(butyloxy)-, heptaethoxylated | |
| 1,2-propanediol, 3-(butyloxy)-, octaethoxylated | |
| 1,2-propanediol, 3-(butyloxy)-, nonaethoxylated | |
| 1,2-propanediol, 3-(butyloxy)-, monopropoxylated | |
| 1,2-propanediol, 3-(butyloxy)-, dibutyleneoxylated | |
| 1,2-propanediol, 3-(butyloxy)-, tributyleneoxylated | |
| More Preferred Di(hydroxyalkyl) Ethers | |
| bis(2-hydroxybutyl) ether | |
| bis(2-hydroxycyclopentyl) ether | |

TABLE VI-continued

| ALKYL GLYCERYL ETHERS,DI(HYDROXYALKYL) ETHERS, AND ARYL GLYCERYL ETHERS |
|---|
| AROMATIC GLYCERYL ETHERS |
| Operable Aromatic Glyceryl Ethers |
| 1,2-propanediol, 3-phenyloxy- |
| 1,2-propanediol, 3-benzyloxy- |
| 1,2-propanediol, 3-(2-phenylethyloxy)- |
| 1,2-propanediol, 3-(1-phenyl-2-propanyloxy)- |
| 1,3-propanediol, 2-phenyloxy- |
| 1,3-propanediol, 2-(m-cresyloxy)- |
| 1,3-propanediol, 2-(p-cresyloxy)- |
| 1,3-propanediol, 2-benzyloxy- |
| 1,3-propanediol, 2-(2-phenylethyloxy)- |
| 1,3-propanediol, 2-(1-phenylethyloxy)- |
| Preferred Aromatic Glyceryl Ethers |
| 1,2-propanediol, 3-phenyloxy- |
| 1,2-propanediol, 3-benzyloxy- |
| 1,2-propanediol, 3-(2-phenylethyloxy)- |
| 1,3-propanediol, 2-(m-cresyloxy)- |
| 1,3-propanediol, 2-(p-cresyloxy)- |
| 1,3-propanediol, 2-benzyloxy- |
| 1,3-propanediol, 2-(2-phenylethyloxy)- |
| Preferred Aromatic Glyceryl Ethers |
| 1,2-propanediol, 3-phenyloxy- |
| 1,2-propanediol, 3-benzyloxy- |
| 1,2-propanediol, 3-(2-phenylethyloxy)- |
| 1,3-propanediol, 2-(m-cresyloxy)- |
| 1,3-propanediol, 2-(p-cresyloxy)- |
| 1,3-propanediol, 2-(2-phenylethyloxy)- |

TABLE VII

| ALICYCLIC DIOLS AND DERIVATIVES | |
|---|---|
| Chemical Name | CAS No. |
| Preferred Cylic Diols and Derivatives | |
| 1-isopropyl-1,2-cyclobutanediol | 59895-32-8 |
| 3-ethyl-4-methyl-1,2-cyclobutanediol | |
| 3-propyl-1,2-cyclobutanediol | |
| 3-isopropyl-1,2-cyclobulanediol | 42113-90-6 |
| 1-ethyl-1,2-cyclopentanediol | 67396-17-2 |
| 1,2-dimethyl-1,2-cyclopentanediol | 33046-20-7 |
| 1,4-dimethyl-1,2-cyclopentanediol | 89794-56-9 |
| 2,4,5-trimethyl-1,3-cyclopentanediol | |
| 3,3-dimethyl-1,2-cyclopentanediol | 89794-57-0 |
| 3,4-dimethyl-1,2-cyclopentanediol | 70051-69-3 |
| 3,5-dimethyl-1,2-cyclopentanediol | 89794-58-1 |
| 3-ethyl-1,2-cyclopentanediol | |
| 4,4-dimethyl-1,2-cyclopentanediol | 70197-54-5 |
| 4-ethyl-1,2-cyclopentanediol | |
| 1,1-bis(hydroxymethyl)cyclohexane | 2658-60-8 |
| 1,2-bis(hydroxymethyl)cyclohexane | 76155-27-6 |
| 1,2-dimethyl-1,3-cyclohexanediol | 53023-07-7 |
| 1,3-bis(hydroxymethyl)cyclohexane | 13022-98-5 |
| 1,3-dimethyl-1,3-cyclohexanediol | 128749-93-9 |
| 1,6-dimethyl-1,3-cyclohexanediol | 164713-16-0 |
| 1-hydroxy-cyclohexaneethanol | 40894-17-5 |
| 1-hydroxy-cyclohexanemethanol | 15753-47-6 |
| 1-ethyl-1,3-cyclohexanediol | 10601-18-0 |
| 1-methyl-1,2-cyclohexanediol | 52718-65-7 |
| 2,2-dimethyl-1,3-cyclohexanediol | 114693-83-3 |
| 2,3-dimethyl-1,4-cyclohexanediol | 70156-82-0 |
| 2,4-dimethyl-1,3-cyclohexanediol | |
| 2,5-dimethyl-1,3-cyclohexanediol | |
| 2,6-dimethyl-1,4-cyclohexanediol | 34958-42-4 |
| 2-ethyl-1,3-cyclohexanediol | 155433-88-8 |
| 2-hydroxycyclohexaneethanol | 24682-42-6 |
| 2-hydroxyethyl-1-cyclohexanol | |
| 2-hydroxymethylcyclohexanol | 89794-52-5 |

TABLE VII-continued

| ALICYCLIC DIOLS AND DERIVATIVES | |
|---|---|
| Chemical Name | CAS No. |
| 3-hydroxyethyl-1-cyclohexanol | |
| 3-hydroxycyclohexaneethanol | 86576-87-6 |
| 3-hydroxymethylcyclohexanol | |
| 3-methyl-1,2-cyclohexanediol | 23477-91-0 |
| 4,4-dimethyl-1,3-cyclohexanediol | 14203-50-0 |
| 4,5-dimethyl-1,3-cyclohexanediol | |
| 4,6-dimethyl-1,3-cyclohexanediol | 16066-66-3 |
| 4-ethyl-1,3-cyclohexanediol | |
| 4-hydroxyethyl-1-cyclohexanol | |
| 4-hydroxymethylcyclohexanol | 33893-85-5 |
| 4-methyl-1,2-cyclohexanediol | 23832-27-1 |
| 5,5-dimethyl-1,3-cyclohexanediol | 51335-83-2 |
| 5-ethyl-1,3-cyclohexanediol | |
| 1,2-cycloheptanediol | 108268-28-6 |
| 2-methyl-1,3-cycloheptanediol | 101375-80-8 |
| 2-methyl-1,4-cycloheptanediol | |
| 4-methyl-1,3-cycloheptanediol | |
| 5-methyl-1,3-cycloheptanediol | |
| 5-methyl-1,4-cycloheptanediol | 90201-00-6 |
| 6-methyl-1,4-cycloheptanediol | |
| 1,3-cyclooctanediol | 101935-36-8 |
| 1,4-cyclooctanediol | 73982-04-4 |
| 1,5-cyclooctanediol | 23418-82-8 |
| 1,2-cyclohexanediol, diethoxylate | |
| 1,2-cyclohexanediol, triethoxylate | |
| 1,2-cyclohexanediol, tetraethoxylate | |
| 1,2-cyclohexanediol, pentaethoxylate | |
| 1,2-cyclohexanediol, hexaethoxylate | |
| 1,2-cyclohexanediol, heptaethoxylate | |
| 1,2-cyclohexanediol, octaethoxylate | |
| 1,2-cyclohexanediol, nonaethoxylate | |
| 1,2-cyclohexanediol, monopropoxylate | |
| 1,2-cyclohexanediol, monobutylenoxylate | |
| 1,2-cyclohexanediol, dibutylenoxylate | |
| 1,2-cyclohexanediol, tributylenoxylate | |
| More Preferred Cylic Diols and Derivatives | |
| 1-isopropyl-1,2-cyclobutanediol | 59895-32-8 |
| 3-ethyl-4-methyl-1,2-cyclobutanediol | |
| 3-propyl-1,2-cyclobutanediol | |
| 3-isopropyl-1,2-cyclobutanediol | 42113-90-6 |
| 1-ethyl-1,2-cyclopentanediol | 67396-17-2 |
| 1,2-dimethyl-1,2-cyclopentanediol | 33046-20-7 |
| 1,4-dimethyl-1,2-cyclopentanediol | 89794-56-9 |
| 3,3-dimethyl-1,2-cyclopentanediol | 89794-57-0 |
| 3,4-dimethyl-1,2-cyclopentanediol | 70051-69-3 |
| 3,5-dimethyl-1,2-cyclopentanediol | 89794-58-1 |
| 3-ethyl-1,2-cyclopentanediol | |
| 4,4-dimethyl-1,2-cyclopentanediol | 70197-54-5 |
| 4-ethyl-1,2-cyclopentanediol | |
| 1,1-bis(hydroxymethyl)cyclohexane | 2658-60-8 |
| 1,2-bis(hydroxymethyl)cyclohexane | 76155-27-6 |
| 1,2-dimethyl-1,3-cyclohexanediol | 53023-07-7 |
| 1,3-bis(hydroxymethyl)cyclohexane | 13022-98-5 |
| 1-hydroxy-cyclohexanemethanol | 15753-47-6 |
| 1-methyl-1,2-cyclohexanediol | 52718-65-7 |
| 3-hydroxymethylcyclohexanol | |
| 3-methyl-1,2-cyclohexanediol | 23477-91-0 |
| 4,4-dimethyl-1,3-cyclohexanediol | 14203-50-0 |
| 4,5-dimethyl-1,3-cyclohexanediol | |
| 4,6-dimethyl-1,3-cyclohexanediol | 16066-66-3 |
| 4-ethyl-1,3-cyclohexanediol | |
| 4-hydroxyethyl-1-cyclohexanol | |
| 4-hydroxymethylcyclohexanol | 33893-85-5 |
| 4-methyl-1,2-cyclohexanediol | 23832-27-1 |
| 1,2-cycloheptanediol | 108268-28-6 |
| 1,2-cyclohexanediol, pentaethoxylate | |
| 1,2-cyclohexanediol, hexaethoxylate | |
| 1,2-cyclohexanediol, heptaethoxylate | |
| 1,2-cyclohexanediol, octaethoxylate | |
| 1,2-cyclohexanediol, nonaethoxylate | |
| 1,2-cyclohexanediol, monopropoxylate | |
| 1,2-cyclohexanediol, dibutylenoxylate | |

The unsaturated alicyclic diols include the following known unsaturated alicyclic diols:

TABLE VIII $C_3C_7$DIOL ALKOXYLATED DERIVATIVES
Operable Unsaturated Alicyclic Diols

| Chemical Name | CAS No. |
|---|---|
| 1,2-Cyclobutanediol, 1-ethenyl-2-ethyl- | 58016-14-1 |
| 3-Cyclobutene-1,2-diol, 1,2,3,4-tetramethyl- | 90112-64-4 |
| 3-Cyclobutene-1,2-diol, 3,4-diethyl- | 142543-60-0 |
| 3-Cyclobutene-1,2-diol, 3-(1,1-dimethylethyl)- | 142543-56-4 |
| 3-Cyclobutene-1,2-diol, 3-butyl- | 142543-55-3 |
| 1,2-Cyclopentanediol, 1,2-dimethyl-4-methylene- | 103150-02-3 |
| 1,2-Cyclopentanediol, 1-ethyl-3-methylene- | 90314-52-6 |
| 1,2-Cyclopentanediol, 4-(1-propenyl) | 128173-45-5 |
| 3-Cyclopentene-1,2-diol, 1-ethyl-3-methyl- | 90314-43-5 |
| 1,2-Cyclohexanediol, 1-ethenyl- | 134134-16-0 |
| 1,2-Cyclohexanediol, 1-methyl-3-methylene- | 98204-78-5 |
| 1,2-Cyclohexanediol, 1-methyl-4-methylene- | 133358-53-9 |
| 1,2-Cyclohexanediol, 3-ethenyl- | 55310-51-5 |
| 1,2-Cyclohexanediol, 4-ethenyl- | 85905-16-4 |
| 3-Cyclohexene-1,2-diol, 2,6-dimethyl- | 81969-75-7 |
| 3-Cyclohexene-1,2-diol, 6,6-dimethyl- | 61875-93-2 |
| 4-Cyclohexene-1,2-diol, 3,6-dimethyl- | 156808-73-0 |
| 4-Cyclohexene-1,2-diol, 4,5-dimethyl- | 154351-54-9 |

TABLE VIII-continued $C_3C_7$DIOL ALKOXYLATED DERIVATIVES
Operable Unsaturated Alicyclic Diols

| Chemical Name | CAS No. |
|---|---|
| 3-Cyclooctene-1,2-diol | 170211-27-5 |
| 4-Cyclooctene-1,2-diol | 124791-61-3 |
| 5-Cyclooctene-1,2-diol | 117468-07-2 |

In the following tables, "EO" means polyethoxylates, i.e., —$(CH_2CH_2O)_nH$; Me-En means methyl-capped polyethoxylates —$(CH_2CH_2O)_nCH_3$;"2(Me-En)" means 2 Me-En groups needed; "PO" means polypropoxylates, —$(CH(CH_3)CH_2O)_nH$; "BO" means polybutyleneoxy groups, $(CH(CH_2CH_3)CH_2O)_nH$; and "n-BO" means poly(n-butyleneoxy) or poly(tetramethylene)oxy groups —$(CH_2CH_2CH_2CH_2O)_nH$. The indicated alkoxylated derivatives are all operable and those that are preferred are in bold type and listed on the second line.

TABLE VIIIA

| Base Material[(a)] | Base Material CAS No. | EO's (b) | 1(Me-En) (c) | 2(Me-En) (d) | PO's (e) | n-BO's (f) | BO's (g) |
|---|---|---|---|---|---|---|---|
| 1,2-propanediol (C3) | 57-55-6 | | | 1-4 **3-4** | **4** | | |
| 1,2-propanediol, 2-methyl- (C4) | 558-43-0 | | 4-10 **8-10** | **1** | **3** | | 1 |
| 1,3-propanediol (C3) | 504-63-2 | | | 6-8 **8** | 5-6 **6** | | |
| 1,3-propanediol, 2,2-diethyl- (C7) | 115-76-4 | 1-7 **4-7** | | | **1** | 1-2 **2** | |
| 1,3-propanediol, 2,2-dimethyl- (C5) | 126-30-7 | | | **1-2** | 3-4 **4** | | |
| 1,3-propanediol, 2-(1-methylpropyl)- (C7) | 33673-01-7 | 1-7 **4-7** | | | **1** | 1-2 **2** | |
| 1,3-propanediol, 2-(2-methylpropyl)- (C7) | 26462-20-8 | 1-7 **4-7** | | | **1** | 1-2 **2** | |
| 1,3-propanediol, 2-ethyl- (C5) | 2612-29-5 | | 6-10 **9-10** | **1** | **3** | | |
| 1,3-propanediol, 2-ethyl-2-methyl- (C6) | 77-84-9 | | 1-6 **3-6** | | **2** | | **1** |
| 1,3-propanediol, 2-isopropyl- (C6) | 2612-27-3 | | 1-6 **3-6** | | **2** | | **1** |
| 1,3-propanediol, 2-methyl- (C4) | 2163-42-0 | | | 2-5 **4-5** | 4-5 **5** | | **2** |
| 1,3-propanediol, 2-methyl-2-isopropyl- (C7) | 2109-23-1 | 2-9 **6-9** | | | **1** | 1-3 **2-3** | |
| 1,3-propanediol, 2-methyl-2-propyl- (C7) | 78-26-2 | 1-7 **4-7** | | | **1** | 1-2 **2** | |

TABLE VIIIA-continued

| Base Material[a] | Base Material CAS No. | EO's (b) | 1(Me-En) (c) | 2(Me-En) (d) | PO's (e) | n-BO's (f) | BO's (g) |
|---|---|---|---|---|---|---|---|
| 1,3-propanediol, 2-propyl- (C6) | 2612-28-4 | | **1-4** | | **2** | | 1 |

[a]The number of indicated alkoxylated groups in this Table are all operable, the generic limits being listed on the first line, and those that are preferred are in bold type and listed on the second line.
(b) The numbers in this column are average numbers of ($CH_2CH_2O$) groups in the polyethoxylated derivative.
(c) The numbers in this column are average numbers of ($CH_2CH_2O$) groups in the one methyl-capped polyethoxylate substituant in each derivative.
(d) The numbers in this column are average numbers of ($CH_2CH_2O$) groups in each of the two methyl-capped polyethoxylate substituants in each derivative.
(e) The numbers in this column are average numbers of ($CH(CH_3)CH_2O$) groups in the polypropoxylated derivative.
(f) The numbers in this column are average numbers of ($CH_2CH_2CH_2CH_2O$) groups in the polytetramethyleneoxylated derivative.
(g) The numbers in this column are average numbers of ($CH(CH_2CH_3)CH_2O$) groups in the polybutoxylated derivative.

TABLE VIIIB

| Base Material[a] | Base Material CAS No. | EO's (b) | 1(Me-En) (c) | 2(Me-En) (d) | PO's (e) | n-BO's (f) | BO's (g) |
|---|---|---|---|---|---|---|---|
| 1,2-butanediol (C4) | 584-03-2 | | 2-8 **6-8** | | **2-3** | | **1** |
| 1,2-butanediol, 2,3-dimethyl- (C6) | 66553-15-9 | 1-6 **2-5** | | | | 1-2 **1** | |
| 1,2-butanediol, 2-ethyl- (C6) | 66553-16-0 | **1-3** | | | | **1** | |
| 1,2-butanediol, 2-methyl- (C5) | 41051-72-3 | | **1-2** | **1** | | | |
| 1,2-butanediol, 3,3-dimethyl- (C6) | 59562-82-2 | 1-6 **2-5** | | | | 1-2 **1** | |
| 1,2-butanediol, 3-methyl- (C5) | 50468-22-9 | | **1-2** | | **1** | | |
| 1,3-butanediol (C4) | 107-88-0 | | | 3-6 **5-6** | 5 | | **2** |
| 1,3-butanediol, 2, 2,3-trimethyl- (C7) | 16343-75-2 | | **1-3** | | 1-2 **2** | | |
| 1,3-butanediol, 2, 2-dimethyl- (C6) | 76-35-7 | | 3-8 **6-8** | | **3** | | |
| 1,3-butanediol, 2,3-dimethyl- (C6) | 24893-35-4 | | 3-8 **6-8** | | **3** | | |
| 1,3-butanediol, 2-ethyl- (C6) | 66553-17-1 | | 1-6 **4-6** | | **2 to 3** | | **1** |
| 1,3-butanediol, 2-ethyl-2-methyl- (C7) | Method C | | **1** | | **1** | 2-4 **3** | |
| 1,3-butanediol, 2-ethyl-3-methyl- (C7) | 68799-03-1 | | **1** | | **1** | 2-4 **3** | |
| 1,3-butanediol, 2-isopropyl- (C7) | 66567-04-2 | | **1** | | **1** | 2-4 **3** | |
| 1,3-butanediol, 2-methyl- (C5) | 684-84-4 | | | 1-3 **2-3** | **4** | | |
| 1,3-butanediol, 2-propyl- (C7) | 66567-03-1 | 2-9 **6-8** | | | **1** | 1-3 **2-3** | |
| 1,3-butanediol, 3-methyl- (C5) | 2568-33-4 | | | 1-3 **2-3** | **4** | | |
| 1,4-butanediol (C4) | 110-63-4 | | | 2-4 **3-4** | 4-5 **4-5** | | 2 |
| 1,4-butanediol, 2, 2,3-trimethyl- (C7) | 162108-60-3 | 2-9 **6-9** | | | **1** | 1-3 **2-3** | |
| 1,4-butanediol, 2,2-dimethyl- (C6) | 32812-23-0 | | 1-6 **3-6** | | **2** | | **1** |
| 1,4-butanediol, 2,3-dimethyl- (C6) | 57716-80-0 | | 1-6 **3-6** | | **2** | | **1** |
| 1,4-butanediol, 2-ethyl- (C6) | 57716-79-7 | | **1-4** | | **2** | | 1 |
| 1,4-butanediol, 2-ethyl-2-methyl- (C7) | 76651-98-4 | 1-7 **4-7** | | | **1** | 1-2 **2** | |

TABLE VIIIB-continued

| Base Material[a] | Base Material CAS No. | EO's (b) | 1(Me-En) (c) | 2(Me-En) (d) | PO's (e) | n-BO's (f) | BO's (g) |
|---|---|---|---|---|---|---|---|
| 1,4-butanediol, 2-ethyl-3-methyl- (C7) | 66225-34-1 | 1-7<br>**4-7** | | | **1** | 1-2<br>**2** | |
| 1,4-butanediol, 2-isopropyl- (C7) | 39497-66-0 | 1-7<br>**4-7** | | | **1** | 1-2<br>**2** | |
| 1,4-butanediol, 2-methyl- (C5) | 2938-98-9 | | 6-10<br>**9-10** | **1** | **3** | | 1 |
| 1,4-butanediol, 2-propyl- (C7) | 62946-68-3 | 1-5<br>**2-5** | | | | 1-2<br>**1** | |
| 1,4-butanediol, 3-ethyl-1-methyl- (C7) | Method F | 2-9<br>**6-8** | | | **1** | 1-3<br>**2-3** | |
| 2,3-butanediol (C4) | 513-85-9 | | 6-10<br>**9-10** | **1** | **3-4** | | 1 |
| 2,3-butanediol, 2,3-dimethyl- (C6) | 76-09-5 | 3-9<br>**7-9** | | | **1** | 1-3<br>**2-3** | |
| 2,3-butanediol, 2-methyl- (C5) | 5396-58-7 | | 1-5<br>**2-5** | | **2** | | **1** |

[a]The number of indicated alkoxylated groups in this Table are all operable, the generic limits being listed on the first line, and those that are preferred are in bold type and listed on the second line.
(b) The numbers in this column are average numbers of ($CH_2CH_2O$) groups in the polyethoxylated derivative.
(c) The numbers in this column are average numbers of ($CH_2CH_2O$) groups in the one methyl-capped polyethoxylate substituant in each derivative.
(d) The numbers in this column are average numbers of ($CH_2CH_2O$) groups in each of the two methyl-capped polyethoxylate substituants in each derivative.
(e) The numbers in this column are average numbers of ($CH(CH_3)CH_2O$) groups in the polypropoxylated derivative.
(f) The numbers in this column are average numbers of ($CH_2CH_2CH_2CH_2O$) groups in the polytetramethyleneoxylated derivative.
(g) The numbers in this column are average numbers of ($CH(CH_2CH_3)CH_2O$) groups in the polybutoxylated derivative.

TABLE VIIIC

| Base Material[a] | Base Material CAS No. | EO's (b) | 1(Me-En) (c) | 2(Me-En) (d) | PO's (e) | n-BO's (f) | BO's (g) |
|---|---|---|---|---|---|---|---|
| 1,2-pentanediol (C5) | 5343-92-0 | 3-10<br>**7-10** | | | **1** | 2-3<br>**3** | |
| 1,2-pentanediol, 2-methyl- (C6) | 20667-05-4 | **1-3** | | | | **1** | |
| 1,2-pentanediol, 3-methyl- (C6) | 159623-53-7 | **1-3** | | | | **1** | |
| 1,2-pentanediol, 4-methyl- (C6) | 72110-08-8 | **1-3** | | | | **1** | |
| 1,3-pentanediol (C5) | 3174-67-2 | | | **1-2** | **3-4** | | |
| 1,3-pentanediol, 2,2-dimethyl- (C7) | 2157-31-5 | | **1** | | **1** | 2-4<br>**3** | |
| 1,3-pentanediol, 2,3-dimethyl- (C7) | 66225-52-3 | | **1** | | **1** | 2-4<br>**3** | |
| 1,3-pentanediol, 2,4-dimethyl- (C7) | 60712-38-1 | | **1** | | **1** | 2-4<br>**3** | |
| 1,3-pentanediol, 2-ethyl- (C7) | 29887-11-4 | 2-9<br>**6-8** | | | **1** | 1-3<br>**2-3** | |
| 1,3-pentanediol, 2-methyl- (C6) | 149-31-5 | | 1-6<br>**4-6** | | **2-3** | | 1 |
| 1,3-pentanediol, 3,4-dimethyl- (C7) | 129851-50-9 | | **1** | | **1** | 2-4<br>**3** | |
| 1,3-pentanediol, 3-methyl- (C6) | 33879-72-0 | | 1-6<br>**4-6** | | **2-3** | | 1 |
| 1,3-pentanediol, 4,4-dimethyl- (C7) | 30458-16-3 | | **1** | | **1** | 2-4<br>**3** | |
| 1,3-pentanediol, 4-methyl- (C6) | 54876-99-2 | | 1-6<br>**4-6** | | **2-3** | | 1 |

TABLE VIIIC-continued

| Base Material[a] | Base Material CAS No. | EO's (b) | 1(Me-En) (c) | 2(Me-En) (d) | PO's (e) | n-BO's (f) | BO's (g) |
|---|---|---|---|---|---|---|---|
| 1,4-pentanediol (C5) | 626-95-9 | | | **1-2** | **3-4** | | |
| 1,4-pentanediol, 2,2-dimethyl- (C7) | Method F | | **1** | | **1** | 2-4 **3** | |
| 1,4-pentanediol, 2,3-dimethyl- (C7) | Method F | | **1** | | **1** | 2-4 **3** | |
| 1,4-pentanediol, 2,4-dimethyl- (C7) | Method F | | **1** | | **1** | 2-4 **3** | |
| 1,4-pentanediol, 2-methyl- (C6) | 6287-17-8 | | 1-6 **4-6** | | **2-3** | | 1 |
| 1,4-pentanediol, 3,3-dimethyl- (C7) | 81887-62-9 | | **1** | | **1** | 2-4 **3** | |
| 1,4-pentanediol, 3,4-dimethyl- (C7) | 63521-36-8 | | **1** | | **1** | 2-4 **3** | |
| 1,4-pentanediol, 3-methyl- (C6) | 26787-63-3 | | 1-6 **4-6** | | **2-3** | | 1 |
| 1,4-pentanediol, 4-methyl- (C6) | 1462-10-8 | | 1-6 **4-6** | | **2-3** | | 1 |
| 1,5-pentanediol (C5) | 111-29-5 | | 4-10 **8-10** | **1** | **3** | | |
| 1,5-pentanediol, 2,2-dimethyl- (C7) | 3121-82-2 | 1-7 **4-7** | | | **1** | 1-2 **2** | |
| 1,5-pentanediol, 2,3-dimethyl- (C7) | 81554-20-3 | 1-7 **4-7** | | | **1** | 1-2 **2** | |
| 1,5-pentanediol, 2,4-dimethyl- (C7) | 2121-69-9 | 1-7 **4-7** | | | **1** | 1-2 **2** | |
| 1,5-pentanediol, 2-ethyl- (C7) | 14189-13-0 | 1-5 **2-5** | | | | 1-2 **1** | |
| 1,5-pentanediol, 2-methyl- (C6) | 42856-62-2 | | **1-4** | | **2** | | |
| 1,5-pentanediol, 3,3-dimethyl- (C7) | 53120-74-4 | 1-7 **4-7** | | | **1** | 1-2 **2** | |
| 1,5-pentanediol, 3-methyl- (C6) | 4457-71-0 | | **1-4** | | **2** | | |
| 2,3-pentanediol (C5) | 42027-23-6 | | **1-3** | | **2** | | |
| 2,3-pentanediol, 2-methyl- (C6) | 7795-80-4 | 1-7 **4-7** | | | **1** | 1-2 **2** | |
| 2,3-pentanediol, 3-methyl- (C6) | 63521-37-9 | 1-7 **4-7** | | | **1** | 1-2 **2** | |
| 2,3-pentanediol, 4-methyl- (C6) | 7795-79-1 | 1-7 **4-7** | | | **1** | 1-2 **2** | |
| 2,4-pentanediol (C5) | 625-69-4 | | | 1-4 **2-4** | **4** | | |
| 2,4-pentanediol, 2,3-dimethyl- (C7) | 24893-39-8 | | 1-4 **2-4** | | **2** | | |
| 2,4-pentanediol, 2,4-dimethyl- (C7) | 24892-49-7 | | 1-4 **2-4** | | **2** | | |
| 2,4-pentanediol, 2-methyl- (C6) | 107-41-5 | | 5-10 **8-10** | | **3** | | |
| 2,4-pentanediol, 3,3 -dimethyl- (C7) | 24892-50-0 | | 1-4 **2-4** | | **2** | | |

TABLE VIIIC-continued

| Base Material[(a)] | Base Material CAS No. | EO's (b) | 1(Me-En) (c) | 2(Me-En) (d) | PO's (e) | n-BO's (f) | BO's (g) |
|---|---|---|---|---|---|---|---|
| 2,4-pentanediol, 3-methyl- (C6) | Method H | | 5-10<br>**8-10** | | <br>**3** | | |

[(a)]The number of indicated alkoxylated groups in this Table are all operable, the generic limits being listed on the first line, and those that are preferred are in bold type and listed on the second line.
(b) The numbers in this column are average numbers of ($CH_2CH_2O$) groups in the polyethoxylated derivative.
(c) The numbers in this column are average numbers of ($CH_2CH_2O$) groups in the one methyl-capped polyethoxylate substituant in each derivative.
(d) The numbers in this column are average numbers of ($CH_2CH_2O$) groups in each of the two methyl-capped polyethoxylate substituants in each derivative.
(e) The numbers in this column are average numbers of ($CH(CH_3)CH_2O$) groups in the polypropoxylated derivative.
(f) The numbers in this column are average numbers of ($CH_2CH_2CH_2CH_2O$) groups in the polytetramethyleneoxylated derivative.
(g) The numbers in this column are average numbers of ($CH(CH_2CH_3)CH_2O$) groups in the polybutoxylated derivative.

TABLE VIIIC

| Base Material[(a)] | Base Material CAS No. | EO's (b) | 1(Me-En) (c) | PO's (e) | n-BO's (f) | BO's (g) |
|---|---|---|---|---|---|---|
| 1,3-hexanediol (C6) | 21531-91-9 | | 1-5<br>**2-5** | <br>**2** | | <br>**1** |
| 1,3-hexanediol, 2-methyl- (C7) | 66072-21-7 | 2-9<br>**6-8** | | <br>**1** | 1-3<br>**2-3** | 1 |
| 1,3-hexanediol, 3-methyl- (C7) | Method D | 2-9<br>**6-8** | | <br>**1** | 1-3<br>**2-3** | |
| 1,3-hexanediol, 4-methyl- (C7) | Method C | 2-9<br>**6-8** | | <br>**1** | 1-3<br>**2-3** | |
| 1,3-hexanediol, 5-methyl- (C7) | 109863-14-1 | 2-9<br>**6-8** | | <br>**1** | 1-3<br>**2-3** | |
| 1,4-hexanediol (C6) | 16432-53-4 | | 1-5<br>**2-5** | <br>**2** | | <br>**1** |
| 1,4-hexanediol, 2-methyl- (C7) | Method F | 2-9<br>**6-8** | | <br>**1** | 1-3<br>**2-3** | |
| 1,4-hexanediol, 3-methyl- (C7) | 66225-36-3 | 2-9<br>**6-8** | | <br>**1** | 1-3<br>**2-3** | |
| 1,4-hexanediol, 4-methyl- (C7) | 40646-08-0 | 2-9<br>**6-8** | | <br>**1** | 1-3<br>**2-3** | |
| 1,4-hexanediol, 5-methyl- (C7) | 38624-36-1 | 2-9<br>**6-8** | | <br>**1** | 1-3<br>**2-3** | |
| 1,5-hexanediol (C6) | 928-40-5 | | 1-5<br>**2-5** | <br>**2** | | <br>**1** |
| 1,5-hexanediol, 2-methyl- (C7) | Method F | 2-9<br>**6-8** | | <br>**1** | 1-3<br>**2-3** | |
| 1,5-hexanediol, 3-methyl- (C7) | Method F | 2-9<br>**6-8** | | <br>**1** | 1-3<br>**2-3** | |
| 1,5-hexanediol, 4-methyl- (C7) | 66225-37-4 | 2-9<br>**6-8** | | <br>**1** | 1-3<br>**2-3** | |
| 1,5-hexanediol, 5-methyl- (C7) | 1462-11-9 | 2-9<br>**6-8** | | <br>**1** | 1-3<br>**2-3** | |
| 1,6-hexanediol (C6) | 629-11-8 | | <br>**1-2** | <br>**1-2** | <br>**4** | |
| 1,6-hexanediol, 2-methyl- (C7) | 25258-92-8 | 1-5<br>**2-5** | | | 1-2<br>**1** | |
| 1,6-hexanediol, 3-methyl- (C7) | 4089-71-8 | 1-5<br>**2-5** | | | 1-2<br>**1** | |
| 2,3-hexanediol (C6) | 617-30-1 | 1-5<br>**2-5** | | | 1-2<br>**1** | |
| 2,4-hexanediol (C6) | 19780-90-6 | | 3-8<br>**5-8** | <br>**3** | | |
| 2,4-hexanediol, 2-methyl- (C7) | 66225-35-2 | | <br>**1-2** | <br>**1-2** | | |
| 2,4-hexanediol, 3-methyl- (C7) | 116530-79-1 | | | <br>**1-2** | <br>**1-2** | |
| 2,4-hexanediol, 4-methyl- (C7) | 38836-25-8 | | <br>**1-2** | <br>**1-2** | | |
| 2,4-hexanediol, 5-methyl- (C7) | 54877-00-8 | <br>**1-2** | <br>**1-2** | | | |

TABLE VIIIC-continued

| Base Material[a] | Base Material CAS No. | EO's (b) | 1(Me-En) (c) | PO's (e) | n-BO's (f) | BO's (g) |
|---|---|---|---|---|---|---|
| 2,5-hexanediol (C6) | 2935-44-6 | | 3-8 | | | |
| | | | **5-8** | **3** | | |
| 2,5-hexanediol, 2-methyl-(C7) | 29044-06-2 | | | | | |
| | | | **1-2** | **1-2** | | |
| 2,5-hexanediol, 3-methyl-(C7) | Method H | | | | | |
| | | | **1-2** | **1-5** | | |
| 3,4-hexanediol (C6) | 922-17-8 | 1-5 | | | | |
| | | **2-5** | | | **1** | |

[a]The number of indicated alkoxylated groups in this Table are all operable, the generic limits being listed on the first line, and those that are preferred are in bold type and listed on the second line.
(b) The numbers in this column are average numbers of ($CH_2CH_2O$) groups in the polyethoxylated derivative.
(c) The numbers in this column are average numbers of ($CH_2CH_2O$) groups in the one methyl-capped polyethoxylate substituant in each derivative.
(e) The numbers in this column are average numbers of ($CH(CH_3)CH_2O$) groups in the polypropoxylated derivative.
(f) The numbers in this column are average numbers of ($CH_2CH_2CH_2CH_2O$) groups in the polytetramethyleneoxylated derivative.
(g) The numbers in this column are average numbers of ($CH(CH_2CH_3)CH_2O$) groups in the polybutoxylated derivative.

TABLE VIIIE

| Base Material[a] | Base Material CAS No. | EO's (b) | 1(Me-En) (c) | PO's (e) | n-BO's (f) |
|---|---|---|---|---|---|
| 1,3-heptanediol (C7) | 23433-04-7 | 1-7 | | | 1-2 |
| | | **3-6** | | **1** | **2** |
| 1,4-heptanediol (C7) | 40646-07-9 | 1-7 | | | 1-2 |
| | | **3-6** | | **1** | **2** |
| 1,5-heptanediol (C7) | 60096-09-5 | 1-7 | | | 1-2 |
| | | **3-6** | | **1** | **2** |
| 1,6-heptanediol (C7) | 13175-27-4 | 1-7 | | | 1-2 |
| | | **3-6** | | **1** | **2** |
| 1,7-heptanediol (C7) | 629-30-1 | | | | |
| | | **1-2** | | | **1** |
| 2,4-heptanediol (C7) | 20748-86-1 | 3-10 | | | |
| | | **7-10** | **1** | **1** | **3** |
| 2,5-heptanediol (C7) | 70444-25-6 | 3-10 | | | |
| | | **7-10** | **1** | **1** | **3** |
| 2,6-heptanediol (C7) | 5969-12-0 | 3-10 | | | |
| | | **7-10** | **1** | **1** | **3** |
| 3,5-heptanediol (C7) | 86632-40-8 | 3-10 | | | |
| | | **7-10** | **1** | **1** | **3** |

[a]The number of indicated alkoxylated groups in this Table are all operable, the generic limits being listed on the first line, and those that are preferred are in bold type and listed on the second line.
(b) The numbers in this column are average numbers of ($CH_2CH_2O$) groups in the polyethoxylated derivative.
(c) The numbers in this column are average numbers of ($CH_2CH_2O$) groups in the one methyl-capped polyethoxylate substituant in each derivative.
(e) The numbers in this column are average numbers of ($CH(CH_3)CH_2O$) groups in the polypropoxylated derivative.
(f) The numbers in this column are average numbers of ($CH_2CH_2CH_2CH_2O$) groups in the polytetramethyleneoxylated derivative.

TABLE IX

AROMATIC DIOLS
Suitable aromatic diols include:

| Chemical Name | CAS No. |
|---|---|
| Operable Aromatic Diols | |
| 1-phenyl-1,2-ethanediol | 93-56-1 |
| 1-phenyl-1,2-propanediol | 1855-09-0 |
| 2-phenyl-1,2-propanediol | 87760-50-7 |

TABLE IX-continued

AROMATIC DIOLS
Suitable aromatic diols include:

| Chemical Name | CAS No. |
|---|---|
| 3-phenyl-1,2-propanediol | 17131-14-5 |
| 1-(3-methylphenyl)-1,3-propanediol | 51699-43-5 |
| 1-(4-methylphenyl)-1,3-propanediol | 159266-06-5 |
| 2-methyl-1-phenyl-1,3-propanediol | 139068-60-3 |
| 1-phenyl-1,3-butanediol | 118100-60-0 |
| 3-phenyl-1,3-butanediol | 68330-54-1 |
| 1-phenyl-1,4-butanediol | 136173-88-1 |
| 2-phenyl-1,4-butanediol | 95840-73-6 |
| 1-phenyl-2,3-butanediol | 169437-68-7 |
| Preferred Aromatic Diols | |
| 1-phenyl-1,2-ethanediol | 93-56-1 |
| 1-phenyl-1,2-propanediol | 1855-09-0 |
| 2-phenyl-1,2-propanediol | 87760-50-7 |
| 3-phenyl-1,2-propanediol | 17131-14-5 |
| 1-(3-methylphenyl)-1,3-propanediol | 51699-43-5 |
| 1-(4-methylphenyl)-1,3-propanediol | 159266-06-5 |
| 2-methyl-1-phenyl-1,3-propanediol | 139068-60-3 |
| 1-phenyl-1,3-butanediol | 118100-60-0 |
| 3-phenyl-1,3-butanediol | 68330-54-1 |
| 1-phenyl-1,4-butanediol | 136173-88-1 |
| More Preferred Aromatic Diols | |
| 1-phenyl-1,2-propanediol | 1855-09-0 |
| 2-phenyl-1,2-propanediol | 87760-50-7 |
| 3-phenyl-1,2-propanediol | 17131-14-5 |
| 1-(3-methylphenyl)-1,3-propanediol | 51699-43-5 |
| 1-(4-methylphenyl)-1,3-propanediol | 159266-06-5 |
| 2-methyl-1-phenyl-1,3-propanediol | 139068-60-3 |
| 3-phenyl-1,3-butanediol | 68330-54-1 |
| 1-phenyl-1,4-butanediol | 136173-88-1 |

X. principal solvents which are homologs, or analogs, of the above structures where the total number of hydrogen atoms is increased by the addition of one, or more additional $CH_2$ groups, the total number of hydrogen atoms being kept at the same number by introducing double bonds, are also useful with examples including the following known compounds:

TABLE X

| EXAMPLES OF UNSATURATED COMPOUNDS | |
|---|---|
| Operable Unsaturated Diols | |
| 1,3-Propanediol,2,2-di-2-propenyl- | 55038-13-6 |
| 1,3-Propanediol,2-(1-pentenyl)- | 138436-18-7 |
| 1,3-Propanediol,2-(2-methyl-2-propenyl)-2-(2-propenyl)- | 121887-76-1 |
| 1,3-Propanediol,2-(3-methyl-1-butenyl)- | 138436-17-6 |
| 1,3-Propanediol,2-(4-pentenyl)- | 73012-46-1 |
| 1,3-Propanediol,2-ethyl-2-(2-methyl-2-propenyl)- | 91367-61-2 |
| 1,3-Propanediol,2-ethyl-2-(2-propenyl)- | 27606-26-4 |
| 1,3-Propanediol,2-methyl-2-(3-methyl-3-butenyl)- | 132130-95-1 |
| 1,3-Butanediol,2,2-diallyl- | 103985-49-5 |
| 1,3-Butanediol,2-(1-ethyl-1-propenyl)- | 116103-35-6 |
| 1,3-Butanediol,2-(2-butenyl)-2-methyl- | 92207-83-5 |
| 1,3-Butanediol,2-(3-methyl-2-butenyl)- | 98955-19-2 |
| 1,3-Butanediol,2-ethyl-2-(2-propenyl)- | 122761-93-7 |
| 1,3-Butanediol,2-methyl-2-(1-methyl-2-propenyl)- | 141585-58-2 |
| 1,4-Butanediol,2,3-bis(1-methylethylidene)- | 52127-63-6 |
| 1,4-Butanediol,2-(3-methyl-2-butenyl)-3-methylene- | 115895-78-8 |
| 2-Butene-1,4-diol,2-(1,1-dimethylpropyl)- | 91154-01-7 |
| 2-Butene-1,4-diol,2-(1-methylpropyl)- | 91154-00-6 |
| 2-Butene-1,4-diol,2-butyl- | 153943-66-9 |
| 1,3-Pentanediol,2-ethenyl-3-ethyl- | 104683-37-6 |
| 1,3-Pentanediol,2-ethenyl-4,4-dimethyl- | 143447-08-9 |
| 1,4-Pentanediol,3-methyl-2-(2-propenyl)- | 139301-86-3 |
| 1,5-Pentanediol,2-(1-propenyl)- | 84143-44-2 |
| 1,5-Pentanediol,2-(2-propenyl)- | 134757-01-0 |
| 1,5-Pentanediol,2-ethylidene-3-methyl- | 42178-93-8 |
| 1,5-Pentanediol,2-propylidene- | 58203-50-2 |
| 2,4-Pentanediol,3-ethylidene-2,4-dimethyl- | 88610-19-9 |
| 4-Pentene-1,3-diol,2-(1,1-dimethylethyl)- | 109788-04-7 |
| 4-Pentene-1,3-diol,2-ethyl-2,3-dimethyl- | 90676-97-4 |
| 1,4-Hexanediol,4-ethyl-2-methylene- | 66950-87-6 |
| 1,5-Hexadiene-3,4-diol,2,3,5-trimethyl- | 18984-03-7 |
| 1,5-Hexadiene-3,4-diol,5-ethyl-3-methyl- | 18927-12-3 |
| 1,5-Hexanediol,2-(1-methylethenyl)- | 96802-18-5 |
| 1,6-Hexanediol,2-ethenyl- | 66747-31-7 |
| 1-Hexene-3,4-diol,5,5-dimethyl- | 169736-29-2 |
| 1-Hexene-3,4-diol,5,5-dimethyl- | 120191-04-0 |
| 2-Hexene-1,5-diol,4-ethenyl-2,5-dimethyl- | 70101-76-7 |
| 3-Hexene-1,6-diol,2-ethenyl-2,5-dimethyl- | 112763-52-7 |
| 3-Hexene-1,6-diol,2-ethyl- | 84143-45-3 |
| 3-Hexene-1,6-diol,3,4-dimethyl- | 125032-66-8 |
| 4-Hexene-2,3-diol,2,5-dimethyl- | 13295-61-9 |
| 4-Hexene-2,3-diol,3,4-dimethyl- | 135367-17-8 |
| 5-Hexene-1,3-diol,3-(2-propenyl)- | 74693-24-6 |
| 5-Hexene-2,3-diol,2,3-dimethyl- | 154386-00-2 |
| 5-Hexene-2,3-diol,3,4-dimethyl- | 135096-13-8 |
| 5-Hexene-2,3-diol,3,5-dimethyl- | 134626-63-4 |
| 5-Hexene-2,4-diol,3-ethenyl-2,5-dimethyl- | 155751-24-9 |
| 1,4-Heptanediol,6-methyl-5-methylene- | 100590-29-2 |
| 1,5-Heptadiene-3,4-diol,2,3-dimethyl- | 18927-06-5 |
| 1,5-Heptadiene-3,4-diol,2,5-dimethyl- | 22607-16-5 |
| 1,5-Heptadiene-3,4-diol,3,5-dimethyl- | 18938-51-7 |
| 1,7-Heptanediol,2,6-bis(methylene)- | 139618-24-9 |
| 1,7-Heptanediol,4-methylene- | 71370-08-6 |
| 1-Heptene-3,5-diol,2,4-dimethyl- | 155932-77-7 |
| 1-Heptene-3,5-diol,2,6-dimethyl- | 132157-35-8 |
| 1-Heptene-3,5-diol,3-ethenyl-5-methyl | 61841-10-9 |
| 1-Heptene-3,5-diol,6,6-dimethyl- | 109788-01-4 |
| 2,4-Heptadiene-2,6-diol,4,6-dimethyl- | 102605-95-8 |
| 2,5-Heptadiene-1,7-diol,4,4-dimethyl- | 162816-19-5 |
| 2,6-Heptadiene-1,4-diol,2,5,5-trimethyl- | 115346-30-0 |
| 2-Heptene-1,4-diol,5,6-dimethyl- | 103867-76-1 |
| 2-Heptene-1,5-diol,5-ethyl- | 104683-39-8 |
| 2-Heptene-1,7-diol,2-methyl- | 74868-68-1 |
| 3-Heptene-1,5-diol,4,6-dimethyl- | 147028-45-3 |
| 3-Heptene-1,7-diol,3-methyl-6-methylene- | 109750-55-2 |
| 3-Heptene-2,5-diol,2,4-dimethyl- | 98955-40-9 |
| 3-Heptene-2,5-diol,2,5-dimethyl- | 24459-23-2 |
| 3-Heptene-2,6-diol,2,6-dimethyl- | 160524-66-3 |
| 3-Heptene-2,6-diol,4,6-dimethyl- | 59502-66-8 |
| 5-Heptene-1,3-diol,2,4-dimethyl- | 123363-69-9 |
| 5-Heptene-1,3-diol,3,6-dimethyl- | 96924-52-6 |
| 5-Heptene-1,4-diol,2,6-dimethyl- | 106777-98-4 |
| 5-Heptene-1,4-diol,3,6-dimethyl- | 106777-99-5 |
| 5-Heptene-2,4-diol,2,3-dimethyl- | 104651-56-1 |
| 6-Heptene-1,3-diol,2,2-dimethyl- | 140192-39-8 |

TABLE X-continued

| EXAMPLES OF UNSATURATED COMPOUNDS | |
|---|---|
| 6-Heptene-1,4-diol,4-(2-propenyl)- | 1727-87-3 |
| 6-Heptene-1,4-diol,5,6-dimethyl- | 152344-16-6 |
| 6-Heptene-1,5-diol,2,4-dimethyl- | 74231-27-9 |
| 6-Heptene-1,5-diol,2-ethylidene-6-methyl- | 91139-73-0 |
| 6-Heptene-2,4-diol,4-(2-propenyl)- | 101536-75-8 |
| 6-Heptene-2,4-diol,5,5-dimethyl- | 98753-77-6 |
| 6-Heptene-2,5-diol,4,6-dimethyl- | 134876-94-1 |
| 6-Heptene-2,5-diol,5-ethenyl-4-methyl- | 65757-31-5 |
| 1,3-Octanediol,2-methylene- | 108086-78-8 |
| 1,6-Octadiene-3,5-diol,2,6-dimethyl- | 91140-06-6 |
| 1,6-Octadiene-3,5-diol,3,7-dimethyl- | 75654-19-2 |
| 1,7-Octadiene-3,6-diol,2,6-dimethyl- | 51276-33-6 |
| 1,7-Octadiene-3,6-diol,2,7-dimethyl- | 26947-10-4 |
| 1,7-Octadiene-3,6-diol,3,6-dimethyl- | 31354-73-1 |
| 1-Octene-3,6-diol,3-ethenyl- | 65757-34-8 |
| 2,4,6-Octatriene-1,8-diol,2,7-dimethyl- | 162648-63-7 |
| 2,4-Octadiene-1,7-diol,3,7-dimethyl- | 136054-24-5 |
| 2,5-Octadiene-1,7-diol,2,6-dimethyl- | 91140-07-7 |
| 2,5-Octadiene-1,7-diol,3,7-dimethyl- | 117935-59-8 |
| 2,6-Octadiene-1,4-diol,3,7-dimethyl-(Rosiridol) | 101391-01-9 |
| 2,6-Octadiene-1,8-diol,2-methyl- | 149112-02-7 |
| 2,7-Octadiene-1,4-diol,3,7-dimethyl- | 91140-08-8 |
| 2,7-Octadiene-1,5-diol,2,6-dimethyl- | 91140-09-9 |
| 2,7-Octadiene-1,6-diol,2,6-dimethyl-(8-Hydroxylinalool) | 103619-06-3 |
| 2,7-Octadiene-1,6-diol,2,7-dimethyl- | 60250-14-8 |
| 2-Octene-1,4-diol | 40735-15-7 |
| 2-Octene-1,7-diol | 73842-95-2 |
| 2-Octene-1,7-diol,2-methyl-6-methylene- | 91140-16-8 |
| 3,5-Octadiene-1,7-diol,3,7-dimethyl- | 62875-09-6 |
| 3,5-Octadiene-2,7-diol,2,7-dimethyl- | 7177-18-6 |
| 3,5-Octanediol,4-methylene- | 143233-15-2 |
| 3,7-Octadiene-1,6-diol,2,6-dimethyl- | 127446-29-1 |
| 3,7-Octadiene-2,5-diol,2,7-dimethyl- | 171436-39-8 |
| 3,7-Octadiene-2,6-diol,2,6-dimethyl- | 150283-67-3 |
| 3-Octene-1,5-diol,4-methyl- | 147028-43-1 |
| 3-Octene-1,5-diol,5-methyl- | 19764-77-3 |
| 4,6-Octadiene-1,3-diol,2,2-dimethyl- | 39824-01-6 |
| 4,7-Octadiene-2,3-diol,2,6-dimethyl- | 51117-38-5 |
| 4,7-Octadiene-2,6-diol,2,6-dimethyl- | 59076-71-0 |
| 4-Octene-1,6-diol,7-methyl- | 84538-24-9 |
| 4-Octene-1,8-diol,2,7-bis(methylene)- | 109750-56-3 |
| 4-Octene-1,8-diol,2-methylene- | 109750-58-5 |
| 5,7-Octadiene-1,4-diol,2,7-dimethyl- | 105676-78-6 |
| 5,7-Octadiene-1,4-diol,7-methyl- | 105676-80-0 |
| 5-Octene-1,3-diol | 130272-38-7 |
| 6-Octene-1,3-diol,7-methyl- | 110971-19-2 |
| 6-Octene-1,4-diol,7-methyl- | 152715-87-2 |
| 6-Octene-1,5-diol | 145623-79-6 |
| 6-Octene-1,5-diol,7-methyl- | 116214-61-0 |
| 6-Octene-3,5-diol,2-methyl- | 65534-66-9 |
| 6-Octene-3,5-diol,4-methyl- | 156414-25-4 |
| 7-Octene-1,3-diol,2-methyl- | 155295-38-8 |
| 7-Octene-1,3-diol,4-methyl- | 142459-25-4 |
| 7-Octene-1,3-diol,7-methyl- | 132130-96-2 |
| 7-Octene-1,5-diol | 7310-51-2 |
| 7-Octene-1,6-diol | 159099-43-1 |
| 7-Octene-1,6-diol,5-methyl- | 144880-56-8 |
| 7-Octene-2,4-diol,2-methyl-6-methylene- | 72446-81-2 |
| 7-Octene-2,5-diol,7-methyl- | 152344-12-2 |
| 7-Octene-3,5-diol,2-methyl- | 98753-85-6 |
| 1-Nonene-3,5-diol | 119554-56-2 |
| 1-Nonene-3,7-diol | 23866-97-9 |
| 3-Nonene-2,5-diol | 165746-84-9 |
| 4,6-Nonadiene-1,3-diol,8-methyl- | 124099-52-1 |
| 4-Nonene-2,8-diol | 154600-80-3 |
| 6,8-Nonadiene-1,5-diol | 108586-03-4 |
| 7-Nonene-2,4-diol | 30625-41-3 |
| 8-Nonene-2,4-diol | 119785-59-0 |
| 8-Nonene-2,5-diol | 132381-58-9 |
| 1,9-Decadiene-3,8-diol | 103984-04-9 |
| 1,9-Decadiene-4,6-diol | 138835-67-3 |
| Preferred Unsaturated Diols | |
| 1,3-Butanediol,2,2-diallyl- | 103985-49-5 |
| 1,3-Butanediol,2-(1-ethyl-1-propenyl)- | 116103-35-6 |
| 1,3-Butanediol,2-(2-butenyl)-2-methyl- | 92207-83-5 |
| 1,3-Butanediol,2-(3-methyl-2-butenyl)- | 98955-19-2 |

TABLE X-continued

| EXAMPLES OF UNSATURATED COMPOUNDS | |
|---|---|
| 1,3-Butanediol,2-ethyl-2-(2-propenyl)- | 122761-93-7 |
| 1,3-Butanediol,2-methyl-2-(1-methyl-2-propenyl)- | 141585-58-2 |
| 1,4-Butanediol,2,3-bis(1-methylethylidene)- | 52127-63-6 |
| 1,3-Pentanediol,2-ethenyl-3-ethyl- | 104683-37-6 |
| 1,3-Pentanediol,2-ethenyl-4,4-dimethyl- | 143447-08-9 |
| 1,4-Pentanediol,3-methyl-2-(2-propenyl)- | 139301-86-3 |
| 4-Pentene-1,3-diol,2-(1,1-dimethylethyl)- | 109788-04-7 |
| 4-Pentene-1,3-diol,2-ethyl-2,3-dimethyl- | 90676-97-4 |
| 1,4-Hexanediol,4-ethyl-2-methylene- | 66950-87-6 |
| 1,5-Hexadiene-3,4-diol,2,3,5-trimethyl- | 18984-03-7 |
| 1,5-Hexanediol,2-(1-methylethenyl)- | 96802-18-5 |
| 2-Hexene-1,5-diol,4-ethenyl-2,5-dimethyl- | 70101-76-7 |
| 1,4-Heptanediol,6-methyl-5-methylene- | 100590-29-2 |
| 2,4-Heptadiene-2,6-diol,4,6-dimethyl- | 102605-95-8 |
| 2,6-Heptadiene-1,4-diol,2,5,5-trimethyl- | 115346-30-0 |
| 2-Heptene-1,4-diol,5,6-dimethyl- | 103867-76-1 |
| 3-Heptene-1,5-diol,4,6-dimethyl- | 147028-45-3 |
| 5-Heptene-1,3-diol,2,4-dimethyl- | 123363-69-9 |
| 5-Heptene-1,3-diol,3,6-dimethyl- | 96924-52-6 |
| 5-Heptene-1,4-diol,2,6-dimethyl- | 106777-98-4 |
| 5-Heptene-1,4-diol,3,6-dimethyl- | 106777-99-5 |
| 6-Heptene-1,3-diol,2,2-dimethyl- | 140192-39-8 |
| 6-Heptene-1,4-diol,5,6-dimethyl- | 152344-16-6 |
| 6-Heptene-1,5-diol,2,4-dimethyl- | 74231-27-9 |
| 6-Heptene-1,5-diol,2-ethylidene-6-methyl- | 91139-73-0 |
| 6-Heptene-2,4-dial,4-(2-propenyl)- | 101536-75-8 |
| 1-Octene-3,6-diol,3-ethenyl- | 65757-34-8 |
| 2,4,6-Octatriene-1,8-diol,2,7-dimethyl- | 162648-63-7 |
| 2,5-Octadiene-1,7-diol,2,6-dimethyl- | 91140-07-7 |
| 2,5-Octadiene-1,7-diol,3,7-dimethyl- | 117935-59-8 |
| 2,6-Octadiene-1,4-diol,3,7-dimethyl-(Rosiridol) | 101391-01-9 |
| 2,6-Octadiene-1,8-diol,2-methyl- | 149112-02-7 |
| 2,7-Octadiene-1,4-diol,3,7-dimethyl- | 91140-08-8 |
| 2,7-Octadiene-1,5-diol,2,6-dimethyl- | 91140-09-9 |
| 2,7-Octadiene-1,6-diol,2,6-dimethyl-(8-Hydroxylinalool) | 103619-06-3 |
| 2,7-Octadiene-1,6-diol,2,7-dimethyl- | 60250-14-8 |
| 2-Octene-1,7-diol,2-methyl-6-methylene- | 91140-16-8 |
| 3,5-Octadiene-2,7-diol,2,7-dimethyl- | 7177-18-6 |
| 3,5-Octanediol,4-methylene- | 143233-15-2 |
| 3,7-Octadiene-1,6-diol,2,6-dimethyl- | 127446-29-1 |
| 4-Octene-1,8-diol,2-methylene- | 109750-58-5 |
| 6-Octene-3,5-diol,2-methyl- | 65534-66-9 |
| 6-Octene-3,5-diol,4-methyl- | 156414-25-4 |
| 7-Octene-2,4-diol,2-methyl-6-methylene- | 72446-81-2 |
| 7-Octene-2,5-diol,7-methyl- | 152344-12-2 |
| 7-Octene-3,5-diol,2-methyl- | 98753-85-6 |
| 1-Nonene-3,5-diol | 119554-56-2 |
| 1-Nonene-3,7-diol | 23866-97-9 |
| 3-Nonene-2,5-diol | 165746-84-9 |
| 4-Nonene-2,8-diol | 154600-80-3 |
| 6,8-Nonadiene-1,5-diol | 108586-03-4 |
| 7-Nonene-2,4-diol | 30625-41-3 |
| 8-Nonene-2,4-diol | 119785-59-0 |
| 8-Nonene-2,5-diol | 132381-58-9 |
| 1,9-Decadiene-3,8-diol | 103984-04-9 |
| 1,9-Decadiene-4,6-diol | 138835-67-3 |
| ; and | |

XI. mixtures thereof.

It is found that some principal solvents which have two hydroxyl groups in their chemical formulas are suitable for use in the formulation of the liquid concentrated, clear fabric softener compositions of this invention. It is discovered that the suitability of each principal solvent is surprisingly very selective, dependent on the number of carbon atoms, the isomeric configuration of the molecules having the same number of carbon atoms, the degree of unsaturation, etc. Principal solvents with similar solubility characteristics to the principal solvents above and possessing at least some asymmetry will provide the same benefit. It is discovered that the suitable principal solvents have a ClogP of from about 0.15 to about 0.64, preferably from about 0.25 to about 0.62, and more preferably from about 0.40 to about 0.60.

Although there are many $C_6$ diols that are possible isomers, only the ones listed above are suitable for making clear products and only: 1,2-butanediol, 2,3-dimethyl-; 1,2-butanediol, 3,3-dimethyl-; 2,3-pentanediol, 2-methyl-; 2,3-pentanediol, 3-methyl-; 2,3-pentanediol, 4-methyl-; 2,3-hexanediol; 3,4-hexanediol; 1,2-butanediol, 2-ethyl-; 1,2-pentanediol, 2-methyl-; 1,2-pentanediol, 3-methyl-; 1,2-pentanediol, 4-methyl-; and 1,2-hexanediol are preferred, of which the most preferred are: 1,2-butanediol, 2-ethyl-; 1,2-pentanediol, 2-methyl-; 1,2-pentanediol, 3-methyl-; 1,2-pentanediol, 4-methyl-; and 1,2-hexanediol.

There are more possible $C_7$ diol isomers, but only the listed ones provide clear products and the preferred ones are: 1,3-butanediol, 2-butyl-; 1,4-butanediol, 2-propyl-; 1,5-pentanediol, 2-ethyl-; 2,3-pentanediol, 2,3-dimethyl-; 2,3-pentanediol, 2,4-dimethyl-; 2,3-pentanediol, 4,4-dimethyl-; 3,4-pentanediol, 2,3-dimethyl-; 1,6-hexanediol, 2-methyl-; 1,6-hexanediol, 3-methyl-; 1,3-heptanediol; 1,4-heptanediol; 1,5-heptanediol; 1,6-heptanediol; of which the most preferred are: 2,3-pentanediol, 2,3-dimethyl-; 2,3-pentanediol, 2,4-dimethyl-; 2,3-pentanediol, 3,4-dimethyl-; 2,3-pentanediol, 4,4-dimethyl-; and 3,4-pentanediol, 2,3-dimethyl-.

Similarly, there are even more $C_8$ diol isomers, but only the listed ones provide clear products and the preferred ones are: 1,3-propanediol, 2-(1,1-dimethylpropyl)-; 1,3-propanediol, 2-(1,2-dimethylpropyl)-; 1,3-propanediol, 2-(1-ethylpropyl)-; 1,3-propanediol, 2-(2,2-dimethylpropyl)-; 1,3-propanediol, 2-ethyl-2-isopropyl-; 1,3-propanediol, 2-methyl-2-(1-methylpropyl)-; 1,3-propanediol, 2-methyl-2-(2-methylpropyl)-; 1,3-propanediol, 2-tertiary-butyl-2-methyl-; 1,3-butanediol, 2,2-diethyl; 1,3-butanediol, 2-(1-methylpropyl)-; 1,3-butanediol, 2-butyl-; 1,3-butanediol, 2-ethyl-2,3-dimethyl-; 1,3-butanediol, 2-(1,1-dimethylethyl)-; 1,3-butanediol, 2-(2-methylpropyl)-; 1,3-butanediol, 2-methyl-2-propyl-; 1,3-butanediol, 2-methyl-2-isopropyl-; 1,3-butanediol, 3-methyl-2-propyl-; 1,4-butanediol, 2,2-diethyl-; 1,4-butanediol, 2-ethyl-2,3-dimethyl-; 1,4-butanediol, 2-ethyl-3,3-dimethyl-; 1,4-butanediol, 2-(1,1-dimethylethyl)-; 1,4-butanediol, 3-methyl-2-isopropyl-; 1,3-pentanediol, 2,2,3-trimethyl-; 1,3-pentanediol, 2,2,4-trimethyl-; 1,3-pentanediol, 2,3,4-trimethyl-; 1,3-pentanediol, 2,4,4-trimethyl-; 1,3-pentanediol, 3,4,4-trimethyl-; 1,4-pentanediol, 2,2,3-trimethyl-; 1,4-pentanediol, 2,2,4-trimethyl-; 1,4-pentanediol, 2,3,3-trimethyl-; 1,4-pentanediol, 2,3,4-trimethyl-; 1,4-pentanediol, 3,3,4-trimethyl-; 1,5-pentanediol, 2,2,3-trimethyl-; 1,5-pentanediol, 2,2,4-trimethyl-; 1,5-pentanediol, 2,3,3-trimethyl-; 2,4-pentanediol, 2,3,4-trimethyl-; 1,3-pentanediol, 2-ethyl-2-methyl-; 1,3-pentanediol, 2-ethyl-3-methyl-; 1,3-pentanediol, 2-ethyl-4-methyl-; 1,3-pentanediol, 3-ethyl-2-methyl-; 1,4-pentanediol, 2-ethyl-2-methyl-; 1,4-pentanediol, 2-ethyl-3-methyl-; 1,4-pentanediol, 2-ethyl-4-methyl-; 1,5-pentanediol, 3-ethyl-3-methyl-; 2,4-pentanediol, 3-ethyl-2-methyl-; 1,3-pentanediol, 2-isopropyl-; 1,3-pentanediol, 2-propyl-; 1,4-pentanediol, 2-isopropyl-; 1,4-pentanediol, 2-propyl-; 1,4-pentanediol, 3-isopropyl-; 2,4-pentanediol, 3-propyl-; 1,3-hexanediol, 2,2-dimethyl-; 1,3-hexanediol, 2,3-dimethyl-; 1,3-hexanediol, 2,4-dimethyl-; 1,3-hexanediol, 2,5-dimethyl-; 1,3-hexanediol, 3,4-dimethyl-; 1,3-hexanediol, 3,5-dimethyl-; 1,3-hexanediol, 4,4-dimethyl-; 1,3-hexanediol, 4,5-dimethyl-; 1,4-hexanediol, 2,2-dimethyl-; 1,4-hexanediol, 2,3-dimethyl-; 1,4-hexanediol, 2,4-dimethyl-; 1,4-hexanediol, 2,5-dimethyl-; 1,4-hexanediol, 3,3-dimethyl-; 1,4-hexanediol, 3,4-dimethyl-; 1,4-hexanediol, 3,5-dimethyl-; 1,4-hexanediol, 4,5-dimethyl-; 1,4-hexanediol, 5,5-dimethyl-; 1,5-hexanediol, 2,2-dimethyl-;

1,5-hexanediol, 2,3-dimethyl-; 1,5-hexanediol, 2,4-dimethyl-; 1,5-hexanediol, 2,5-dimethyl-; 1,5-hexanediol, 3,3-dimethyl-; 1,5-hexanediol, 3,4-dimethyl-; 1,5-hexanediol, 3,5-dimethyl-; 1,5-hexanediol, 4,5-dimethyl-; 2,6-hexanediol, 3,3-dimethyl-; 1,3-hexanediol, 2-ethyl-; 1,3-hexanediol, 4-ethyl-; 1,4-hexanediol, 2-ethyl-; 1,4-hexanediol, 4-ethyl-; 1,5-hexanediol, 2-ethyl-; 2,4-hexanediol, 3-ethyl-; 2,4-hexanediol, 4-ethyl-; 2,5-hexanediol, 3-ethyl-; 1,3-heptanediol, 2-methyl-; 1,3-heptanediol, 3-methyl-; 1,3-heptanediol, 4-methyl-; 1,3-heptanediol, 5-methyl-; 1,3-heptanediol, 6-methyl-; 1,4-heptanediol, 2-methyl-; 1,4-heptanediol, 3-methyl-; 1,4-heptanediol, 4-methyl-; 1,4-heptanediol, 5-methyl-; 1,4-heptanediol, 6-methyl-; 1,5-heptanediol, 2-methyl-; 1,5-heptanediol, 3-methyl-; 1,5-heptanediol, 4-methyl-; 1,5-heptanediol, 5-methyl-; 1,5-heptanediol, 6-methyl-; 1,6-heptanediol, 2-methyl-; 1,6-heptanediol, 3-methyl-; 1,6-heptanediol, 4-methyl-; 1,6-heptanediol, 5-methyl-; 1,6-heptanediol, 6-methyl-; 2,4-heptanediol, 2-methyl-; 2,4-heptanediol, 3-methyl-; 2,4-heptanediol, 4-methyl-; 2,4-heptanediol, 5-methyl-; 2,4-heptanediol, 6-methyl-; 2,5-heptanediol, 2-methyl-; 2,5-heptanediol, 3-methyl-; 2,5-heptanediol, 4-methyl-; 2,5-heptanediol, 5-methyl-; 2,5-heptanediol, 6-methyl-; 2,6-heptanediol, 2-methyl-; 2,6-heptanediol, 3-methyl-; 2,6-heptanediol, 4-methyl-; 3,4-heptanediol, 3-methyl-; 3,5-heptanediol, 2-methyl-; 3,5-heptanediol, 4-methyl-; 2,4-octanediol; 2,5-octanediol; 2,6-octanediol; 2,7-octanediol; 3,5-octanediol; and/or 3,6-octanediol of which the following are the most preferred: 1,3-propanediol, 2-(1,1-dimethylpropyl)-; 1,3-propanediol, 2-(1,2-dimethylpropyl)-; 1,3-propanediol, 2-(1-ethylpropyl)-; 1,3-propanediol, 2-ethyl-2-isopropyl-; 1,3-propanediol, 2-methyl-2-(1-methylpropyl)-; 1,3-propanediol, 2-methyl-2-(2-methylpropyl)-; 1,3-propanediol, 2-tertiary-butyl-2-methyl-; 1,3-butanediol, 2-(1-methylpropyl)-; 1,3-butanediol, 2-(2-methylpropyl)-; 1,3-butanediol, 2-butyl-; 1,3-butanediol, 2-methyl-2-propyl-; 1,3-butanediol, 3-methyl-2-propyl-; 1,4-butanediol, 2,2-diethyl-; 1,4-butanediol, 2-ethyl-2,3-dimethyl-; 1,4-butanediol, 2-ethyl-3,3-dimethyl-; 1,4-butanediol, 2-(1,1-dimethylethyl)-; 1,3-pentanediol, 2,3,4-trimethyl-; 1,5-pentanediol, 2,2,3-trimethyl-; 1,5-pentanediol, 2,2,4-trimethyl-; 1,5-pentanediol, 2,3,3-trimethyl-; 1,3-pentanediol, 2-ethyl-2-methyl-; 1,3-pentanediol, 2-ethyl-3-methyl-; 1,3-pentanediol, 2-ethyl-4-methyl-; 1,3-pentanediol, 3-ethyl-2-methyl-; 1,4-pentanediol, 2-ethyl-2-methyl-; 1,4-pentanediol, 2-ethyl-3-methyl-; 1,4-pentanediol, 2-ethyl-4-methyl-; 1,5-pentanediol, 3-ethyl-3-methyl-; 2,4-pentanediol, 3-ethyl-2-methyl-; 1,3-pentanediol, 2-isopropyl-; 1,3-pentanediol, 2-propyl-; 1,4-pentanediol, 2-isopropyl-; 1,4-pentanediol, 2-propyl-; 1,4-pentanediol, 3-isopropyl-; 2,4-pentanediol, 3-propyl-; 1,3-hexanediol, 2,2-dimethyl-; 1,3-hexanediol, 2,3-dimethyl-; 1,3-hexanediol, 2,4-dimethyl-; 1,3-hexanediol, 2,5-dimethyl-; 1,3-hexanediol, 3,4-dimethyl-; 1,3-hexanediol, 3,5-dimethyl-; 1,3-hexanediol, 4,4-dimethyl-; 1,3-hexanediol, 4,5-dimethyl-; 1,4-hexanediol, 2,2-dimethyl-; 1,4-hexanediol, 2,3-dimethyl-; 1,4-hexanediol, 2,4-dimethyl-; 1,4-hexanediol, 2,5-dimethyl-; 1,4-hexanediol, 3,3-dimethyl-; 1,4-hexanediol, 3,4-dimethyl-; 1,4-hexanediol, 3,5-dimethyl-; 1,4-hexanediol, 4,5-dimethyl-; 1,4-hexanediol, 5,5-dimethyl-; 1,5-hexanediol, 2,2-dimethyl-; 1,5-hexanediol, 2,3-dimethyl-; 1,5-hexanediol, 2,4-dimethyl-; 1,5-hexanediol, 2,5-dimethyl-; 1,5-hexanediol, 3,3-dimethyl-; 1,5-hexanediol, 3,4-dimethyl-; 1,5-hexanediol, 3,5-dimethyl-; 1,5-hexanediol, 4,5-dimethyl-; 2,6-hexanediol, 3,3-dimethyl-; 1,3-hexanediol, 2-ethyl-; 1,3-hexanediol, 4-ethyl-; 1,4-hexanediol, 2-ethyl-1,4-hexanediol, 4-ethyl-; 1,5-hexanediol, 2-ethyl-; 2,4-hexanediol, 3-ethyl-; 2,4-hexanediol, 4-ethyl-; 2,5-hexanediol, 3-ethyl-; 1,3-heptanediol, 2-methyl-; 1,3-heptanediol, 3-methyl-; 1,3-heptanediol, 4-methyl-; 1,3-heptanediol, 5-methyl-; 1,3-heptanediol, 6-methyl-; 1,4-heptanediol, 2-methyl-; 1,4-heptanediol, 3-methyl-; 1,4-heptanediol, 4-methyl-; 1,4-heptanediol, 5-methyl-; 1,4-heptanediol, 6-methyl-; 1,5-heptanediol, 2-methyl-; 1,5-heptanediol, 3-methyl-; 1,5-heptanediol, 4-methyl-; 1,5-heptanediol, 5-methyl-; 1,5-heptanediol, 6-methyl-; 1,6-heptanediol, 2-methyl-; 1,6-heptanediol, 3-methyl-; 1,6-heptanediol, 4-methyl-; 1,6-heptanediol, 5-methyl-; 1,6-heptanediol, 6-methyl-; 2,4-heptanediol, 2-methyl-; 2,4-heptanediol, 3-methyl-; 2,4-heptanediol, 4-methyl-; 2,4-heptanediol, 5-methyl-; 2,4-heptanediol, 6-methyl-; 2,5-heptanediol, 2-methyl-; 2,5-heptanediol, 3-methyl-; 2,5-heptanediol, 4-methyl-; 2,5-heptanediol, 5-methyl-; 2,5-heptanediol, 6-methyl-; 2,6-heptanediol, 2-methyl-; 2,6-heptanediol, 3-methyl-; 2,6-heptanediol, 4-methyl-; 3,4-heptanediol, 3-methyl-; 3,5-heptanediol, 2-methyl-; 3,5-heptanediol, 4-methyl-; 2,4-octanediol; 2,5-octanediol; 2,6-octanediol; 2,7-octanediol; 3,5-octanediol; and/or 3,6-octanediol.

The formulatability, and other properties, such as odor, fluidity, melting point lowering, etc., of some $C_{6-8}$ diols listed above in Tables II–IV which are not preferred, can be improved by polyalkoxylation. Also, some of the $C_{3-5}$ diols which are alkoxylated are preferred. Preferred alkoxylated derivatives of the above $C_{3-8}$ diols [In the following disclosure, "EO" means polyethoxylates, "En" means —$(CH_2CH_2O)_nH$; Me-En means methyl-capped polyethoxylates —$(CH_2CH_2O)_nCH_3$;"2(Me-En)" means 2 Me-En groups needed; "PO" means polypropoxylates, —$(CH(CH_3)CH_2O)_nH$; "BO" means polybutyleneoxy groups, $(CH(CH_2CH_3)CH_2O)_nH$; and "n-BO" means poly(n-butyleneoxy) groups —$(CH_2CH_2CH_2CH_2O)_nH$.] include:

1. 1,2-propanediol (C3) 2(Me-$E_{3-4}$); 1,2-propanediol (C3) $PO_4$; 1,2-propanediol, 2-methyl- (C4) (Me-$E_{8-10}$); 1,2-propanediol, 2-methyl- (C4) 2(Me-$E_1$); 1,2-propanediol, 2-methyl- (C4) $PO_3$; 1,3-propanediol (C3) 2(Me-$E_8$); 1,3-propanediol (C3) $PO_6$; 1,3-propanediol, 2,2-diethyl- (C7) $E_{4-7}$; 1,3-propanediol, 2,2-diethyl- (C7) $PO_1$; 1,3-propanediol, 2,2-diethyl- (C7) n-$BO_2$; 1,3-propanediol, 2,2-dimethyl- (C5) 2(Me $E_{1-2}$); 1,3-propanediol, 2,2-dimethyl- (C5) $PO_4$; 1,3-propanediol, 2-(1-methylpropyl)- (C7) $E_{4-7}$; 1,3-propanediol, 2-(1-methylpropyl)- (C7) $PO_1$; 1,3-propanediol, 2-(1-methylpropyl)- (C7) n-$BO_2$; 1,3-propanediol, 2-(2-methylpropyl)- (C7) $E_{4-7}$; 1,3-propanediol, 2-(2-methylpropyl)- (C7) $PO_1$; 1,3-propanediol, 2-(2-methylpropyl)- (C7) n-$BO_2$; 1,3-propanediol, 2-ethyl- (C5) (Me $E_{9-10}$); 1,3-propanediol, 2-ethyl- (C5) 2(Me $E_1$); 1,3-propanediol, 2-ethyl- (C5) $PO_3$; 1,3-propanediol, 2-ethyl-2-methyl- (C6) (Me $E_{3-6}$); 1,3-propanediol, 2-ethyl-2-methyl- (C6) $PO_2$; 1,3-propanediol, 2-ethyl-2-methyl- (C6) $BO_1$; 1,3-propanediol, 2-isopropyl- (C6) (Me $E_{3-6}$); 1,3-propanediol, 2-isopropyl- (C6) $PO_2$; 1,3-propanediol, 2-isopropyl- (C6) $BO_1$; 1,3-propanediol, 2-methyl- (C4) 2(Me $E_{4-5}$); 1,3-propanediol, 2-methyl- (C4) $PO_5$; 1,3-propanediol, 2-methyl- (C4) $BO_2$; 1,3-propanediol, 2-methyl-2-isopropyl- (C7) $E_{6-9}$; 1,3-propanediol, 2-methyl-2-isopropyl- (C7) $PO_1$; 1,3-propanediol, 2-methyl-2-isopropyl- (C7) n-$BO_{2-3}$; 1,3-propanediol, 2-methyl-2-propyl- (C7) $E_{4-7}$; 1,3-propanediol, 2-methyl-2-propyl- (C7) $PO_1$; 1,3-propanediol, 2-methyl-2-propyl- (C7) n-$BO_2$; 1,3-propanediol, 2-propyl- (C6) (Me $E_{1-4}$); 1,3-propanediol, 2-propyl- (C6) $PO_2$;

2. 1,2-butanediol (C4) (Me $E_{6-8}$); 1,2-butanediol (C4) $PO_{2-3}$; 1,2-butanediol (C4) $BO_1$; 1,2-butanediol, 2,3-dimethyl- (C6) $E_{2-5}$; 1,2-butanediol, 2,3-dimethyl- (C6) n-$BO_1$; 1,2-butanediol, 2-ethyl- (C6) $E_{1-3}$; 1,2-butanediol, 2-ethyl- (C6) n-$BO_1$; 1,2-butanediol, 2-methyl- (C5) (Me $E_{1-2}$); 1,2-butanediol, 2-methyl- (C5) $PO_1$; 1,2-butanediol, 3,3-dimethyl- (C6) $E_{2-5}$; 1,2-butanediol, 3,3-dimethyl- (C6) n-BO1; 1,2-butanediol, 3-methyl- (C5) (Me $E_{1-2}$); 1,2-butanediol, 3-methyl- (C5) $PO_1$; 1,3-butanediol (C4) 2(Me $E_{5-6}$); 1,3-butanediol (C4) $BO_2$; 1,3-butanediol, 2,2,3-trimethyl- (C7) (Me $E_{1-3}$); 1,3-butanediol, 2,2,3-trimethyl- (C7) $PO_2$; 1,3-butanediol, 2,2-dimethyl- (C6) (Me $E_{6-8}$); 1,3-butanediol, 2,2-dimethyl- (C6) $PO_3$; 1,3-butanediol, 2,3-dimethyl- (C6) (Me $E_{6-8}$); 1,3-butanediol, 2,3-dimethyl- (C6) $PO_3$; 1,3-butanediol, 2-ethyl- (C6) (Me $E_{4-6}$); 1,3-butanediol, 2-ethyl- (C6) $PO_{2-3}$; 1,3-butanediol, 2-ethyl- (C6) $BO_1$; 1,3-butanediol, 2-ethyl-2-methyl- (C7) (Me $E_1$); 1,3-butanediol, 2-ethyl-2-methyl- (C7) $PO_1$; 1,3-butanediol, 2-ethyl-2-methyl- (C7) n-$BO_3$; 1,3-butanediol, 2-ethyl-3-methyl- (C7) (Me $E_1$); 1,3-butanediol, 2-ethyl-3-methyl- (C7) $PO_1$; 1,3-butanediol, 2-ethyl-3-methyl- (C7) n-$BO_3$; 1,3-butanediol, 2-isopropyl- (C7) (Me $E_1$); 1,3-butanediol, 2-isopropyl- (C7) $PO_1$; 1,3-butanediol, 2-isopropyl- (C7) n-$BO_3$; 1,3-butanediol, 2-methyl- (C5) 2(Me $E_{2-3}$); 1,3-butanediol, 2-methyl- (C5) $PO_4$; 1,3-butanediol, 2-propyl- (C7) $E_{6-8}$; 1,3-butanediol, 2-propyl- (C7) $PO_1$; 1,3-butanediol, 2-propyl- (C7) n-$BO_{2-3}$; 1,3-butanediol, 3-methyl- (C5) 2(Me $E_{2-3}$); 1,3-butanediol, 3-methyl- (C5) $PO_4$; 1,4-butanediol (C4) 2(Me $E_{3-4}$); 1,4-butanediol (C4) $PO_{4-5}$; 1,4-butanediol, 2,2,3-trimethyl- (C7) $E_{6-9}$; 1,4-butanediol, 2,2,3-trimethyl- (C7) $PO_1$; 1,4-butanediol, 2,2,3-trimethyl- (C7) n-$BO_{2-3}$; 1,4-butanediol, 2,2-dimethyl- (C6) (Me $E_{3-6}$); 1,4-butanediol, 2,2-dimethyl- (C6) $PO_2$; 1,4-butanediol, 2,2-dimethyl- (C6) $BO_1$; 1,4-butanediol, 2,3-dimethyl- (C6) (Me $E_{3-6}$); 1,4-butanediol, 2,3-dimethyl- (C6) $PO_2$; 1,4-butanediol, 2,3-dimethyl- (C6) $BO_1$; 1,4-butanediol, 2-ethyl- (C6) (Me $E_{1-4}$); 1,4-butanediol, 2-ethyl- (C6) $PO_2$; 1,4-butanediol, 2-ethyl-2-methyl- (C7) $E_{4-7}$; 1,4-butanediol, 2-ethyl-2-methyl- (C7) $PO_1$; 1,4-butanediol, 2-ethyl-2-methyl- (C7) n-$BO_2$; 1,4-butanediol, 2-ethyl-3-methyl- (C7) $E_{4-7}$; 1,4-butanediol, 2-ethyl-3-methyl- (C7) $PO_1$; 1,4-butanediol, 2-ethyl-3-methyl- (C7) n-$BO_2$; 1,4-butanediol, 2-isopropyl- (C7) $E_{4-7}$; 1,4-butanediol, 2-isopropyl- (C7) $PO_1$; 1,4-butanediol, 2-isopropyl- (C7) n-$BO_2$; 1,4-butanediol, 2-methyl- (C5) (Me $E_{9-10}$); 1,4-butanediol, 2-methyl- (C5) 2(Me $E_1$); 1,4-butanediol, 2-methyl- (C5) $PO_3$; 1,4-butanediol, 2-propyl- (C7) $E_{2-5}$; 1,4-butanediol, 2-propyl- (C7) n-$BO_1$; 1,4-butanediol, 3-ethyl-1-methyl- (C7) $E_{6-8}$; 1,4-butanediol, 3-ethyl-1-methyl- (C7) $PO_1$; 1,4-butanediol, 3-ethyl-1-methyl- (C7) n-$BO_{2-3}$; 2,3-butanediol (C4) (Me $E_{9-10}$); 2,3-butanediol (C4) 2(Me $E_1$); 2,3-butanediol (C4) $PO_{3-4}$; 2,3-butanediol, 2,3-dimethyl- (C6) $E_{7-9}$; 2,3-butanediol, 2,3-dimethyl- (C6) $PO_1$; 2,3-butanediol, 2,3-dimethyl- (C6) $BO_{2-3}$; 2,3-butanediol, 2-methyl- (C5) (Me $E_{2-5}$); 2,3-butanediol, 2-methyl- (C5) $PO_2$; 2,3-butanediol, 2-methyl- (C5) $BO_1$;

3. 1,2-pentanediol (C5) $E_{7-10}$; 1,2-pentanediol, (C5) $PO_1$; 1,2-pentanediol, (C5) n-$BO_3$; 1,2-pentanediol, 2-methyl (C6) $E_{1-3}$; 1,2-pentanediol, 2-methyl (C6) n-$BO_1$; 1,2-pentanediol, 3-methyl (C6) $E_{1-3}$; 1,2-pentanediol, 3-methyl (C6) n-$BO_1$; 1,2-pentanediol, 4-methyl (C6) $E_{1-3}$; 1,2-pentanediol, 4-methyl (C6) n-$BO_1$; 1,3-pentanediol (C5) 2(Me-$E_{1-2}$); 1,3-pentanediol (C5) $PO_{3-4}$; 1,3-pentanediol, 2,2-dimethyl- (C7) (Me-$E_1$); 1,3-pentanediol, 2,2-dimethyl- (C7) $PO_1$; 1,3-pentanediol, 2,2-dimethyl- (C7) n-$BO_3$; 1,3-pentanediol, 2,3-dimethyl- (C7) (Me-$E_1$); 1,3-pentanediol, 2,3-dimethyl- (C7) $PO_1$; 1,3-pentanediol, 2,3-dimethyl- (C7) n-$BO_3$; 1,3-pentanediol, 2,4-dimethyl- (C7) $PO_1$; 1,3-pentanediol, 2,3-dimethyl- (C7) n-$BO_3$; 1,3-pentanediol, 2,4-dimethyl- (C7) (Me-$E_1$); 1,3-pentanediol, 2,4-dimethyl- (C7) $PO_1$; 1,3-pentanediol, 2,4-dimethyl- (C7) n-$BO_3$; 1,3-pentanediol, 2-ethyl- (C7) $E_{6-8}$; 1,3-pentanediol, 2-ethyl- (C7) $PO_1$; 1,3-pentanediol, 2-ethyl- (C7) n-$BO_{2-3}$; 1,3-pentanediol, 2-methyl- (C6) 2(Me-$E_{4-6}$); 1,3-pentanediol, 2-methyl- (C6) $PO_{2-3}$; 1,3-pentanediol, 3,4-dimethyl- (C7) (Me-$E_1$); 1,3-pentanediol, 3,4-dimethyl- (C7) $PO_1$; 1,3-pentanediol, 3,4-dimethyl- (C7) n-$BO_3$; 1,3-pentanediol, 3-methyl- (C6) 2(Me-$E_{4-6}$); 1,3-pentanediol, 3-methyl- (C6) $PO_{2-3}$; 1,3-pentanediol, 4,4-dimethyl- (C7) (Me-$E_1$); 1,3-pentanediol, 4,4-dimethyl- (C7) $PO_1$; 1,3-pentanediol, 4,4-dimethyl- (C7) n-$BO_3$; 1,3-pentanediol, 4-methyl- (C6) 2(Me-$E_{4-6}$); 1,3-pentanediol, 4-methyl- (C6) $PO_{2-3}$; 1,4-pentanediol, (C5) 2(Me-$E_{1-2}$); 1,4-pentanediol (C5) $PO_{3-4}$; 1,4-pentanediol, 2,2-dimethyl- (C7) (Me-E1); 1,4-pentanediol, 1,4-pentanediol (C5) $PO_{3-4}$; 1,4-pentanediol, 2,2-dimethyl- (C7) (Me-E1); 1,4-pentanediol, 2,2-dimethyl- (C7) $PO_1$; 1,4-pentanediol, 2,2-dimethyl- (C7) n-$BO_3$; 1,4-pentanediol, 2,3-dimethyl- (C7) (Me-$E_1$); 1,4-pentanediol, 2,3-dimethyl- (C7) $PO_1$; 1,4-pentanediol, 2,3-dimethyl- (C7) n-$BO_3$; 1,4-pentanediol, 2,4-dimethyl- (C7) (Me-$E_1$); 1,4-pentanediol, 2,4-dimethyl- (C7) $PO_1$; 1,4-pentanediol, 2,4-dimethyl- (C7) n-$BO_3$; 1,4-pentanediol, 2-methyl- (C6) (Me-$E_{4-6}$); 1,4-pentanediol, 2-methyl- (C6) $PO_{2-3}$; 1,4-pentanediol, 3,3-dimethyl- (C7) (Me-$E_1$); 1,4-pentanediol, 3,3-dimethyl- (C7) $PO_1$; 1,4-pentanediol, 3,3-dimethyl- (C7) n-$BO_3$; 1,4-pentanediol, 3,4-dimethyl- (C7) (Me-$E_1$); 1,4-pentanediol, 3,4-dimethyl- (C7) $PO_1$; 1,4-pentanediol, 3,4-dimethyl- (C7) n-$BO_3$; 1,4-pentanediol, 4-methyl- (C6) 2(Me-$E_{4-6}$); 1,4-pentanediol, 4-methyl- (C6) $PO_{2-3}$; 1,5-pentanediol, (C5) (Me-$E_{8-10}$); 1,5-pentanediol (C5) 2(Me-$E_1$); 1,5-pentanediol (C5) $PO_3$; 1,5-pentanediol, 2,2-dimethyl- (C7) $E_{4-7}$; 1,5-pentanediol, 2,2-dimethyl- (C7) $PO_1$; 1,5-pentanediol, 2,2-dimethyl- (C7) n-$BO_2$; 1,5-pentanediol, 2,3-dimethyl- (C7) $E_{4-7}$; 1,5-pentanediol, 2,3-dimethyl- (C7) $PO_1$; 1,5-pentanediol, 2,3-dimethyl- (C7) n-$BO_2$; 1,5-pentanediol, 2,4-dimethyl- (C7) $E_{4-7}$; 1,5-pentanediol, 2,4-dimethyl- (C7) $PO_1$; 1,5-pentanediol, 2,4-dimethyl- (C7) n-$BO_2$; 1,5-pentanediol, 2-ethyl- (C7) $E_{2-5}$; 1,5-pentanediol, 2-ethyl- (C7) n-$BO_1$; 1,5-pentanediol, 2-methyl- (C6) (Me-$E_{1-4}$); 1,5-pentanediol, 2-methyl- (C6) $PO_2$; 1,5-pentanediol, 3,3-dimethyl- (C7) $E_{4-7}$; 1,5-pentanediol, 3,3-dimethyl- (C7) $PO_1$; 1,5-pentanediol, 3,3-dimethyl- (C7) n-$BO_2$; 1,5-pentanediol, 3-methyl- (C6) (Me-$E_{1-4}$); 1,5-pentanediol, 3-methyl- (C6) $PO_2$; 2,3-pentanediol, (C5) (Me-$E_1$-3); 2,3-pentanediol, (C5) $PO_2$; 2,3-pentanediol, 2-methyl- (C6) $E_{4-7}$; 2,3-pentanediol, 2-methyl- (C6) $PO_1$; 2,3-pentanediol, 2-methyl- (C6) n-$BO_2$; 2,3-pentanediol, 3-methyl- (C6) $E_{4-7}$; 2,3-pentanediol, 3-methyl- (C6) $PO_1$; 2,3-pentanediol, 3-methyl- (C6) n-$BO_2$; 2,3-pentanediol, 4-methyl- (C6) $E_{4-7}$; 2,3-pentanediol, 4-methyl- (C6) $PO_1$; 2,3-pentanediol, 4-methyl- (C6) n-$BO_2$; 2,4-pentanediol, (C5) 2(Me-E2-$_4$); 2,4-pentanediol (C5) $PO_4$; 2,4-pentanediol, 2,3-dimethyl- (C7) (Me-$E_{2-4}$); 2,4-pentanediol, 2,3-dimethyl- (C7) $PO_2$; 2,4-pentanediol, 2,4-dimethyl- (C7) (Me-$E_{2-4}$); 2,4-pentanediol, 2,4-dimethyl- (C7) $PO_2$; 2,4-pentanediol, 2-methyl- (C7) (Me-$E_{8-10}$); 2,4-pentanediol, 2-methyl- (C7) $PO_3$; 2,4-pentanediol, 3,3-dimethyl- (C7) (Me-$E_{2-4}$); 2,4-pentanediol, 3,3-dimethyl- (C7) $PO_2$; 2,4-pentanediol, 3-methyl- (C6) (Me-$E_{8-10}$); 2,4-pentanediol, 3-methyl- (C6) $PO_3$;

4. 1,3-hexanediol (C6) (Me-$E_{2-5}$); 1,3-hexanediol (C6) $PO_2$; 1,3-hexanediol (C6) $BO_1$; 1,3-hexanediol, 2-methyl- (C7) $E_{6-8}$; 1,3-hexanediol, 2-methyl- (C7) $PO_1$; 1,3-hexanediol, 2-methyl- (C7) n-$BO_{2-3}$; 1,3-hexanediol, 3-methyl- (C7) $E_{6-8}$; 1,3-hexanediol, 3-methyl- (C7) $PO_1$; 1,3-hexanediol, 3-methyl- (C7) n-$BO_{2-3}$; 1,3-hexanediol, 4-methyl- (C7) $E_{6-8}$; 1,3-hexanediol, 4-methyl- (C7) $PO_1$; 1,3-hexanediol, 4-methyl- (C7) n-$BO_{2-3}$; 1,3-hexanediol, 5-methyl- (C7) $E_{6-8}$; 1,3-hexanediol, 5-methyl- (C7) $PO_1$; 1,3-hexanediol, 5-methyl- (C7) n-$BO_{2-3}$; 1,4-hexanediol (C6) (Me-$E_{2-5}$); 1,4-hexanediol (C6) $PO_2$; 1,4-hexanediol (C6) $BO_1$; 1,4-hexanediol, 2-methyl- (C7) $E_{6-8}$; 1,4-hexanediol, 2-methyl- (C7) $PO_1$; 1,4-hexanediol, 2-methyl- (C7) n-$BO_{2-3}$; 1,4-hexanediol, 3-methyl- (C7) $E_{6-8}$; 1,4-hexanediol, 3-methyl- (C7) $PO_1$; 1,4-hexanediol, 3-methyl- (C7) n-$BO_{2-3}$; 1,4-hexanediol, 4-methyl- (C7) $E_{6-8}$; 1,4-hexanediol, 4-methyl- (C7) $PO_1$; 1,4-hexanediol, 4-methyl- (C7) n-$BO_{2-3}$; 1,4-hexanediol, 5-methyl- (C7) $E_{6-8}$; 1,4-hexanediol, 5-methyl- (C7) $PO_1$; 1,4-hexanediol, 5-methyl- (C7) n-$BO_{2-3}$; 1,5-hexanediol (C6) (Me-$E_{2-5}$); 1,5-hexanediol (C6) $PO_2$; 1,5-hexanediol (C6) $BO_1$; 1,5-hexanediol, 2-methyl- (C7) $E_{6-8}$; 1,5-hexanediol, 2-methyl- (C7) $PO_1$; 1,5-hexanediol, 2-methyl- (C7) n-$BO_{2-3}$; 1,5-hexanediol, 3-methyl- (C7) $E_{6-8}$; 1,5-hexanediol, 3-methyl- (C7) $PO_1$; 1,5-hexanediol, 3-methyl- (C7) n-$BO_{2-3}$; 1,5-hexanediol, 4-methyl- (C7) $E_{6-8}$; 1,5-hexanediol, 4-methyl- (C7) $PO_1$; 1,5-hexanediol, 4-methyl- (C7) n-$BO_{2-3}$; 1,5-hexanediol, 5-methyl- (C7) $E_{6-8}$; 1,5-hexanediol, 5-methyl- (C7) $PO_1$; 1,5-hexanediol, 5-methyl- (C7) n-$BO_{2-3}$; 1,6-hexanediol (C6) (Me-$E_{1-2}$); 1,6-hexanediol (C6) $PO_{1-2}$; 1,6-hexanediol (C6) n-$BO_4$; 1,6-hexanediol, 2-methyl- (C7) $E_{2-5}$; 1,6-hexanediol, 2-methyl- (C7) n-$BO_1$; 1,6-hexanediol, 3-methyl- (C7) $E_{2-5}$; 1,6-hexanediol, 3-methyl- (C7) n-$BO_1$; 2,3-hexanediol (C6) $E_{2-5}$; 2,3-hexanediol (C6) n-$BO_1$; 2,4-hexanediol (C6) (Me-$E_{5-8}$); 2,4-hexanediol (C6) $PO_3$; 2,4-hexanediol, 2-methyl- (C7) (Me-$E_{1-2}$); 2,4-hexanediol 2-methyl- (C7) $PO_{1-2}$; 2,4-hexanediol, 3-methyl- (C7) (Me-$E_{1-2}$); 2,4-hexanediol 3-methyl- (C7) $PO_{1-2}$; 2,4-hexanediol, 4-methyl- (C7) (Me-$E_{1-2}$); 2,4-hexanediol 4-methyl- (C7) $PO_{1-2}$; 2,4-hexanediol, 5-methyl- (C7) (Me-$E_{1-2}$); 2,4-hexanediol 5-methyl- (C7) $PO_{1-2}$; 2,5-hexanediol (C6) (Me-$E_{5-8}$); 2,5-hexanediol (C6) $PO_3$; 2,5-hexanediol, 2-methyl- (C7) (Me-$E_{1-2}$); 2,5-hexanediol 2-methyl- (C7) $PO_{1-2}$; 2,5-hexanediol, 3-methyl- (C7) (Me-$E_{1-2}$); 2,5-hexanediol 3-methyl- (C7) $PO_{1-2}$; 3,4-hexanediol (C6) $EO_{2-5}$; 3,4-hexanediol (C6) n-$BO_1$;

5. 1,3-heptanediol (C7) $E_{3-6}$; 1,3-heptanediol (C7) $PO_1$; 1,3-heptanediol (C7) n-$BO_2$; 1,4-heptanediol (C7) $E_{3-6}$; 1,4-heptanediol (C7) $PO_1$; 1,4-heptanediol (C7) n-$BO_2$; 1,5-heptanediol (C7) $E_{3-6}$; 1,5-heptanediol (C7) $PO_1$; 1,5-heptanediol (C7) n-$BO_2$; 1,6-heptanediol (C7) $E_{3-6}$; 1,6-heptanediol (C7) $PO_1$; 1,6-heptanediol (C7) n-$BO_2$; 1,7-heptanediol (C7) $E_{1-2}$; 1,7-heptanediol (C7) n-$BO_1$; 2,4-heptanediol (C7) $E_{7-10}$; 2,4-heptanediol (C7) (Me-$E_1$); 2,4-heptanediol (C7) $PO_1$; 2,4-heptanediol (C7) n-$BO_3$; 2,5-heptanediol (C7) $E_{7-10}$; 2,5-heptanediol (C7) (Me-$E_1$); 2,5-heptanediol (C7) $PO_1$; 2,5-heptanediol (C7) n-$BO_3$; 2,6-heptanediol (C7) $E_{7-10}$; 2,6-heptanediol (C7) (Me-$E_1$); 2,6-heptanediol (C7) $PO_1$; 2,6-heptanediol (C7) n-$BO_3$; 3,5-heptanediol (C7) $E_{7-10}$; 3,5-heptanediol (C7) (Me-$E_1$); 3,5-heptanediol (C7) $PO_1$; 3,5-heptanediol (C7) n-$BO_3$;

6. 1,3-butanediol, 3-methyl-2-isopropyl- (C8) $PO_1$; 2,4-pentanediol, 2,3,3-trimethyl- (C8) $PO_1$; 1,3-butanediol, 2,2-diethyl- (C8) $E_{2-5}$; 2,4-hexanediol, 2,3-dimethyl- (C8) $E_{2-5}$; 2,4-hexanediol, 2,4-dimethyl- (C8) $E_{2-5}$; 2,4-hexanediol, 2,5-dimethyl- (C8) $E_{2-5}$; 2,4-hexanediol, 3,3-dimethyl- (C8) $E_{2-5}$; 2,4-hexanediol, 3,4-dimethyl- (C8) $E_{2-5}$; 2,4-hexanediol, 3,5-dimethyl- (C8) $E_{2-5}$; 2,4-hexanediol, 4,5-dimethyl- (C8) $E_{2-5}$; 2,4-hexanediol, 5,5-dimethyl- (C8) $E_{2-5}$; 2,5-hexanediol, 2,3-dimethyl- (C8) $E_{2-5}$; 2,5-hexanediol, 2,4-dimethyl- (C8) $E_{2-5}$; 2,5-hexanediol, 2,5-dimethyl- (C8) $E_{2-5}$; 2,5-hexanediol, 3,3-dimethyl- (C8) $E_{2-5}$; 2,5-hexanediol, 3,4-dimethyl- (C8) $E_{2-5}$; 3,5-heptanediol, 3-methyl- (C8) $E_{2-5}$; 1,3-butanediol, 2,2-diethyl- (C8) n-$BO_{1-2}$; 2,4-hexanediol, 2,3-dimethyl- (C8) n-$BO_{1-2}$; 2,4-hexanediol, 2,4-dimethyl- (C8) n-$BO_{1-2}$; 2,4-hexanediol, 2,5-dimethyl- (C8) n-$BO_{1-2}$; 2,4-hexanediol, 3,3-dimethyl- (C8) n-$BO_{1-2}$; 2,4-hexanediol, 3,4-dimethyl- (C8) n-$BO_{1-2}$; 2,4-hexanediol, 3,5-dimethyl- (C8) n-$BO_{1-2}$; 2,4-hexanediol, 4,5-dimethyl- (C8) n-$BO_{1-2}$; 2,4-hexanediol, 5,5-dimethyl-, n-$BO_{1-2}$; 2,5-hexanediol, 2,3-dimethyl- (C8) n-$BO_{1-2}$; 2,5-hexanediol, 2,4-dimethyl- (C8) n-$BO_{1-2}$; 2,5-hexanediol, 2,5-dimethyl- (C8) n-$BO_{1-2}$; 2,5-hexanediol, 3,3-dimethyl- (C8) n-$BO_{1-2}$; 2,5-hexanediol, 3,4-dimethyl- (C8) n-$BO_{1-2}$; 3,5-heptanediol, 3-methyl- (C8) n-$BO_{1-2}$; 1,3-propanediol, 2-(1,2-dimethylpropyl)- (C8) n-$BO_1$; 1,3-butanediol, 2-ethyl-2,3-dimethyl- (C8) n-$BO_1$; 1,3-butanediol, 2-methyl-2-isopropyl- (C8) n-$BO_1$; 1,4-butanediol, 3-methyl-2-isopropyl- (C8) n-$BO_1$; 1,3-pentanediol, 2,2,3-trimethyl- (C8) n-$BO_1$; 1,3-pentanediol, 2,2,4-trimethyl- (C8) n-$BO_1$; 1,3-pentanediol, 2,4,4-trimethyl- (C8) n-$BO_1$; 1,3-pentanediol, 3,4,4-trimethyl- (C8) n-$BO_1$; 1,4-pentanediol, 2,2,3-trimethyl- (C8) n-$BO_1$; 1,4-pentanediol, 2,2,4-trimethyl- (C8) n-$BO_1$; 1,4-pentanediol, 2,3,3-trimethyl- (C8) n-$BO_1$; 1,4-pentanediol, 2,3,4-trimethyl- (C8) n-$BO_1$; 1,4-pentanediol, 3,3,4-trimethyl- (C8) n-$BO_1$; 2,4-pentanediol, 2,3,4-trimethyl- (C8) n-$BO_1$; 2,4-hexanediol, 4-ethyl- (C8) n-$BO_1$; 2,4-heptanediol, 2-methyl- (C8) n-$BO_1$; 2,4-heptanediol, 3-methyl- (C8) n-$BO_1$; 2,4-heptanediol, 4-methyl- (C8) n-$BO_1$; 2,4-heptanediol, 5-methyl- (C8) n-$BO_1$; 2,4-heptanediol, 6-methyl- (C8) n-$BO_1$; 2,5-heptanediol, 2-methyl- (C8) n-$BO_1$; 2,5-heptanediol, 3-methyl- (C8) n-$BO_1$; 2,5-heptanediol, 4-methyl- (C8) n-$BO_1$; 2,5-heptanediol, 5-methyl- (C8) n-$BO_1$; 2,5-heptanediol, 6-methyl- (C8) n-$BO_1$; 2,6-heptanediol, 2-methyl- (C8) n-$BO_1$; 2,6-heptanediol, 3-methyl- (C8) n-$BO_1$; 2,6-heptanediol, 4-methyl- (C8) n-$BO_1$; 3,5-heptanediol, 2-methyl- (C8) n-$BO_1$; 1,3-propanediol, 2-(1,2-dimethylpropyl)- (C8) $E_{1-3}$; 1,3-butanediol, 2-ethyl-2,3-dimethyl- (C8) $E_{1-3}$; 1,3-butanediol, 2-methyl-2-isopropyl- (C8) $E_{1-3}$; 1,4-butanediol, 3-methyl-2-isopropyl- (C8) $E_{1-3}$; 1,3-pentanediol, 2,2,3-trimethyl- (C8) $E_{1-3}$; 1,3-pentanediol, 2,2,4-trimethyl- (C8) $E_{1-3}$; 1,3-pentanediol, 2,4,4-trimethyl- (C8) $E_{1-3}$; 1,3-pentanediol, 3,4,4-trimethyl- (C8) $E_{1-3}$; 1,4-pentanediol, 2,2,3-trimethyl- (C8) $E_{1-3}$; 1,4-pentanediol, 2,2,4-trimethyl- (C8) $E_{1-3}$; 1,4-pentanediol, 2,3,3-trimethyl- (C8) $E_{1-3}$; 1,4-pentanediol, 2,3,4-trimethyl- (C8) $E_{1-3}$; 1,4-pentanediol, 3,3,4-trimethyl- (C8) $E_{1-3}$; 2,4-pentanediol, 2,3,4-trimethyl- (C8) $E_{1-3}$; 2,4-hexanediol, 4-ethyl- (C8) $E_{1-3}$; 2,4-heptanediol, 2-methyl- (C8) $E_{1-3}$; 2,4-heptanediol, 3-methyl- (C8) $E_{1-3}$; 2,4-heptanediol, 4-methyl- (C8) $E_{1-3}$; 2,4-heptanediol, 5-methyl- (C8) $E_{1-3}$; 2,4-heptanediol, 6-methyl- (C8) $E_{1-3}$; 2,5-heptanediol, 2-methyl- (C8) $E_{1-3}$; 2,5-heptanediol, 3-methyl- (C8) $E_{1-3}$; 2,5-heptanediol, 4-methyl- (C8) $E_{1\ 3}$; 2,5-heptanediol, 5-methyl- (C8) $E_{1-3}$; 2,5-heptanediol, 6-methyl- (C8) $E_{1-3}$; 2,6-heptanediol, 2-methyl- (C8) $E_{1-3}$; 2,6-heptanediol, 3-methyl- (C8) $E_{1-3}$; 2,6-heptanediol, 4-methyl- (C8) $E_{1-3}$; and/or 3,5-heptanediol, 2-methyl- (C8) $E_{1-3}$; and 7. mixtures thereof.

Of the nonane isomers, only 2,4-pentadiol, 2,3,3,4-tetramethyl- is highly preferred.

All of the preferred alkyl glyceryl ethers and/or di(hydroxyalkyl)ethers that have been identified are given in Table VI and the most preferred are: 1,2-propanediol, 3-(n-pentyloxy)-; 1,2-propanediol, 3-(2-pentyloxy)-; 1,2-propanediol, 3-(3-pentyloxy)-; 1,2-propanediol, 3-(2-methyl-1-butyloxy)-; 1,2-propanediol, 3-(iso-amyloxy)-; 1,2-propanediol, 3-(3-methyl-2-butyloxy)-; 1,2-propanediol, 3-(cyclohexyloxy)-; 1,2-propanediol, 3-(1-cyclohex-1-enyloxy)-; 1,3-propanediol, 2-(pentyloxy)-; 1,3-propanediol, 2-(2-pentyloxy)-; 1,3-propanediol, 2-(3-pentyloxy)-; 1,3-propanediol, 2-(2-methyl-1-butyloxy)-; 1,3-propanediol, 2-(iso-amyloxy)-; 1,3-propanediol, 2-(3-methyl-2-butyloxy)-; 1,3-propanediol, 2-(cyclohexyloxy)-; 1,3-propanediol, 2-(1-cyclohex-1-enyloxy)-; 1,2-propanediol, 3-(butyloxy)-, pentaethoxylated; 1,2-propanediol, 3-(butyloxy)-, hexaethoxylated; 1,2-propanediol, 3-(butyloxy)-, heptaethoxylated; 1,2-propanediol, 3-(butyloxy)-, octaethoxylated; 1,2-propanediol, 3-(butyloxy)-, nonaethoxylated; 1,2-propanediol, 3-(butyloxy)-, monopropoxylated; 1,2-propanediol, 3-(butyloxy)-, dibutyleneoxylated; and/or 1,2-propanediol, 3-(butyloxy)-, tributyleneoxylated. Preferred aromatic glyceryl ethers include: 1,2-propanediol, 3-phenyloxy-; 1,2-propanediol, 3-benzyloxy-; 1,2-propanediol, 3-(2-phenylethyloxy)-; 1,2-propanediol, 1,3-propanediol, 2-(m-cresyloxy)-; 1,3-propanediol, 2-(p-cresyloxy)-; 1,3-propanediol, 2-benzyloxy-; 1,3-propanediol, 2-(2-phenylethyloxy)-; and mixtures thereof. The more preferred aromatic glyceryl ethers include: 1,2-propanediol, 3-phenyloxy-; 1,2-propanediol, 3-benzyloxy-; 1,2-propanediol, 3-(2-phenylethyloxy)-; 1,2-propanediol, 1,3-propanediol, 2-(m-cresyloxy)-; 1,3-propanediol, 2-(p-cresyloxy)-; 1,3-propanediol, 2-(2-phenylethyloxy)-; and mixtures thereof. The most preferred di(hydroxyalkyl)ethers include: bis(2-hydroxybutyl)ether; and bis(2-hydroxycyclopentyl)ether;

Non-limiting example of synthesis methods to prepare the preferred alkyl and aryl monoglyceryl ethers is given in the copending application Ser. No. 08/679,694, incorporated hereinbefore by reference.

The alicyclic diols and their derivatives that are preferred include: (1) the saturated diols and their derivatives including: 1-isopropyl-1,2-cyclobutanediol; 3-ethyl-4-methyl-1,2-cyclobutanediol; 3-propyl-1,2-cyclobutanediol; 3-isopropyl-1,2-cyclobutanediol; 1-ethyl-1,2-cyclopentanediol; 1,2-dimethyl-1,2-cyclopentanediol; 1,4-dimethyl-1,2-cyclopentanediol; 2,4,5-trimethyl-1,3-cyclopentanediol; 3,3-dimethyl-1,2-cyclopentanediol; 3,4-dimethyl-1,2-cyclopentanediol; 3,5-dimethyl-1,2-cyclopentanediol; 3-ethyl-1,2-cyclopentanediol; 4,4-dimethyl-1,2-cyclopentanediol; 4-ethyl-1,2-cyclopentanediol; 1,1-bis(hydroxymethyl)cyclohexane; 1,2-bis(hydroxymethyl)cyclohexane; 1,2-dimethyl-1,3-cyclohexanediol; 1,3-bis(hydroxymethyl)cyclohexane; 1,3-dimethyl-1,3-cyclohexanediol; 1,6-dimethyl-1,3-cyclohexanediol; 1-hydroxy-cyclohexaneethanol; 1-hydroxy-cyclohexanemethanol; 1-ethyl-1,3-cyclohexanediol; 1-methyl-1,2-cyclohexanediol; 2,2-dimethyl-1,3-cyclohexanediol; 2,3-dimethyl-1,4-cyclohexanediol; 2,4-dimethyl-1,3-cyclohexanediol; 2,5-dimethyl-1,3-cyclohexanediol; 2,6-dimethyl-1,4-cyclohexanediol; 2-ethyl-1,3-cyclohexanediol; 2-hydroxycyclohexaneethanol; 2-hydroxyethyl-1-cyclohexanol; 2-hydroxymethylcyclohexanol; 3-hydroxyethyl-1-cyclohexanol; 3-hydroxycyclohexaneethanol; 3-hydroxymethylcyclohexanol; 3-methyl-1,2-cyclohexanediol; 4,4-dimethyl-1,3-Cyclohexanediol; 4,5-dimethyl-1,3-cyclohexanediol; 4,6-dimethyl-1,3-cyclohexanediol; 4-ethyl-1,3-cyclohexanediol; 4-hydroxyethyl-1-cyclohexanol; 4-hydroxymethylcyclohexanol; 4-methyl-1,2-cyclohexanediol; 5,5-dimethyl-1,3-cyclohexanediol; 5-ethyl-1,3-cyclohexanediol; 1,2-cycloheptanediol; 2-methyl-1,3-cycloheptanediol; 2-methyl-1,4-cycloheptanediol; 4-methyl-1,3-cycloheptanediol; 5-methyl-1,3-cycloheptanediol; 5-methyl-1,4-cycloheptanediol; 6-methyl-1,4-cycloheptanediol; ; 1,3-cyclooctanediol; 1,4-cyclooctanediol; 1,5-cyclooctanediol; 1,2-cyclohexanediol, diethoxylate; 1,2-cyclohexanediol, triethoxylate; 1,2-cyclohexanediol, tetraethoxylate; 1,2-cyclohexanediol, pentaethoxylate; 1,2-cyclohexanediol, hexaethoxylate; 1,2-cyclohexanediol, heptaethoxylate; 1,2-cyclohexanediol, octaethoxylate; 1,2-cyclohexanediol, nonaethoxylate; 1,2-cyclohexanediol, monopropoxylate; 1,2-cyclohexanediol, monobutylenoxylate; 1,2-cyclohexanediol, dibutylenoxylate; and/or 1,2-cyclohexanediol, tributylenoxylate. The most preferred saturated alicyclic diols and their derivatives are: 1-isopropyl-1,2-cyclobutanediol; 3-ethyl-4-methyl-1,2-cyclobutanediol; 3-propyl-1,2-cyclobutanediol; 3-isopropyl-1,2-cyclobutanediol; 1-ethyl-1,2-cyclopentanediol; 1,2-dimethyl-1,2-cyclopentanediol; 1,4-dimethyl-1,2-cyclopentanediol; 3,3-dimethyl-1,2-cyclopentanediol; 3,4-dimethyl-1,2-cyclopentanediol; 3,5-dimethyl-1,2-cyclopentanediol; 3-ethyl-1,2-cyclopentanediol; 4,4-dimethyl-1,2-cyclopentanediol; 4-ethyl-1,2-cyclopentanediol; 1,1-bis(hydroxymethyl)cyclohexane; 1,2-bis(hydroxymethyl)cyclohexane; 1,2-dimethyl-1,3-cyclohexanediol; 1,3-bis(hydroxymethyl)cyclohexane; 1-hydroxy-cyclohexanemethanol; 1-methyl-1,2-cyclohexanediol; 3-hydroxymethylcyclohexanol; 3-methyl-1,2-cyclohexanediol; 4,4-dimethyl-1,3-cyclohexanediol; 4,5-dimethyl-1,3-cyclohexanediol; 4,6-dimethyl-1,3-cyclohexanediol; 4-ethyl-1,3-cyclohexanediol; 4-hydroxyethyl-1-cyclohexanol; 4-hydroxymethylcyclohexanol; 4-methyl-1,2-cyclohexanediol; 1,2-cycloheptanediol; ; 1,2-cyclohexanediol, pentaethoxylate; 1,2-cyclohexanediol, hexaethoxylate; 1,2-cyclohexanediol, heptaethoxylate; 1,2-cyclohexanediol, octaethoxylate; 1,2-cyclohexanediol, nonaethoxylate; 1,2-cyclohexanediol, monopropoxylate; and/or 1,2-cyclohexanediol, dibutylenoxylate.

Preferred aromatic diols include: 1-phenyl-1,2-ethanediol; 1-phenyl-1,2-propanediol; 2-phenyl-1,2-propanediol; 3-phenyl-1,2-propanediol; 1-(3-methylphenyl)-1,3-propanediol; 1-(4-methylphenyl)-1,3-propanediol; 2-methyl-1-phenyl-1,3-propanediol; l-phenyl-1,3-butanediol; 3-phenyl-1,3-butanediol; and/or 1-phenyl-1,4-butanediol, of which, 1-phenyl-1,2-propanediol; 2-phenyl-1,2-propanediol; 3-phenyl-1,2-propanediol; 1-(3-methylphenyl)-1,3-propanediol; 1-(4-methylphenyl)-1,3-propanediol; 2-methyl-1-phenyl-1,3-propanediol; and/or 1-phenyl-1,4-butanediol are the most preferred.

All of the unsaturated materials that are related to the other preferred principal solvents herein by the same relationship, i.e., having one more $CH_2$ group than the corresponding saturated principal solvent and remaining within the effective ClogP range are preferred. However, the specific preferred unsaturated diol principal solvents are: 1,3-butanediol, 2,2-diallyl-; 1,3-butanediol, 2-(1-ethyl-1-propenyl)-; 1,3-butanediol, 2-(2-butenyl)-2-methyl-; 1,3-butanediol, 2-(3-methyl-2-butenyl)-; 1,3-butanediol, 2-ethyl-2-(2-propenyl)-; 1,3-butanediol, 2-methyl-2-(1-methyl-2-propenyl)-; 1,4-butanediol, 2,3-bis(1-methylethylidene)-; 1,3-pentanediol, 2-ethenyl-3-ethyl-; 1,3-pentanediol, 2-ethenyl-4,4-dimethyl-; 1,4-pentanediol, 3-methyl-2-(2-propenyl)-; 4-pentene-1,3-diol, 2-(1,1-dimethylethyl)-; 4-pentene-1,3-diol, 2-ethyl-2,3-dimethyl-; 1,4-hexanediol, 4-ethyl-2-methylene-; 1,5-hexadiene-3,4-diol, 2,3,5-trimethyl-; 1,5-hexanediol, 2-(1-methylethenyl)-; 2-hexene-1,5-diol, 4-ethenyl-2,5-dimethyl-; 1,4-heptanediol, 6-methyl-5-methylene-; 2,4-heptadiene-2,6-diol, 4,6-dimethyl-; 2,6-heptadiene-1,4-diol, 2,5,5-trimethyl-; 2-heptene-1,4-diol, 5,6-dimethyl-; 3-heptene-1,5-diol, 4,6-dimethyl-; 5-heptene-1,3-diol, 2,4-dimethyl-; 5-heptene-1,3-diol, 3,6-dimethyl-; 5-heptene-1,4-diol, 2,6-dimethyl-; 5-heptene-1,4-diol, 3,6-dimethyl-; 6-heptene-1,3-diol, 2,2-dimethyl-; 6-heptene-1,4-diol, 5,6-dimethyl-; 6-heptene-1,5-diol, 2,4-dimethyl-; 6-heptene-1,5-diol, 2-ethylidene-6-methyl-; 6-heptene-2,4-diol, 4-(2-propenyl)-; l-octene-3,6-diol, 3-ethenyl-; 2,4,6-octatriene-1,8-diol, 2,7-dimethyl-; 2,5-octadiene-1,7-diol, 2,6-dimethyl-; 2,5-octadiene-1,7-diol, 3,7-dimethyl-; 2,6-octadiene-1,4-diol, 3,7-dimethyl-(Rosiridol); 2,6-octadiene-1,8-diol, 2-methyl-; 2,7-octadiene-1,4-diol, 3 ,7-dimethyl-; 2,7-octadiene-1,5-diol, 2,6-dimethyl-; 2,7-octadiene-1,6-diol, 2,6-dimethyl-(8-hydroxylinalool); 2,7-octadiene-1,6-diol, 2,7-dimethyl-; 2-octene-1,7-diol, 2-methyl-6-methylene-; 3,5-octadiene-2, 7-diol, 2,7-dimethyl-; 3,5-octanediol, 4-methylene-; 3,7-octadiene-1,6-diol, 2,6-dimethyl-; 4-octene-1,8-diol, 2-methylene-; 6-octene-3,5-diol, 2-methyl-; 6-octene-3,5-diol, 4-methyl-; 7-octene-2,4-diol, 2-methyl-6-methylene-; 7-octene-2,5-diol, 7-methyl-; 7-octene-3,5-diol, 2-methyl-; 1-nonene-3,5-diol; 1-nonene-3,7-diol; 3-nonene-2,5-diol; 4-nonene-2,8-diol; 6,8-nonadiene-1,5-diol; 7-nonene-2,4-diol; 8-nonene-2,4-diol; 8-nonene-2,5-diol; 1,9-decadiene-3,8-diol; and/or 1,9-decadiene-4,6-diol.

Said principal alcohol solvent can also preferably be selected from the group consisting of: 2,5-dimethyl-2,5-hexanediol; 2-ethyl-1,3-hexanediol; 2-methyl-2-propyl-1,3-propanediol; 1,2-hexanediol; and mixtures thereof. More preferably said principal alcohol solvent is selected from the group consisting of 2-ethyl-1,3-hexanediol; 2-methyl-2-propyl-1,3-propanediol; 1,2-hexanediol; and mixtures thereof. Even more preferably, said principal alcohol solvent is selected from the groups consisting of 2-ethyl-1,3-hexanediol; 1,2-hexanediol; and mixtures thereof.

When several derivatives of the same diol with different alkyleneoxy groups can be used, e.g., 2-methyl-2,3-butanediol having 3 to 5 ethyleneoxy groups, or 2 propyleneoxy groups, or 1 butyleneoxy group, it is preferred to use the derivative with the lowest number of groups, i.e., in this case, the derivative with one butyleneoxy group. However, when only about one to about four ethyleneoxy groups are needed to provide good formulatability, such derivatives are also preferred.

The unsaturated homologs/analogs have the same formulatability as the parent saturated principal solvent with the condition that the unsaturated principal solvents have one additional methylene (viz., $CH_2$) group for each double bond in the chemical formula. In other words, there is an apparent "addition rule" in that for each good saturated principal solvent of this invention, which is suitable for the formulation of clear, concentrated fabric softener compositions, there are suitable unsaturated principal solvents where one, or more, $CH_2$ groups are added while, for each $CH_2$ group added, two hydrogen atoms are removed from adjacent carbon atoms in the molecule to form one carbon-carbon double bond, thus holding the number of hydrogen atoms in the molecule constant with respect to the chemical formula of the "parent" saturated principal solvent. This is due to the fact that adding a —$CH_2$— group to a solvent chemical formula has an effect of increasing its ClogP value by about 0.53, while removing two adjacent hydrogen atoms to form a double bond has an effect of decreasing its ClogP value by about a similar amount, viz., about 0.48, thus about compensating for the —$CH_2$— addition. Therefore one goes from a preferred saturated principal solvent to the preferred higher molecular weight unsaturated analogs/homologs containing at least one more carbon atom by inserting one double bond for each additional $CH_2$ group, and thus the total number of hydrogen atoms is kept the same as in the parent saturated principal solvent, as long as the ClogP value of the new solvent remains within the effective 0.15–0.64, preferably from about 0.25 to about 0.62, and more preferably from about 0.40 to about 0.60, range. There is an exception to the above addition rule, in which saturated principal solvents always have unsaturated analogs/homologs with the same degree of acceptability. The exception relates to saturated diol principal solvents having the two hydroxyl groups situated on two adjacent carbon atoms. In some cases, but not always, inserting one, or more, $CH_2$ groups between the two adjacent hydroxyl groups of a poor solvent results in a higher molecular weight unsaturated homolog which is more suitable for the clear, concentrated fabric softener formulation.

It has been discovered that the use of these specific principal alcohol solvents can produce clear, low viscosity, stable fabric softener compositions at surprisingly low principal solvent levels, i.e., less than about 40%, by weight of the composition when the fabric softener actives have the stated IVs and cis/trans ratios. It has also been discovered that the use of the principal alcohol solvents can produce highly concentrated fabric softener compositions, that are stable and can be diluted, e.g. from about 2:1 to about 10:1, to produce compositions with lower levels of fabric softener that are still stable.

As previously discussed, the principal solvents are desirably kept to the lowest levels that are feasible in the present compositions for obtaining translucency or clarity. The presence of water exerts an important effect on the need for the principal solvents to achieve clarity of these compositions. The higher the water content, the higher the principal solvent level (relative to the softener level) is needed to attain product clarity. Inversely, the less the water content, the less principal solvent (relative to the softener) is needed. Thus, at low water levels of from about 5% to about 15%, the softener active-to-principal solvent weight ratio is preferably from about 55:45 to about 85:15, more preferably from about 60:40 to about 80:20. At water levels of from about 15% to about 70%, the softener active-to-principal solvent weight ratio is preferably from about 45:55 to about 70:30, more preferably from about 55:45 to about 70:30. But at high water levels of from about 70% to about 80%, the softener active-to-principal solvent weight ratio is preferably from about 30:70 to about 55:45, more preferably from about 35:65 to about 45:55. At even higher water levels, the softener to principal solvent ratios should also be even higher.

Mixtures of the above principal solvents are particularly preferred, since one of the problems associated with large amounts of solvents is safety. Mixtures decrease the amount of any one material that is present. Odor and flammability can also be mimimized by use of mixtures, especially when one of the principal solvents is volatile and/or has an odor, which is more likely for low molecular weight materials. Suitable solvents that can be used at levels that would not be sufficient to produce a clear product are 2,2,4-trimethyl-1,3-pentane diol; the ethoxylate, diethoxylate, or triethoxylate derivatives of 2,2,4-trimethyl-1,3-pentane diol; and/or 2-ethyl-1,3-hexanediol. Preferred mixtures are those where the majority of the solvent is one, or more, that have been identified hereinbefore as most preferred. The use of mixtures of solvents is also preferred, especially when one, or more, of the preferred principal solvents are solid at room temperature. In this case, the mixtures are fluid, or have lower melting points, thus improving processability of the softener compositions.

It is also discovered that it is possible to substitute for part of a principal solvent or a mixture of principal solvents of this invention with a secondary solvent, or a mixture of secondary solvents, which by themselves are not operable as a principal solvent of this invention, as long as an effective amount of the operable principal solvent(s) of this invention is still present in the liquid concentrated, clear fabric softener composition. An effective amount of the principal solvent(s) of this invention is at least greater than about 5%, preferably more than about 7%, more preferably more than about 10% of the composition, when at least about 15% of the softener active is also present. The substitute solvent(s) can be used at any level, but preferably about equal to, or less than, the amount of operable principal solvent, as defined hereinbefore, that is present in the fabric softener composition.

For example, even though 1,2-pentanediol, 1,3-octanediol, and hydroxy pivalyl hydroxy pivalate (hereinafter, HPHP) having the following formula:

$$HO—CH_2—C(CH_3)_2—CH_2—O—CO—C(CH_3)_2—CH_2—OH \quad \text{(CAS \# 1115-20-4)}$$

are inoperable solvents according to this invention, mixtures of these solvents with the principal solvent, e.g., with the preferred 1,2-hexanediol principal solvent, wherein the 1,2-hexanediol principal solvent is present at effective levels, also provide liquid concentrated, clear fabric softener compositions.

Some of the secondary solvents that can be used are those listed as inoperable hereinbefore and hereinafter, as well as some parent, non-alkoxylated solvents disclosed in Tables VIIIA–VIIIE.

The principal solvent can be used to either make a composition translucent or clear, or can be used to reduce the temperature at which the composition is translucent or clear. Thus the invention also comprises the method of adding the principal solvent, at the previously indicated levels, to a composition that is not translucent, or clear, or which has a temperature where instability occurs that is too high, to make the composition translucent or clear, or, when the composition is clear, e.g., at ambient temperature, or down to a specific temperature, to reduce the temperature at which instability occurs, preferably by at least about 5° C., more preferably by at least about 10° C. The principal advantage of the principal solvent is that it provides the maximum advantage for a given weight of solvent. It is understood that "solvent", as used herein, refers to the effect of the principal solvent and not to its physical form at a given temperature, since some of the principal solvents are solids at ambient temperature.

Alkyl Lactates

Some alkyl lactate esters, e.g., ethyl lactate and isopropyl lactate have ClogP values within the effective range of from about 0.15 to about 0.64, and can form liquid concentrated, clear fabric softener compositions with the fabric softener actives of this invention, but need to be used at a slightly higher level than the more effective diol solvents like 1,2-hexanediol. They can also be used to substitute for part of other principal solvents of this invention to form liquid concentrated, clear fabric softener compositions. This is illustrated in Example I–C.

III. Optional Ingredients (A) Low molecular weight water soluble solvents can also be used at levels of of from 0% to about 12%, preferably from about 1% to about 10%, more preferably from about 2% to about 8%. The water soluble solvents cannot provide a clear product at the same low levels of the principal solvents described hereinbefore but can provide clear product when the principal solvent is not sufficient to provide completely clear product. The presence of these water soluble solvents is therefore highly desirable. Such solvents include: ethanol; isopropanol; 1,2-propanediol; 1,3-propanediol; propylene carbonate; etc. but do not include any of the principal solvents (B). These water soluble solvents have a greater affinity for water in the presence of hydrophobic materials like the softener active than the principal solvents.

(B) Brighteners

The compositions herein can also optionally contain from about 0.005% to 5% by weight of certain types of hydrophilic optical brighteners which also provide a dye transfer inhibition action. If used, the compositions herein will preferably comprise from about 0.001% to 1% by weight of such optical brighteners.

The hydrophilic optical brighteners useful in the present invention are those having the structural formula:

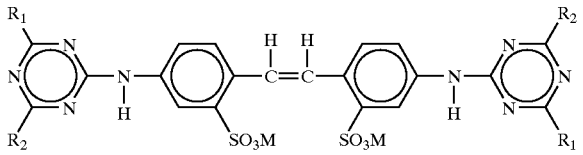

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX® by Ciba-Geigy Corporation. Tinopal-UNPA-GX is the preferred hydrophilic optical brightener useful in the rinse added compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX® by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX® by Ciba Geigy Corporation.

(C) Optional Viscosity/Dispersibility Modifiers

Relatively concentrated compositions containing both saturated and unsaturated diester quaternary ammonium compounds can be prepared that are stable without the addition of concentration aids. However, the compositions of the present invention may require organic and/or inorganic concentration aids to go to even higher concentrations and/or to meet higher stability standards depending on the other ingredients. These concentration aids which typically can be viscosity modifiers may be needed, or preferred, for ensuring stability under extreme conditions when particular softener active levels are used. The surfactant concentration aids are typically selected from the group consisting of (1) nonionic surfactants; (2) amine oxides; (3) fatty acids; and (4) mixtures thereof. These aids are described in P&G Copending Application Ser. No. 08/461,207, filed Jun. 5, 1995, Wahl et al., specifically on page 14, line 12 to page 20, line 12, which is herein incorporated by reference.

When said dispersibility aids are present, the total level is from about 2% to about 25%, preferably from about 3% to about 17%, more preferably from about 4% to about 15%, and even more preferably from 5% to about 13% by weight of the composition. These materials can either be added as part of the active softener raw material, (I), e.g., the mono-long chain alkyl cationic surfactant and/or the fatty acid which are reactants used to form the biodegradable fabric softener active as discussed hereinbefore, or added as a separate component. The total level of dispersibility aid includes any amount that may be present as part of component (I).

(2) Amine Oxides

Suitable amine oxides include those with one alkyl or hydroxyalkyl moiety of about 8 to about 22 carbon atoms, preferably from about 10 to about 18 carbon atoms, more preferably from about 8 to about 14 carbon atoms, and two alkyl moieties selected from the group consisting of alkyl groups and hydroxyalkyl groups with about 1 to about 3 carbon atoms.

Examples include dimethyloctylamine oxide, diethyldecylamine oxide, bis-(2-hydroxyethyl)dodecyl-amine oxide, dimethyldodecylamine oxide, dipropyl-tetradecylamine oxide, methylethylhexadecylamine oxide, dimethyl-2-hydroxyoctadecylamine oxide, and coconut fatty alky (3) Fatty Acids Fatty acids are well known, and suitable fatty acids have been disclosed hereinbefore. They also contribute to lowering the pH.

(D) Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and, preferably, from about 0.01% to about 0.2% for reductive agents. These assure good odor stability under long term storage conditions. Antioxidants and reductive agent stabilizers are especially critical for unscented or low scent products (no or low perfume).

Examples of antioxidants that can be added to the compositions of this invention include a mixture of ascorbic acid, ascorbic palmitate, propyl gallate, available from Eastman Chemical Products, Inc., under the trade names Tenox® PG and Tenox® S-1; a mixture of BHT (butylated hydroxytoluene), BHA (butylated hydroxyanisole), propyl gallate, and citric acid, available from Eastman Chemical Products, Inc., under the trade name Tenox®-6; butylated hydroxytoluene, available from UOP Process Division under the trade name Sustane® BHT; tertiary butylhydroquinone, Eastman Chemical Products, Inc., as Tenox® TBHQ; natural tocopherols, Eastman Chemical Products, Inc., as Tenox® GT-1/ GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1,1-diphosphonic acid (etidronic acid), and Tiron®, available from Kodak with a chemical name of 4,5-dihydroxy-m-benzenesulfonic acid/sodium salt, and DTPA(®, available from Aldrich with a chemical name of diethylenetriaminepentaacetic acid.

(E) Soil Release Agent

In the present invention, an optional soil release agent can be added. The addition of the soil release agent can occur in combination with the premix, in combination with the acid/water seat, before or after electrolyte addition, or after the final composition is made. The softening composition prepared by the process of the present invention herein can contain from 0% to about 10%, preferably from 0.2% to about 5%, of a soil release agent. Preferably, such a soil release agent is a polymer. Polymeric soil release agents useful in the present invention include copolymeric blocks of terephthalate and polyethylene oxide or polypropylene oxide, and the like.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon 4780® (from Dupont) and Milease To (from ICI).

Highly preferred soil release agents are polymers of the generic formula:

$$X-(OCH_2CH_2)_p(O-\overset{O}{\overset{\|}{C}}-R^{14}-\overset{O}{\overset{\|}{C}}-OR^{15})_u(O-\overset{O}{\overset{\|}{C}}-R^{14}-O\overset{O}{\overset{\|}{C}}-O)(CH_2CH_2O-)_n-X$$

in which each X can be a suitable capping group, with each X typically being selected from the group consisting of H, and alkyl or acyl groups containing from about 1 to about 4 carbon atoms. p is selected for water solubility and generally is from about 6 to about 113, preferably from about 20 to about 50. u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^{14}$ moieties are essentially 1,4-phenylene moieties. As used herein, the term "the $R^{14}$ moieties are essentially 1,4-phenylene moieties" refers to compounds where the $R^{14}$ moieties consist entirely of 1,4-phenylene moieties, or are partially substituted with other arylene or alkarylene moieties, alkenyl moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene, and mixtures thereof. Alkylene and alkenylene moieties which can be partially substituted include 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^{14}$ moieties, the degree of partial substitution with moieties other than 1,4-phenylene should be such that the soil release properties of the compound are not adversely affected to any great extent. Generally the degree of partial substitution which can be tolerated will depend upon the backbone length of the compound, i.e., longer backbones can have greater partial substitution for 1,4-phenylene moieties. Usually, compounds where the $R^{14}$ comprise from about 50% to about 100% 1,4-phenylene moieties (from 0% to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^{14}$ moieties consist entirely of (i.e., comprise 100%) 1,4-phenylene moieties, i.e., each $R^{14}$ moiety is 1,4-phenylene.

For the $R^{15}$ moieties, suitable ethylene or substituted ethylene moieties include ethylene, 1,2-propylene, 1,2-butylene, 1,2-hexylene, 3-methoxy-1,2-propylene, and mixtures thereof. Preferably, the $R^{15}$ moieties are essentially ethylene moieties, 1,2-propylene moieties, or mixtures thereof inclusion of a greater percentage of ethylene moieties tends to improve the soil release activity of compounds. Surprisingly, inclusion of a greater percentage of 1,2-propylene moieties tends to improve the water solubility of compounds.

Therefore, the use of 1,2-propylene moieties or a similar branched equivalent is desirable for incorporation of any substantial part of the soil release component in the liquid fabric softener compositions. Preferably, from about 75% to about 100%, are 1,2-propylene moieties.

The value for each p is at least about 6, and preferably is at least about 10. The value for each n usually ranges from about 12 to about 113. Typically the value for each p is in the range of from about 12 to about 43.

A more complete disclosure of soil release agents is contained in U.S. Pat. No.: 4,661,267, Decker, Konig, Straathof, and Gosselink, issued Apr. 28, 1987; U.S. Pat. No. 4,711,730, Gosselink and Diehl, issued Dec. 8, 1987; U.S. Pat. No. 4,749,596, Evans, Huntington, Stewart, Wolf, and Zimmerer, issued Jun. 7, 1988; U.S. Pat. No. 4,818,569, Trinh, Gosselink, and Rattinger, issued Apr. 4, 1989; U.S. Pat. No. 4,877,896, Maldonado, Trinh, and Gosselink, issued Oct. 31, 1989; U.S. Pat. No. 4,956,447, Gosselink et al., issues Sep. 11, 1990; and U.S. Pat. No. 4,976,879, Maldonado, Trinh, and Gosselink, issued Dec. 11, 1990, all of said patents being incorporated herein by reference.

These soil release agents can also act as scum dispersants.

(F) Scum Dispersant

In the present invention, the premix can be combined with an optional scum dispersant, other than the soil release agent, and heated to a temperature at or above the melting point(s) of the components.

The preferred scum dispersants herein are formed by highly ethoxylating hydrophobic materials. The hydrophobic material can be a fatty alcohol, fatty acid, fatty amine, fatty acid amide, amine oxide, quaternary ammonium compound, or the hydrophobic moieties used to form soil release polymers. The preferred scum dispersants are highly ethoxylated, e.g., more than about 17, preferably more than about 25, more preferably more than about 40, moles of ethylene oxide per molecule on the average, with the polyethylene oxide portion being from about 76% to about 97%, preferably from about 81 % to about 94%, of the total molecular weight.

The level of scum dispersant is sufficient to keep the scum at an acceptable, preferably unnoticeable to the consumer, level under the conditions of use, but not enough to adversely affect softening. For some purposes it is desirable that the scum is nonexistent. Depending on the amount of anionic or nonionic detergent, etc., used in the wash cycle of a typical laundering process, the efficiency of the rinsing steps prior to the introduction of the compositions herein, and the water hardness, the amount of anionic or nonionic detergent surfactant and detergency builder (especially phosphates and zeolites) entrapped in the fabric (laundry) will vary. Normally, the minimum amount of scum dispersant should be used to avoid adversely affecting softening properties. Typically scum dispersion requires at least about 2%, preferably at least about 4% (at least 6% and preferably at least 10% for maximum scum avoidance) based upon the level of softener active. However, at levels of about 10% (relative to the softener material) or more, one risks loss of softening efficacy of the product especially when the fabrics contain high proportions of nonionic surfactant which has been absorbed during the washing operation.

Preferred scum dispersants are: Brij 700®; Varonic U-250®; Genapol T-500®, Genapol T-800®; Plurafac A-79®; and Neodol 25-50®.

(G) Bactericides

Examples of bactericides used in the compositions of this invention include glutaraldehyde, formaldehyde, 2-bromo-2-nitro-propane-1,3-diol sold by Inolex Chemicals, located in Philadelphia, Pa., under the trade name Bronopol®, and a mixture of 5-chloro-2-methyl-4-isothiazoline-3-one and 2-methyl-4-isothiazoline-3-one sold by Rohm and Haas Company under the trade name Kathon about 1 to about 1,000 ppm by weight of the agent.

(H) Perfume

The present invention can contain any softener compatible perfume. Suitable perfumes are disclosed in U.S. Pat. No. 5,500,138, Bacon et al., issued Mar. 19, 1996, said patent being incorporated herein by reference.

As used herein, perfume includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

Examples of perfume ingredients useful in the perfumes of the present invention compositions include, but are not limited to, hexyl cinnamic aldehyde; amyl cinnamic aldehyde; amyl salicylate; hexyl salicylate; terpineol; 3,7-dimethyl-cis-2,6-octadien-1-ol; 2,6-dimethyl-2-octanol; 2,6-dimethyl-7-octen-2-ol; 3,7-dimethyl-3-octanol; 3,7-dimethyl-trans-2,6-octadien-1-ol; 3,7-dimethyl-6-octen-1-ol; 3,7-dimethyl-1-octanol; 2-methyl-3-(para-tert-butylphenyl)-propionaldehyde; 4-(4-hydroxy-4-methylpentyl)-3-cyclohexene-1-carboxaldehyde; tricyclodecenyl propionate; tricyclodecenyl acetate; anisaldehyde; 2-methyl-2-(para-iso-propylphenyl)-propionaldehyde; ethyl-3-methyl-3-phenyl glycidate; 4-(para-hydroxyphenyl)-butan-2-one; 1-(2,6,6-trimethyl-2-cyclohexen-1-yl)-2-buten-1-one; para-methoxyacetophenone; para-methoxy-alpha-phenylpropene; methyl-2-n-hexyl-3-oxo-cyclopentane carboxylate; undecalactone gamma.

Additional examples of fragrance materials include, but are not limited to, orange oil; lemon oil; grapefruit oil; bergamot oil; clove oil; dodecalactone gamma; methyl-2-(2-pentyl-3-oxo-cyclopentyl) acetate; beta-naphthol methyl-ether; methyl-beta-naphthylketone; coumarin; decylaldehyde; benzaldehyde; 4-tert-butylcyclohexyl acetate; alpha, alpha-dimethylphenethyl acetate; methylphenylcarbinyl acetate; Schiffs base of 4-(4-hydroxy-4-methylpentyl)-3-cyclohexene-l-carboxaldehyde and methyl anthranilate; cyclic ethyleneglycol diester of tridecandioic acid; 3,7-dimethyl-2,6-octadiene-l-nitrile; ionone gamma methyl; ionone alpha; ionone beta; petitgrain; methyl cedrylone; 7-acetyl-1,2,3,4,5,6,7,8-octahydro-1,1,6,7-tetramethyl-naphthalene; ionone methyl; methyl-1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; benzophenone; 6-acetyl-1,1,2,3,3,5-hexamethyl indane; 5-acetyl-3-isopropyl-1,1,2,6-tetramethyl indane; 1-dodecanal; 7-hydroxy-3,7-dimethyl octanal; 10-undecen-1-al; isohexenyl cyclohexyl carboxaldehyde; formyl tricyclodecan; cyclopentadecanolide; 16-hydroxy-9-hexadecenoic acid lactone; 1,3,4,6,7,8-hexahydro-4,6,6,7,8,8-hexamethylcyclopenta-gamma-2-benzopyrane; ambroxane; dodecahydro-3a,6,6,9a-tetramethylnaphtho- [2,1b]furan; cedrol; 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; cedryl acetate; para-tert-butylcyclohexyl acetate; patchouli; olibanum resinoid; labdanum; vetivert; copaiba balsam; fir balsam; and condensation products of: hydroxycitronellal and methyl anthranilate; hydroxycitronellal and indol; phenyl acetaldehyde and indol; 4-(4-hydroxy-4-methyl pentyl)-3-cyclohexene-1-carboxaldehyde and methyl anthranilate.

More examples of perfume components are geraniol; geranyl acetate; linalool; linalyl acetate; tetrahydrolinalool; citronellol; citronellyl acetate; dihydromyrcenol; dihydromyrcenyl acetate; tetrahydromyrcenol; terpinyl acetate; nopol; nopyl acetate; 2-phenylethanol; 2-phenylethyl acetate; benzyl alcohol; benzyl acetate; benzyl salicylate; benzyl benzoate; styrallyl acetate; dimethylbenzylcarbinol; trichloromethylphenylcarbinyl methylphenylcarbinyl acetate; isononyl acetate; vetiveryl acetate; vetiverol; 2-methyl-3-(p-tert-butylphenyl)-propanal; 2-methyl-3-(p-isopropylphenyl)-propanal; 3-(p-tert-butylphenyl)-propanal; 4-(4-methyl-3-pentenyl)-3-cyclohexenecarbaldehyde; 4-acetoxy-3-pentyltetrahydropyran; methyl dihydrojasmonate; 2-n-heptylcyclopentanone; 3-methyl-2-pentyl-cyclopentanone; n-decanal; n-dodecanal; 9-decenol-1; phenoxyethyl isobutyrate; phenylacetaldehyde dimethylacetal; phenylacetaldehyde diethylacetal; geranonitrile; citronellonitrile; cedryl acetal; 3-isocamphylcyclohexanol; cedryl methylether; isolongifolanone; aubepine nitrile; aubepine; heliotropine; eugenol; vanillin; diphenyl oxide; hydroxycitronellal ionones; methyl ionones; isomethyl ionomes; irones; cis-3-hexenol and esters thereof; indane musk fragrances; tetralin musk fragrances; isochroman musk fragrances; macrocyclic ketones; macrolactone musk fragrances; ethylene brassylate.

The perfumes useful in the present invention compositions are substantially free of halogenated materials and nitromusks.

Suitable solvents, diluents or carriers for perfumes ingredients mentioned above are for examples, ethanol, isopropanol, diethylene glycol, monoethyl ether, dipropylene glycol, diethyl phthalate, triethyl citrate, etc. The amount of such solvents, diluents or carriers incorporated in the perfumes is preferably kept to the minimum needed to provide a homogeneous perfume solution.

Perfume can be present at a level of from 0% to about 15%, preferably from about 0.1% to about 8%, and more preferably from about 0.2% to about 5%, by weight of the finished composition. Fabric softener compositions of the present invention provide improved fabric perfume deposition.

(I) Chelating Agents

The compositions and processes herein can optionally employ one or more copper and/or nickel chelating agents ("chelators"). Such water-soluble chelating agents can be selected from the group consisting of amino carboxylates, amino phosphonates, polyfunctionally-substituted aromatic chelating agents and mixtures thereof, all as hereinafter defined. The whiteness and/or brightness of fabrics are substantially improved or restored by such chelating agents and the stability of the materials in the compositions are improved.

Amino carboxylates useful as chelating agents herein include ethylenedi-aminetetraacetates (EDTA), N-hydroxyethylethylenediaminetriacetates, nitrilotriacetates (NTA), ethylenediamine tetraproprionates, ethylenediamine-N,N'-diglutamates, 2-hyroxypropylenediamine-N,N'-disuccinates, triethylenetetraaminehexacetates, diethylenetriaminepentaacetates (DETPA), and ethanoldiglycines, including their water-soluble salts such as the alkali metal, ammonium, and substituted ammonium salts thereof and mixtures thereof.

Amino phosphonates are also suitable for use as chelating agents in the compositions of the invention when at least low levels of total phosphorus are permitted in detergent compositions, and include ethylenediaminetetrakis (methylenephosphonates), diethylenetriamine-N,N,N',N",N"-pentakis (methane phosphonate) (DETMP) and 1-hydroxyethane-1,1-diphosphonate (HEDP). Preferably, these amino phosphonates to not contain alkyl or alkenyl groups with more than about 6 carbon atoms.

The chelating agents are typically used in the present rinse process at levels from about 2 ppm to about 25 ppm, for periods from 1 minute up to several hours' soaking.

The preferred EDDS chelator used herein (also known as ethylenediamine-N,N'-disuccinate) is the material described in U.S. Pat. No. 4,704,233, cited hereinabove, and has the formula (shown in free acid form):

$$HN(L)C_2H_4N(L)H$$

wherein L is a $CH_2(COOH)CH_2(COOH)$ group.

As disclosed in the patent, EDDS can be prepared using maleic anhydride and ethylenediamine. The preferred biodegradable [S,S] isomer of EDDS can be prepared by reacting L-aspartic acid with 1,2-dibromoethane. The EDDS has advantages over other chelators in that it is effective for chelating both copper and nickel cations, is available in a biodegradable form, and does not contain phosphorus. The EDDS employed herein as a chelator is typically in its salt form, i.e., wherein one or more of the four acidic hydrogens are replaced by a water-soluble cation M, such as sodium, potassium, ammonium, triethanolammonium, and the like. As noted before, the EDDS chelator is also typically used in the present rinse process at levels from about 2 ppm to about 25 ppm for periods from 1 minute up to several hours' soaking. At certain pH's the EDDS is preferably used in combination with zinc cations.

A wide variety of chelators can be used herein. Indeed, simple polycarboxylates such as citrate, oxydisuccinate, and the like, can also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.5% to about 10%, more preferably from about 0.75% to about 5%, by weight of the compositions herein, in addition to those that are stabilizers. Preferred chelators include DETMP, DETPA, NTA, EDDS and mixtures thereof.

(J) Other Optional Ingredients Silicones

The silicone herein can be either a polydimethyl siloxane (polydimethyl silicone or PDMS), or a derivative thereof, e.g., amino silicones, ethoxylated silicones, etc. The PDMS, is preferably one with a low molecular weight, e.g., one having a viscosity of from about 2 to about 5000 cSt, preferably from about 5 to about 500 cSt, more preferably from about 25 to about 200 cSt Silicone emulsions can conveniently be used to prepare the compositions of the present invention. However, preferably, the silicone is one that is, at least initially, not emulsified. I.e., the silicone should be emulsified in the composition itself. In the process of preparing the compositions, the silicone is preferably added to the "water seat", which comprises the water and, optionally, any other ingredients that normally stay in the aqueous phase.

Low molecular weight PDMS is preferred for use in the fabric softener compositions of this invention. The low molecular weight PDMS is easier to formulate without preemulsification.

Silicone derivatives such as amino-functional silicones, quatemized silicones, and silicone derivatives containing Si—OH, Si—H, and/or Si—Cl bonds, can be used. However, these silicone derivatives are normally more substantive to fabrics and can build up on fabrics after repeated treatments to actually cause a reduction in fabric absorbency.

When added to water, the fabric softener composition deposits the biodegradable cationic fabric softening active on the fabric surface to provide fabric softening effects. However, in a typical laundry process, using an automatic washer, cotton fabric water absorbency is appreciably reduced when there is more than about 40 ppm, especially when there is more than about 50 ppm, of the biodegradable cationic fabric softening active in the rinse water. The silicone improves the fabric water absorbency, especially for freshly treated fabrics, when used with this level of fabric softener without adversely affecting the fabric softening performance. The mechanism by which this improvement in water absorbency occurs is not understood, since the silicones are inherently hydrophobic. It is very surprising that there is any improvement in water absorbency, rather than additional loss of water absorbency.

The amount of PDMS needed to provide a noticeable improvement in water absorbency is dependent on the initial rewettability performance, which, in turn, is dependent on the detergent type used in the wash. Effective amounts range from about 2 ppm to about 50 ppm in the rinse water, preferably from about 5 to about 20 ppm. The PDMS to softener active ratio is from about 2:100 to about 50:100, preferably from about 3:100 to about 35:100, more preferably from about 4:100 to about 25:100. As stated hereinbefore, this typically requires from about 0.2% to about 20%, preferably from about 0.5% to about 10%, more preferably from about 1% to about 5% silicone.

The PDMS also improves the ease of ironing in addition to improving the rewettability characteristics of the fabrics. When the fabric care composition contains an optional soil release polymer, the amount of PDMS deposited on cotton fabrics increases and PDMS improves soil release benefits on polyester fabrics. Also, the PDMS improves the rinsing characteristics of the fabric care compositions by reducing the tendency of the compositions to foam during the rinse. Surprisingly, there is little, if any, reduction in the softening characteristics of the fabric care compositions as a result of the presence of the relatively large amounts of PDMS.

The present invention can include other optional components conventionally used in textile treatment compositions, for example: colorants; preservatives; surfactants; anti-shrinkage agents; fabric crisping agents; spotting agents; germicides; fungicides; anti-oxidants such as butylated hydroxy toluene; anti-corrosion agents; enzymes such as proteases, cellulases, amylases, lipases, etc; and the like.

Particularly preferred ingredients include water soluble calcium and/or magnesium compounds, which provide additional stability. The chloride salts are preferred, but acetate, nitrate, etc. salts can be used. The level of said calcium and/or magnesium salts is from 0% to about 2%, preferably from about 0.05% to about 0.5%, more preferably from about 0.1 % to about 0.25%.

The present invention can also include other compatible ingredients, including those as disclosed in copending applications Ser. No.: 08/372,068, filed Jan. 12, 1995, Rusche, et al.; Ser. No. 08/372,490, filed Jan. 12, 1995, Shaw, et al.; and Ser. No. 08/277,558, filed Jul. 19, 1994, Hartman, et al., incorporated herein by reference.

Many synthesis methods can be used to prepare the principal solvents of this invention. Suitable methods are disclosed in the aforesaid copending application, but should not be considered as limiting.

All parts, percentages, proportions, and ratios herein are by weight unless otherwise specified and all numerical values are approximations based upon normal confidence limits. All documents cited are, in relevant part, incorporated herein by reference.

The following non-limiting Examples show both dispersion compositions and clear, or translucent, products with acceptable viscosities.

The clear compositions in the Examples below are made by first preparing an oil seat of softener active and solvent(s). The softener active can be heated, if necessary, to melting if the softener active is not fluid at room temperature. The principal solvent(s) (melted at suitable temperatures if their melting points are above room temperature) are added to the softener premix and said premix is mixed for about 5 minutes. Separately, an acid/water seat is prepared by mixing part of the acid, preferably about half of the amount needed to neutralize the amine softener, with deionized (DI) water at ambient temperature. The remainder of the acid is prepared in the form of a concentrated aqueous solution. If the softener active and/or the principal solvent(s) are not fluid at room temperature and need to be heated, the acid/water seat should also be heated to a suitable temperature, e.g., about 100° F. (about 38° C.) and maintaining said temperature with a water bath. The acid/water seat is then added to the softener premix and mixed for about 5 minutes, and the remainder of the concentrated acid solution is added slowly with mixing. to about 30 minutes or until the composition is clear and homogeneous. The composition is allowed to air cool to ambient temperature.

The following are suitable amine fabric softening actives (FSA) with approximate distributions of fatty acyl groups given, that are used hereinafter for preparing the following compositions.

The following are suitable fabric softening actives (FSA) that are used hereinafter for preparing the following compositions.

FSA[1]: Dioleylmethylamine.
FSA[2]: Di(canola alkyl)methylamine.
FSA[3]: Diisostearylmethylamine.
FSA[4]: 1-Oleylamidoethyl-2-oleylimidazoline.
FSA[5]: 1-(Canola)amidoethyl-2-(canola)imidazoline.
FSA[6]: Di(oleoyloxyethyl)methylamine.
FSA[7]: Di(canolaoyloxyethyl)methylamine.
FSA[8]: Di(canolaoyloxyethyl)(2-hydroxyethyl)amine.
FSA[9]: (hydrogenated tallowoyloxyethyl)(hydrogenated tallowamidotrimethylene) methylamine.
FSA[10]: Di(oleyl)dimethylammonium chloride
FSA[11]: Di(canola alkoyloxyethyl)dimethylammonium chloride
FSA[12]: Di(canola alkoyloxyethyl)(2-hydroxyethyl)methylammonium chloride
FSA[13]: Di(isostearoyloxyethyl)dimethylammonium chloride

EXAMPLE I

| Component | 1 Wt. % | 2 Wt. % | 3 Wt. % | 4 Wt. % | 5 Wt. % | 6 Wt. % | 7 Wt. % | 8 Wt. % |
|---|---|---|---|---|---|---|---|---|
| FSA[1] | 21.2 | 21.2 | 22 | — | — | — | — | 10.6 |
| FSA[2] | — | — | — | 21.2 | — | — | — | — |
| FSA[3] | — | — | — | — | 21.2 | — | — | — |
| FSA[4] | — | — | — | — | — | 24 | — | — |
| FSA[5] | — | — | — | — | — | — | 24 | — |
| FSA[10] | — | — | — | — | — | — | — | 12 |
| 1,2-Hexanediol | 20 | 21 | 20 | 22 | 23 | 23 | 23 | 23 |
| HCl (25%) | 5.8 | 6.4 | 23 | 8.9 | 11.4 | 11.4 | 11.4 | 20 |
| DI Water | Bal. | Bal. | Bal. | Bal. | Bal. | Bal. | Bal. | Bal. |

The above Examples show clear products with acceptable viscosities.

EXAMPLE II

| Component | 1 Wt. % | 2 Wt. % | 3 Wt. % | 4 Wt. % | 5 Wt. % | 6 Wt. % | 7 Wt. % | 8 Wt. % |
|---|---|---|---|---|---|---|---|---|
| FSA[6] | 24.6 | — | — | — | 24.6 | — | — | — |
| FSA[7] | — | 24.6 | — | — | — | 24.6 | — | — |
| FSA[8] | — | — | 24.6 | — | — | — | 24.6 | — |
| FSA[9] | — | — | — | 22 | — | — | — | 22 |
| 1,2-Hexanediol | 22 | 23 | 22 | 20 | 12 | — | 23 | 23 |
| 2,2,4-Trimethyl-1,2-pentanediol | — | — | — | — | 11 | 12 | — | — |
| Cyclohexane-1,4-dimethanol | — | — | — | — | — | 10 | — | — |
| HCl (25%) | 4 | 4 | 4 | 4 | — | 4 | — | — |
| Acetic Acid | 13 | 16 | 13 | 13 | 20 | 13 | — | — |
| Citric Acid | — | — | — | — | — | — | 20 | — |
| Hydroxy-acetic acid | — | — | — | — | — | — | — | 20 |
| DI Water | Bal. | Bal. | Bal. | Bal. | Bal. | Bal. | Bal. | Bal. |

The above Examples show clear products with acceptable viscosities.

EXAMPLE III

| Component | 1 Wt. % | 2 Wt. % | 3 Wt. % | 4 Wt. % | 5 Wt. % | 6 Wt. % | 7 Wt. % |
|---|---|---|---|---|---|---|---|
| FSA[6] | 24.6 | — | — | — | 12 | — | — |
| FSA[7] | — | 24.6 | — | — | — | 12 | — |
| FSA[8] | — | — | 24.6 | — | — | — | 12 |
| FSA[9] | — | — | — | 24 | — | — | — |
| FSA[10] | — | — | — | — | 14 | — | — |
| FSA[11] | — | — | — | — | — | 14 | — |
| FSA[12] | — | — | — | — | — | — | 13 |
| 1,2-Hexanediol | 23 | 23 | 22 | 20 | 21 | 22 | 22 |
| HCl (25%) | 20 | 15 | 12 | 10 | — | 4 | — |
| Acetic Acid | — | — | — | — | 20 | 13 | — |
| Citric Acid | — | — | — | — | — | — | 20 |
| DI Water | Bal. | Bal. | Bal. | Bal. | Bal. | Bal. | Bal. |

The above Examples show clear products with acceptable viscosities.

EXAMPLE IV

| Component | 1 Wt. % | 2 Wt. % | 3 Wt. % | 4 Wt. % | 5 Wt. % | 6 Wt. % | 7 Wt. % | 8 Wt. % |
|---|---|---|---|---|---|---|---|---|
| FSA[1] | 21.1 | — | — | — | — | 10 | — | — |
| FSA[2] | — | 22 | — | — | — | — | — | — |
| FSA[3] | — | — | 22 | — | — | — | — | — |
| FSA[5] | — | — | — | 24 | — | — | — | — |
| FSA[6] | — | — | — | — | 24.6 | — | — | — |
| FSA[7] | — | — | — | — | — | — | 24.6 | — |
| FSA[8] | — | — | — | — | — | — | — | 25 |
| FSA[10] | — | — | — | — | — | 13 | — | — |
| 1,2-Hexanediol | 22 | — | 22 | 11 | 21 | — | 22 | — |
| 2-ethyl-1,3-hexanediol | — | — | 23 | — | — | — | — | 22 |
| 2,2,4-Trimethyl-1,2-pentanediol | — | — | — | 12 | — | 12 | — | — |
| Cyclohexane-1,4-dimethanol | — | — | — | — | — | 10 | — | — |
| Cypro 514[(1)] | 0.4 | — | — | — | 0.4 | — | — | — |
| Magnifloc 587c[(2)] | — | 1 | — | — | — | 1 | — | — |
| SLCQ1[(3)] | — | — | 3 | — | — | — | — | — |
| SLCQ2[(4)] | — | — | — | 3 | — | — | 2.5 | 3 |
| HCl (25%) | 4 | 10 | 10 | 4 | 4 | 4 | 4 | 4 |
| DI Water | Bal. | Bal. | Bal. | Bal. | Bal. | Bal. | Bal. | Bal. |

[(1)]Cypro 514 is a cationic polymer (polyamine, 40K–60K MW) supplied by Cytec Industries, (50% aqueous solution).
[(2)]Magnifloc 587c is a cationic polymer (polyallyldimethylammonium chloride, 80K–120K MW)supplied by Cytec Industries, (20% aqueous solution).
[(3)]Monooleyltrimethylammonium chloride.
[(4)]Monocanolaalkyltrimethylammonium chloride.

EXAMPLE V

| Component | 1 Wt. % | 2 Wt. % | 3 Wt. % | 4 Wt. % | 5 Wt. % |
|---|---|---|---|---|---|
| FSA[1] | 12 | — | — | — | — |
| FSA[2] | — | 22 | — | — | — |

-continued

| Component | 1 Wt. % | 2 Wt. % | 3 Wt. % | 4 Wt. % | 5 Wt. % |
|---|---|---|---|---|---|
| FSA[7] | — | — | 16 | — | 8.6 |
| FSA[8] | — | — | — | 10 | — |
| FSA[10] | 12 | — | 8 | — | 24.6 |
| FSA[11] | — | — | 8 | — | — |
| FSA[12] | — | — | — | 14 | — |

-continued

| Component | 1 Wt. % | 2 Wt. % | 3 Wt. % | 4 Wt. % | 5 Wt. % |
|---|---|---|---|---|---|
| FSA[13] | — | — | — | — | 16 |
| 1,2-Hexanediol | 20 | 21 | — | — | 21 |
| 2-ethyl-1,3-hexanediol | — | — | 22 | — | — |
| 2,2,4-Trimethyl-1,2-pentanediol | — | — | — | 11 | — |
| Cyclohexane-1,4-dimethanol | — | — | — | 10 | — |
| Cypro 514[(1)] | 0.4 | 0.4 | — | — | — |
| Magnifloc 587c[(2)] | — | — | 1 | — | 1 |
| SLCQ1[(3)] | 3 | — | — | — | — |
| SLCQ2[(4)] | — | 3 | — | 4 | — |
| SLCQ3[(5)] | — | — | — | — | 4 |
| HCL (25%) | 10 | 5 | 5 | 4 | 4.5 |
| DI Water | Bal. | Bal. | Bal. | Bal. | Bal. |

[(1)]Cypro 514 is a cationic polymer (polyamine, 40K–60K MW) supplied by Cytec Industries, (50% aqueous solution).
[(2)]Magnifloc 587c is a cationic polymer (polyallyldimethylammonium chloride, 80K–120K MW) supplied by Cytec Industries, (20% aqueous solution).
[(3)]Monooleyltrimethylammonium chloride.
[(4)]Monocanolaalkyltrimethylammonium chloride.
[(5)]Mono(canolaalkoyloxyethyl)trimethylammonium chloride.

For commercial purposes, the above compositions are introduced into containers, specifically bottles, and more specifically clear bottles (although translucent bottles can be used), made from polypropylene (although glass, oriented polyethylene, etc., can be substituted), the bottle having a light blue tint to compensate for any yellow color that is present, or that may develop during storage (although, for short times, and perfectly clear products, clear containers with no tint, or other tints, can be used), and having an ultraviolet light absorber in the bottle to minimize the effects of ultraviolet light on the materials inside, especially the highly unsaturated actives (the absorbers can also be on the surface). The overall effect of the clarity and the container being to demonstrate the clarity of the compositions, thus assuring the consumer of the quality of the product.

The following are nonlimiting Examples of dispersion compositions of the present invention. These compositions commonly do not contain enough of the principal solvent to give them a clarity that is observed in the above Examples. The following are additional suitable fabric softening actives (FSA) that are used hereinafter for preparing the following compositions.

| | |
|---|---|
| FSA[14]: | Ditallowalkylmethylamine. |
| FSA[15]: | Di(hardened tallowalkyl)methylamine. |
| FSA[16]: | 1-(Hardened tallowalkyl)amidoethyl-2-(hardened tallowalkyl)imidazoline. |
| FSA[17]: | Di(tallowalkyl)dimethylammonium chloride |
| FSA[18]:: | Di(hardened tallowalkyl)dimethylammonium chloride |

EXAMPLE VI

| Component | 1 Wt. % | 2 Wt. % | 3 Wt. % | 4 Wt. % | 5 Wt. % | 6 Wt. % | 7 Wt. % | 8 Wt. % |
|---|---|---|---|---|---|---|---|---|
| FSA[1] | 7 | — | — | — | — | 10 | — | — |
| FSA[2] | — | 15 | — | — | — | — | — | — |
| FSA[3] | — | — | 22 | — | — | — | — | — |
| FSA[5] | — | — | — | 24 | — | — | — | — |
| FSA[6] | — | — | — | — | 24.6 | — | — | — |
| FSA[7] | — | — | — | — | — | 10 | — | — |
| FSA[8] | — | — | — | — | — | — | 24 | — |
| FSA[9] | — | — | — | — | — | — | — | 18 |
| Magnifloc 587c[(2)] | — | 1 | — | — | — | — | — | — |
| Acetic Acid | — | — | — | 13 | 16 | — | — | — |
| Citric Acid | — | — | — | — | — | 15 | — | 16 |
| Hydroxy-acetic acid | — | — | — | — | — | — | 15 | — |
| $CaCl_2$ (25%) | 0.3 | 1.3 | 1.8 | 2 | 1.8 | — | 2 | — |
| $MgCl_2$ | — | — | — | 3 | — | 0.3 | — | 0.5 |
| HCL (25%) | 10 | 10 | 10 | 4 | 4 | 2 | 4 | 4 |
| DI Water | Bal. | Bal. | Bal. | Bal. | Bal. | Bal. | Bal. | Bal. |

[(2)]Magnifloc 587c is a cationic polymer (polyallyldimethylammonium chloride, 80K–120K MW) supplied by Cytec Industries, (20% aqueous solution).

| Component | 1 Wt. % | 2 Wt. % | 3 Wt. % | 4 Wt. % | 5 Wt. % | 6 Wt. % | 7 Wt. % | 8 Wt. % |
|---|---|---|---|---|---|---|---|---|
| FSA[1] | 18 | — | — | — | — | — | — | — |
| FSA[2] | — | 15 | — | — | — | — | — | — |
| FSA[3] | — | — | 22 | — | — | — | — | — |
| FSA[5] | — | — | — | 24 | — | — | — | — |
| FSA[6] | — | — | — | — | 24.6 | — | — | — |
| FSA[7] | — | — | — | — | — | 12 | — | — |
| FSA[8] | — | — | — | — | — | — | 11 | — |
| FSA[9] | — | — | — | — | — | — | — | 15 |
| FSA[12] | — | — | — | — | — | — | 14 | — |
| Cypro 514[(1)] | 0.4 | — | — | — | 0.4 | — | — | — |

-continued

| Component | 1 Wt. % | 2 Wt. % | 3 Wt. % | 4 Wt. % | 5 Wt. % | 6 Wt. % | 7 Wt. % | 8 Wt. % |
|---|---|---|---|---|---|---|---|---|
| Magnifloc 587c[2] | — | 1 | — | — | — | — | — | — |
| Acidified PEI[6] | — | — | 8 | — | — | — | 6 | — |
| Tinofix ECO[7] | — | — | — | — | 6.5 | 2 | — | — |
| SLCQ1[3] | 4 | — | — | — | — | — | — | — |
| SLCQ2[4] | — | 2 | — | 3 | — | — | — | — |
| SLCQ3[5] | — | — | — | — | — | — | 3 | — |
| $CaCl_{2\ (25\%)}$ | 1.8 | 1.3 | 1.8 | 2 | 2.4 | 1.4 | 2 | 1.5 |
| HCL (25%) | 12 | 4 | 10 | 4 | 4 | 4 | 4 | 4 |
| DI Water | Bal. | Bal. | Bal. | Bal. | Bal. | Bal. | Bal. | Bal. |

[1]Cypro 514 is a cationic polymer (polyamine, 40K–60K MW) supplied by Cytec Industries, (50% aqueous solution).
[2]Magnifloc 587c is a cationic polymer (polyallyldimethylammonium chloride, 80K–120K MW) supplied by Cytec Industries, (20% aqueous solution).
[3]Monooleyltrimethylammonium chloride.
[4]Monocanolaalkyltrimethylammonium chloride.
[5]Mono(canolaalkoyloxyethyl)trimethylammonium chloride.
[6]The ethoxylated polyethyleneimine (PEI 1200 E1) acid solution is prepared by first diluting the polymer with deionized water to about a 50% concentration, then adding HCl to lower the pH to about 3.0 and trimming with water to obtain an approximate 30% solution.
[7]Tinofix ECO is a proprietary cationlc polymer supplied by Ciba Corporation, an approximate 46.3% solution.

EXAMPLE VIII

| Component | 1 Wt. % | 2 Wt. % | 3 Wt. % | 4 Wt. % | 5 Wt. % | 6 Wt. % | 7 Wt. % | 8 Wt. % |
|---|---|---|---|---|---|---|---|---|
| FSA[9] | 12 | 12 | 22 | 18 | 16 | — | — | — |
| FSA[14] | — | — | — | — | — | 24 | — | — |
| FSA[15] | — | — | — | — | — | — | 22 | — |
| FSA[16] | — | — | — | — | — | — | — | 18 |
| FSA[18] | — | 8 | — | — | — | — | — | 8 |
| Cypro 514[1] | 0.4 | — | — | — | 0.4 | — | — | — |
| Magnifloc 587c[2] | — | 1 | — | — | — | 1 | — | — |
| SLCQ2[4] | — | 2 | 4 | — | — | 4 | 4 | 3 |
| Citric Acid | — | — | — | 12 | — | — | — | — |
| Tricarballylic Acid | — | — | — | — | 10 | — | — | — |
| $CaCl_2$ (25%) | 1.2 | 1.2 | 2 | — | — | 2 | 2.4 | 2 |
| $MgCl_2$ | — | — | — | 0.4 | 0.3 | — | — | — |
| HCL(25%) | 4 | 10 | 7 | 4 | 4 | 4 | 4 | 4 |
| DI Water | Bal. | Bal. | Bal. | Bal. | Bal. | Bal. | Bal. | Bal. |

[1]Cypro 514 is a cationic polymer (polyamine, 40K–60K MW) supplied by Cytec Industries, (50% aqueous solution).
[2]Magnifloc 587c is a cationic polymer (polyallyldimethylammonium chloride, 80K–120K MW) supplied by Cytec Industries, (20% aqueous solution).
[4]Monocanolaalkyltrimethylammonium chloride.

What is claimed is:

1. A fabric softener composition comprising:

(A) from about 2% to about 80% by weight of the composition of a fabric softener active having the formula:

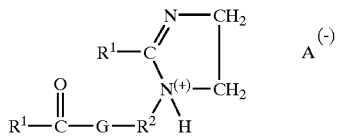

wherein $R^2$ is a $C_{1-6}$ alkylene group; G is an oxygen atom or a —NR— group, wherein R is chosen from H, $C_1$–$C_6$ alkyl, or $C_1$–$C_6$ hydroxyalkyl; each $R^1$ is a $C_6$–$C_{22}$ hydrocarbyl or $C_6$–$C_{22}$ substituted hydrocarbyl; and $A^-$ is a softener compatible anion;

(B) at least one material to increase the cationic charge density of said the fabric softener active; said material comprising a mineral acid or carboxylic acid or a combination thereof, from 3% to about 30% by weight of the composition;

(C) from about 10% about to about 40%, by weight of the composition, of a principal solvent selected from the group consisting of 2,5-dimethyl-2,5-hexanediol; 2-ethyl-1,3-hexanediol; 2-methyl-2-propyl-1,3-propanediol; and mixtures thereof.

2. The composition of claim 1, further comprising from about 0.05% to about 2% of a soluble calcium, chloride, acetate, nitrate, and/or magnesium salt, by weight of the composition.

3. The composition of claim 2 wherein said principal solvent has a ClogP of from about 0.25 to about 0.62.

4. The composition of claim 3 wherein said principal solvent is at a level of from about 10% to about 35%, by weight of the composition.

5. The composition of claim 4 wherein said principal solvent is at a level of from about 12% to about 25%, by weight of the composition, and has a ClogP of from about 0.40 to about 0.60.

6. The composition of claim 3 further comprising a low molecular weight water soluble solvent selected from the group consisting of ethanol, isopropanol, propylene glycol, 1,3-propanediol, propylene carbonate, and mixtures thereof.

7. The composition of claim 2 wherein said fabric softener has an Iodine Value of $R^1$ from about 90 to about 115, with a cis/trans ratio of from about 2:1 to about 40:1.

8. The composition of claim 7 wherein said cis/trans ratio is from about 3:1 to about 30:1.

9. The composition of claim 1 wherein said fabric softener is present at a level of from about 2% to about 17%, by weight of the composition.

10. The composition of claim 1 wherein $R^1$ comprises a $C_{15}$–$C_{17}$ alkyl group.

11. The composition of claim 1 wherein said mineral acid or said carboxylic acid lowers the rinse water pH by at least about 1.

12. The composition of claim 1 wherein said mineral acid or said carboxylic acid lowers the rinse water pH by at least about 0.5 and is at a level being less than about 40%, by weight of the composition.

13. The composition of claim 12 wherein said mineral acid or said carboxylic acid is in an amount greater than about 1%.

14. The composition of claim 1, wherein the composition is clear or translucent.

15. The composition of claim 14, wherein the composition is clear.

16. The composition of claim 14, wherein the fabric softening active is 1-oleylamidoethyl-2-oleylimidazolinium chloride.

* * * * *